US010570469B2

(12) United States Patent
Forbes Jones et al.

(10) Patent No.: US 10,570,469 B2
(45) **Date of Patent: *Feb. 25, 2020**

(54) METHODS FOR PROCESSING ALLOYS

(71) Applicant: ATI Properties LLC, Albany, OR (US)

(72) Inventors: Robin M. Forbes Jones, Saint Helena Island, NC (US); Erin T. McDevitt, Indian Trail, NC (US)

(73) Assignee: ATI PROPERTIES LLC, Albany, OR (US)

( * ) Notice: Subject to any disclaimer, the term of this patent is extended or adjusted under 35 U.S.C. 154(b) by 3 days.

This patent is subject to a terminal disclaimer.

(21) Appl. No.: 15/816,128

(22) Filed: Nov. 17, 2017

(65) Prior Publication Data

US 2018/0073092 A1 Mar. 15, 2018

Related U.S. Application Data

(63) Continuation of application No. 13/777,066, filed on Feb. 26, 2013, now Pat. No. 9,869,003.

(51) Int. Cl.

| | |
|---|---|
| ***C21D 8/00*** | (2006.01) |
| ***C22F 1/10*** | (2006.01) |
| ***C21D 6/00*** | (2006.01) |
| ***C21D 11/00*** | (2006.01) |
| ***C22C 38/00*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/58*** | (2006.01) |

(52) U.S. Cl.

CPC ..... *C21D 8/005* (2013.01); *C21D 6/004* (2013.01); *C21D 6/005* (2013.01); *C21D 6/007* (2013.01); *C21D 11/005* (2013.01); *C22C 38/001* (2013.01); *C22C 38/005* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/58* (2013.01); *C22F 1/10* (2013.01); *C21D 2211/001* (2013.01)

(58) Field of Classification Search

CPC . C21D 8/00; C21D 8/005; C21D 6/00; C21D 6/004; C22C 38/001; C22C 38/005

USPC ..... 148/501

See application file for complete search history.

(56) References Cited

U.S. PATENT DOCUMENTS

| | | | |
|---|---|---|---|
| 2,857,269 | A | 10/1958 | Vordahl |
| 2,893,864 | A | 7/1959 | Harris et al. |
| 2,932,886 | A | 4/1960 | Althouse |
| 2,974,076 | A | 3/1961 | Vordahl |
| 3,015,292 | A | 1/1962 | Bridwell |
| 3,025,905 | A | 3/1962 | Haerr |
| 3,060,564 | A | 10/1962 | Corral |
| 3,082,083 | A | 3/1963 | Levy et al. |
| 3,117,471 | A | 1/1964 | O'Connell et al. |
| 3,313,138 | A | 4/1967 | Spring et al. |
| 3,379,522 | A | 4/1968 | Vordahl |
| 3,436,277 | A | 4/1969 | Bomberger, Jr. et al. |
| 3,469,975 | A | 9/1969 | Bomberger, Jr. et al. |
| 3,489,617 | A | 1/1970 | Wuerfel |
| 3,584,487 | A | 6/1971 | Carlson |
| 3,605,477 | A | 9/1971 | Carlson |
| 3,615,378 | A | 10/1971 | Bomberger, Jr. et al. |
| 3,622,406 | A | 11/1971 | Vordahl |
| 3,635,068 | A | 1/1972 | Watmough et al. |
| 3,649,259 | A | 3/1972 | Heitman |
| 3,676,225 | A | 7/1972 | Owczarski et al. |
| 3,686,041 | A | 8/1972 | Lee |
| 3,802,877 | A | 4/1974 | Parris et al. |
| 3,815,395 | A | 6/1974 | Sass |
| 3,835,282 | A | 9/1974 | Sass et al. |
| 3,922,899 | A | 12/1975 | Fremont et al. |
| 3,979,815 | A | 9/1976 | Nakanose et al. |
| 4,053,330 | A | 10/1977 | Henricks et al. |
| 4,067,734 | A | 1/1978 | Curtis et al. |

(Continued)

FOREIGN PATENT DOCUMENTS

| | | | |
|---|---|---|---|
| CA | 2787980 | A | 7/2011 |
| CN | 1070230 | A | 3/1993 |

(Continued)

OTHER PUBLICATIONS

"Allvac TiOsteum and TiOstalloy Beat Titanium Alloys", printed from www.alivac.com/allvac/pages/Titanium/TiOsteum.htm on Nov. 7, 2005.

"Datasheet: Timetal 21S", Alloy Digest, Advanced Materials and Processes (Sep. 1998), pp. 38-39.

"Heat Treating of Nonferrous Alloys: Heat Treating of Titanium and Titanium Alloys," Metals Handbook, ASM Handbooks Online (2002).

"Stryker Orthopaedics TMF® Alloy (UNS R58120)", printed from www.allvac.com/allvac/pages/Titanium/UNSR58120.htm on Nov. 7, 2005.

"Technical Data Sheet: Allvace® Ti-15Mo Beta Titanium Alloy" (dated Jun. 16, 2004).

(Continued)

*Primary Examiner* — Edward M Johnson

(74) *Attorney, Agent, or Firm* — K&L Gates LLP; Robert J. Toth

(57) ABSTRACT

A method of processing a workpiece to inhibit precipitation of intermetallic compounds includes at least one of thermomechanically processing and cooling a workpiece including an austenitic alloy. During the at least one of thermomechanically working and cooling the workpiece, the austenitic alloy is at temperatures in a temperature range spanning a temperature just less than a calculated sigma solvus temperature of the austenitic alloy down to a cooling temperature for a time no greater than a critical cooling time.

38 Claims, 17 Drawing Sheets

(56) References Cited

U.S. PATENT DOCUMENTS 4,094,708 A 6/1978 Hubbard et al.
4,098,623 A 7/1978 Ibaraki et al.
4,120,187 A 10/1978 Mullen
4,138,141 A 2/1979 Andersen
4,147,639 A 4/1979 Lee et al.
4,150,279 A 4/1979 Metcalfe et al.
4,163,380 A 8/1979 Masoner
4,197,643 A 4/1980 Burstone et al.
4,229,216 A 10/1980 Paton et al.
4,299,626 A 11/1981 Paton et al.
4,309,226 A 1/1982 Chen
4,472,207 A 9/1984 Kinoshita et al.
4,473,125 A 9/1984 Addudle et al.
4,482,398 A 11/1984 Eylon et al.
4,510,788 A 4/1985 Ferguson et al.
4,543,132 A 9/1985 Berczik et al.
4,614,550 A 9/1986 Leonard et al.
4,631,092 A 12/1986 Ruckle et al.
4,639,281 A 1/1987 Sastry et al.
4,668,290 A 5/1987 Wang et al.
4,687,290 A 8/1987 Prussas
4,688,290 A 8/1987 Hogg
4,690,716 A 9/1987 Sabol et al.
4,714,468 A 12/1987 Wang et al.
4,798,632 A 1/1989 Yonezawa et al.
4,799,975 A 1/1989 Ouchi et al.
4,808,249 A 2/1989 Eyelon et al.
4,842,653 A 6/1989 Wirth et al.
4,851,055 A 7/1989 Eylon et al.
4,854,977 A 8/1989 Alheritiere et al.
4,857,269 A 8/1989 Wang et al.
4,878,966 A 11/1989 Alheritiere et al.
4,888,973 A 12/1989 Comley
4,889,170 A 12/1989 Mae et al.
4,917,728 A 4/1990 Enright
4,919,728 A 4/1990 Kohl et al.
4,943,412 A 7/1990 Bania et al.
4,957,567 A 9/1990 Krueger et al.
4,975,125 A 12/1990 Chakrabarti et al.
4,980,127 A 12/1990 Parris et al.
5,026,520 A 6/1991 Bhowal et al.
5,032,189 A 7/1991 Eylon et al.
5,041,262 A 8/1991 Gigliotti, Jr.
5,074,907 A 12/1991 Amato et al.
5,080,727 A 1/1992 Aihara et al.
5,094,812 A 3/1992 Dulmaine et al.
5,141,566 A 8/1992 Kitayama et al.
5,156,807 A 10/1992 Nagata et al.
5,162,159 A 11/1992 Tenhover et al.
5,169,597 A 12/1992 Davidson et al.
5,173,134 A 12/1992 Chakrabarti et al.
5,201,457 A 4/1993 Kitayama et al.
5,244,517 A 9/1993 Kimura et al.
5,256,369 A 10/1993 Ogawa et al.
5,264,055 A 11/1993 Champin et al.
5,277,718 A 1/1994 Paxson et al.
5,310,522 A 5/1994 Culling
5,330,591 A 7/1994 Vasseur
5,332,454 A 7/1994 Meredith et al.
5,332,545 A 7/1994 Love
5,342,458 A 8/1994 Adams et al.
5,358,586 A 10/1994 Schutz
5,359,872 A 11/1994 Nashiki
5,360,496 A 11/1994 Kuhlman et al.
5,374,323 A 12/1994 Kuhlman et al.
5,399,212 A 3/1995 Chakrabarti et al.
5,442,847 A 8/1995 Semiatin et al.
5,472,526 A 12/1995 Gifiliotti, Jr.
5,494,636 A 2/1996 Dupoiron et al.
5,509,979 A 4/1996 Kimura
5,516,375 A 5/1996 Ogawa et al.
5,520,879 A 5/1996 Saito et al.
5,527,403 A 6/1996 Schirra et al.
5,545,262 A 8/1996 Hardee et al.
5,545,268 A 8/1996 Yashiki et al.
5,547,523 A 8/1996 Blankenship et al.
5,558,728 A 9/1996 Kobayashi et al.
5,530,665 A 12/1996 Taguchi et al.
5,600,989 A 2/1997 Segal et al.
5,649,280 A 7/1997 Blankenship et al.
5,658,403 A 8/1997 Kimura
5,662,745 A 9/1997 Takayama et al.
5,679,183 A 10/1997 Takagi et al.
5,698,050 A 12/1997 El-Soudani
5,758,420 A 6/1998 Schmidt et al.
5,759,305 A 6/1998 Benz et al.
5,759,484 A 6/1998 Kashii et al.
5,795,413 A 8/1998 Gorman
5,871,595 A 2/1999 Ahmed et al.
5,896,643 A 4/1999 Tanaka
5,897,830 A 4/1999 Abkowitz et al.
5,904,204 A 5/1999 Teraoka et al.
5,954,724 A 9/1999 Davidson
5,980,655 A 11/1999 Kosaka
6,002,118 A 12/1999 Kawano et al.
6,032,508 A 3/2000 Ashworth et al.
6,044,685 A 4/2000 Delgado et al.
6,053,993 A 4/2000 Reichman et al.
6,059,904 A 5/2000 Benz et al.
6,071,360 A 6/2000 Gillespie
6,077,369 A 6/2000 Kusano et al.
6,127,044 A 10/2000 Yamamoto et al.
6,132,526 A 10/2000 Carisey et al.
6,139,659 A 10/2000 Takahashi et al.
6,143,241 A 11/2000 Hataligol et al.
6,187,045 B1 2/2001 Fehring et al.
6,197,129 B1 3/2001 Zhu et al.
6,200,685 B1 3/2001 Davidson
6,209,379 B1 4/2001 Nishida et al.
6,216,508 B1 4/2001 Matsubara et al.
6,228,189 B1 5/2001 Oyama et al.
6,250,812 B1 6/2001 Ueda et al.
6,258,182 B1 7/2001 Schetky et al.
6,284,071 B1 9/2001 Suzuki et al.
6,332,935 B1 12/2001 Gorman et al.
6,334,350 B1 1/2002 Shin et al.
6,334,912 B1 1/2002 Ganin et al.
6,384,388 B1 5/2002 Anderson et al.
6,387,197 B1 5/2002 Bewlay et al.
6,391,128 B2 5/2002 Ueda et al.
6,399,215 B1 6/2002 Zhu et al.
6,402,859 B1 6/2002 Ishii et al.
6,409,852 B1 6/2002 Lin et al.
6,532,786 B1 3/2003 Luttgeharm
6,536,110 B2 3/2003 Smith et al.
6,539,607 B1 4/2003 Fehring et al.
6,539,765 B2 4/2003 Gates
6,558,273 B2 5/2003 Kobayashi et al.
6,561,002 B2 5/2003 Okada et al.
6,569,270 B2 5/2003 Segal
6,576,068 B2 6/2003 Grubb et al.
6,607,693 B1 8/2003 Saito et al.
6,632,304 B2 10/2003 Oyama et al.
6,632,396 B1 10/2003 Tetjukhin et al.
6,663,501 B2 12/2003 Chen
6,726,784 B2 4/2004 Oyama et al.
6,742,239 B2 6/2004 Lee et al.
6,764,647 B2 7/2004 Aigner et al.
6,773,520 B1 8/2004 Fehring et al.
6,786,985 B2 9/2004 Kosaka et al.
6,800,153 B2 10/2004 Ishii et al.
6,823,705 B2 11/2004 Fukuda et al.
6,908,517 B2 6/2005 Segal et al.
6,918,971 B2 7/2005 Fujii et al.
6,932,877 B2 8/2005 Raymond et al.
6,939,415 B2 9/2005 Iseda et al.
6,954,525 B2 10/2005 Deo et al.
6,971,256 B2 12/2005 Okada et al.
7,008,491 B2 3/2006 Woodfield
7,010,950 B2 3/2006 Cai et al.
7,032,426 B2 4/2006 Durney et al.
7,037,389 B2 5/2006 Barbier et al.
7,038,426 B2 5/2006 Hill
7,081,173 B2 7/2006 Bahar et al.

(56) References Cited

U.S. PATENT DOCUMENTS

| | | | |
|---|---|---|---|
| 7,096,596 | B2 | 8/2006 | Hernandez, Jr. et al. |
| 7,132,021 | B2 | 11/2006 | Kuroda et al. |
| 7,152,449 | B2 | 12/2006 | Durney et al. |
| 7,264,682 | B2 | 9/2007 | Chandran et al. |
| 7,269,986 | B2 | 9/2007 | Pfaffmann et al. |
| 7,332,043 | B2 | 2/2008 | Tetyukhin et al. |
| 7,410,610 | B2 | 8/2008 | Woodfield et al. |
| 7,438,849 | B2 | 10/2008 | Kuramoto et al. |
| 7,449,075 | B2 | 11/2008 | Woodfield et al. |
| 7,536,892 | B2 | 5/2009 | Amino et al. |
| 7,559,221 | B2 | 7/2009 | Horita et al. |
| 7,601,232 | B2 | 10/2009 | Fonte et al. |
| 7,611,592 | B2 | 11/2009 | Davis et al. |
| 7,708,841 | B2 | 5/2010 | Saller et al. |
| 7,837,812 | B2 | 11/2010 | Marquardt et al. |
| 7,879,286 | B2 | 2/2011 | Miracle et al. |
| 7,947,136 | B2 | 5/2011 | Saller |
| 7,984,635 | B2 | 7/2011 | Callebaut et al. |
| 8,037,730 | B2 | 10/2011 | Polen et al. |
| 8,043,446 | B2 | 10/2011 | Jung et al. |
| 8,048,240 | B2 | 11/2011 | Hebda et al. |
| 8,128,764 | B2 | 3/2012 | Miracle et al. |
| 8,211,548 | B2 | 7/2012 | Chun et al. |
| 8,226,568 | B2 | 7/2012 | Watson et al. |
| 8,311,706 | B2 | 11/2012 | Lu et al. |
| 8,316,687 | B2 | 11/2012 | Slattery |
| 8,336,359 | B2 | 12/2012 | Werz |
| 8,408,039 | B2 | 4/2013 | Cao et al. |
| 8,430,075 | B2 | 4/2013 | Qiao et al. |
| 8,454,765 | B2 | 6/2013 | Saller et al. |
| 8,499,605 | B2 | 8/2013 | Bryan |
| 8,551,264 | B2 | 10/2013 | Kosaka et al. |
| 8,568,540 | B2 | 10/2013 | Marquardt et al. |
| 8,578,748 | B2 | 11/2013 | Huskamp et al. |
| 8,597,442 | B2 | 12/2013 | Hebda et al. |
| 8,597,443 | B2 | 12/2013 | Hebda et al. |
| 8,608,913 | B2 | 12/2013 | Shim et al. |
| 8,613,818 | B2 | 12/2013 | Forbes Jones et al. |
| 8,623,155 | B2 | 1/2014 | Marquardt et al. |
| 8,652,400 | B2 | 2/2014 | Forbes Jones et al. |
| 8,679,269 | B2 | 3/2014 | Goller et al. |
| 8,834,653 | B2 | 9/2014 | Bryan |
| 8,919,168 | B2 | 12/2014 | Valiev et al. |
| 9,034,247 | B2 | 5/2015 | Suzuki et al. |
| 9,050,647 | B2 | 6/2015 | Thomas et al. |
| 9,192,981 | B2 | 11/2015 | Forbes Jones et al. |
| 9,206,497 | B2 | 12/2015 | Bryan et al. |
| 9,255,316 | B2 | 2/2016 | Bryan |
| 9,327,342 | B2 | 5/2016 | Oppenheimer et al. |
| 9,523,137 | B2 | 12/2016 | Marquardt et al. |
| 9,616,480 | B2 | 4/2017 | Forbes Jones et al. |
| 9,624,567 | B2 | 4/2017 | Bryan et al. |
| 9,732,408 | B2 | 8/2017 | Sanz et al. |
| 9,765,420 | B2 | 9/2017 | Bryan |
| 9,777,361 | B2 | 10/2017 | Thomas et al. |
| 9,796,005 | B2 | 10/2017 | Hebda et al. |
| 9,869,003 | B2 * | 1/2018 | Forbes Jones ..... C21D 8/005 |
| 2002/0033717 | A1 | 3/2002 | Matsuo |
| 2003/0168138 | A1 | 9/2003 | Marquardt |
| 2004/0099350 | A1 | 5/2004 | Manitone et al. |
| 2004/0148997 | A1 | 8/2004 | Amino et al. |
| 2004/0221929 | A1 | 11/2004 | Hebda et al. |
| 2004/0250932 | A1 | 12/2004 | Briggs |
| 2005/0047952 | A1 | 3/2005 | Coleman |
| 2005/0145310 | A1 | 7/2005 | Bewlay et al. |
| 2006/0045789 | A1 | 3/2006 | Nasserrafi et al. |
| 2006/0110614 | A1 | 5/2006 | Liimatainen |
| 2006/0243356 | A1 | 11/2006 | Oikawa et al. |
| 2007/0009858 | A1 | 1/2007 | Hatton et al. |
| 2007/0017273 | A1 | 1/2007 | Haug et al. |
| 2007/0098588 | A1 | 5/2007 | Narita et al. |
| 2007/0193662 | A1 | 8/2007 | Jablokov et al. |
| 2008/0000554 | A1 | 1/2008 | Yaguchi et al. |
| 2008/0103543 | A1 | 5/2008 | Li et al. |
| 2008/0107559 | A1 | 5/2008 | Nishiyama et al. |
| 2008/0202189 | A1 | 8/2008 | Otaki |
| 2008/0210345 | A1 | 9/2008 | Tetyukhin et al. |
| 2008/0264932 | A1 | 10/2008 | Hirota |
| 2009/0000706 | A1 | 1/2009 | Huron et al. |
| 2009/0183804 | A1 | 7/2009 | Zhao et al. |
| 2009/0234385 | A1 | 9/2009 | Cichocki et al. |
| 2011/0180188 | A1 | 7/2011 | Bryan et al. |
| 2011/0183151 | A1 | 7/2011 | Yokoyama et al. |
| 2012/0067100 | A1 | 3/2012 | Stefansson et al. |
| 2012/0076611 | A1 | 3/2012 | Bryan |
| 2012/0076612 | A1 | 3/2012 | Bryan |
| 2012/0076686 | A1 | 3/2012 | Bryan |
| 2012/0279351 | A1 | 11/2012 | Gu et al. |
| 2013/0062003 | A1 | 3/2013 | Shulkin et al. |
| 2013/0156628 | A1 | 6/2013 | Forbes Jones et al. |
| 2014/0076471 | A1 | 3/2014 | Forbes Jones et al. |
| 2014/0261922 | A1 | 9/2014 | Thomas et al. |
| 2015/0129093 | A1 | 5/2015 | Forbes Jones et al. |
| 2016/0122851 | A1 | 5/2016 | Jones et al. |
| 2016/0201165 | A1 | 7/2016 | Foltz, IV |
| 2017/0058387 | A1 | 3/2017 | Marquardt et al. |
| 2017/0146046 | A1 | 5/2017 | Foltz, IV |
| 2017/0218485 | A1 | 8/2017 | Jones et al. |
| 2017/0321313 | A1 | 11/2017 | Thomas et al. |
| 2017/0349977 | A1 | 12/2017 | Forbes Jones et al. |
| 2018/0016670 | A1 | 1/2018 | Bryan |
| 2018/0195155 | A1 | 7/2018 | Bryan |

FOREIGN PATENT DOCUMENTS

| | | | |
|---|---|---|---|
| CN | 1194671 | A | 9/1998 |
| CN | 1403622 | | 3/2003 |
| CN | 1816641 | A | 8/2006 |
| CN | 101104898 | A | 1/2008 |
| CN | 101205593 | A | 6/2008 |
| CN | 101294264 | A | 10/2008 |
| CN | 101684530 | A | 3/2010 |
| CN | 101637789 | B | 6/2011 |
| CN | 102212716 | A | 10/2011 |
| CN | 102816953 | A | 12/2012 |
| DE | 19743802 | A1 | 3/1999 |
| DE | 10128199 | A1 | 12/2002 |
| DE | 102010009185 | A1 | 11/2011 |
| EP | 0066361 | A2 | 12/1982 |
| EP | 0109350 | A2 | 5/1984 |
| EP | 0320820 | A1 | 6/1989 |
| EP | 0535817 | B1 | 4/1995 |
| EP | 0611831 | B1 | 1/1997 |
| EP | 0834580 | A1 | 4/1998 |
| EP | 0870845 | A1 | 10/1998 |
| EP | 0707085 | B1 | 1/1999 |
| EP | 0683242 | B1 | 5/1999 |
| EP | 0969109 | A1 | 1/2000 |
| EP | 1083243 | A2 | 3/2001 |
| EP | 1136582 | A1 | 9/2001 |
| EP | 1302554 | A1 | 4/2003 |
| EP | 1302555 | A1 | 4/2003 |
| EP | 1433863 | | 6/2004 |
| EP | 1471158 | A1 | 10/2004 |
| EP | 1605073 | A1 | 12/2005 |
| EP | 1612289 | A2 | 1/2006 |
| EP | 1375690 | B1 | 3/2006 |
| EP | 1717330 | A1 | 11/2006 |
| EP | 1882752 | A2 | 1/2008 |
| EP | 2028435 | A1 | 2/2009 |
| EP | 2281908 | A1 | 2/2011 |
| EP | 1546429 | B1 | 6/2012 |
| FR | 2545104 | A1 | 11/1984 |
| GB | 847103 | | 9/1960 |
| GB | 1170997 | A | 11/1969 |
| GB | 1345048 | | 1/1974 |
| GB | 1433306 | | 4/1976 |
| GB | 2151260 | A | 7/1985 |
| GB | 2198144 | A | 6/1988 |
| GB | 2337762 | A | 12/1999 |
| JP | 55-113865 | A | 9/1980 |
| JP | 57-62820 | A | 4/1982 |
| JP | 57-62846 | A | 4/1982 |
| JP | S58-210158 | A | 12/1983 |

(56) References Cited

FOREIGN PATENT DOCUMENTS

| | | | |
|---|---|---|---|
| JP | 60-046358 | | 3/1985 |
| JP | 60-100655 | A | 6/1985 |
| JP | S61-060871 | | 3/1986 |
| JP | S61-217564 | A | 9/1986 |
| JP | S61-270356 | A | 11/1986 |
| JP | 62-109956 | A | 5/1987 |
| JP | 62-127074 | A | 6/1987 |
| JP | 62-149859 | A | 7/1987 |
| JP | S62-227597 | A | 10/1987 |
| JP | S62-247023 | A | 10/1987 |
| JP | S63-49302 | A | 3/1988 |
| JP | S63-188426 | A | 8/1988 |
| JP | H01-272750 | A | 10/1989 |
| JP | 1-279738 | A | 11/1989 |
| JP | 2-205661 | A | 8/1990 |
| JP | 3-134124 | A | 6/1991 |
| JP | H03-138343 | A | 6/1991 |
| JP | H03-166350 | A | 7/1991 |
| JP | H03-264618 | A | 11/1991 |
| JP | H03-274238 | A | 12/1991 |
| JP | 4-74856 | A | 3/1992 |
| JP | 4-103737 | A | 4/1992 |
| JP | 4-143236 | A | 5/1992 |
| JP | 4-168227 | A | 6/1992 |
| JP | 5-59510 | A | 3/1993 |
| JP | 5-117791 | A | 5/1993 |
| JP | 5-195175 | A | 8/1993 |
| JP | H05-293555 | A | 11/1993 |
| JP | H06-93389 | A | 4/1994 |
| JP | 8-300044 | A | 11/1996 |
| JP | 9-143650 | | 6/1997 |
| JP | 9-194969 | A | 7/1997 |
| JP | 9-215786 | A | 8/1997 |
| JP | H10-128459 | A | 5/1998 |
| JP | H10-306335 | A | 11/1998 |
| JP | H11-21642 | A | 1/1999 |
| JP | H11-309521 | A | 11/1999 |
| JP | H11-319958 | A | 11/1999 |
| JP | 11-343528 | A | 12/1999 |
| JP | 11-343548 | A | 12/1999 |
| JP | 2000-153372 | A | 6/2000 |
| JP | 2000-234887 | A | 8/2000 |
| JP | 2001-71037 | A | 3/2001 |
| JP | 2001-081537 | A | 3/2001 |
| JP | 2001-343472 | A | 12/2001 |
| JP | 2002-69591 | A | 3/2002 |
| JP | 2002-146497 | A | 5/2002 |
| JP | 2003-55749 | A | 2/2003 |
| JP | 2003-74566 | A | 3/2003 |
| JP | 2003-285126 | A | 10/2003 |
| JP | 2003-334633 | A | 11/2003 |
| JP | 2004-131761 | | 4/2004 |
| JP | 2005-281855 | A | 10/2005 |
| JP | 2007-291488 | A | 11/2007 |
| JP | 2007-327118 | A | 12/2007 |
| JP | 2008-200730 | A | 9/2008 |
| JP | 2009-138218 | A | 6/2009 |
| JP | WO 2009/142228 | A1 | 11/2009 |
| JP | 2009-299110 | A | 12/2009 |
| JP | 2009-299120 | A | 12/2009 |
| JP | 2010-70833 | A | 4/2010 |
| JP | 2012-140690 | A | 7/2012 |
| JP | 2015-54332 | A | 3/2015 |
| KR | 92000946 | | 6/1992 |
| KR | 10-2005-0087765 | A | 8/2005 |
| KR | 10-2009-0069647 | A | 7/2009 |
| RU | 2003417 | C1 | 11/1993 |
| RU | 1131234 | C | 10/1994 |
| RU | 2156828 | C1 | 9/2000 |
| RU | 2197555 | C1 | 7/2001 |
| RU | 2172359 | C1 | 8/2001 |
| RU | 2217260 | C1 | 11/2003 |
| RU | 2234998 | C1 | 8/2004 |
| RU | 2269584 | C1 | 2/2006 |
| RU | 2288967 | C1 | 12/2006 |
| RU | 2364660 | C1 | 8/2009 |
| RU | 2368695 | C1 | 9/2009 |
| RU | 2378410 | C1 | 1/2010 |
| RU | 2392348 | C2 | 6/2010 |
| RU | 2393936 | C1 | 7/2010 |
| RU | 2441089 | C1 | 2/2012 |
| SU | 534518 | A1 | 1/1977 |
| SU | 631234 | A | 11/1978 |
| SU | 1077328 | A | 5/1982 |
| SU | 1135798 | A1 | 1/1985 |
| SU | 1088397 | A1 | 2/1991 |
| UA | 38805 | A | 5/2001 |
| UA | a200613448 | | 6/2008 |
| UA | 40862 | A | 8/2011 |
| WO | WO 98/17836 | A1 | 4/1998 |
| WO | WO 98/22629 | A | 5/1998 |
| WO | WO 02/36847 | A2 | 5/2002 |
| WO | WO 02/070763 | A1 | 9/2002 |
| WO | WO 02/086172 | A1 | 10/2002 |
| WO | WO 02/090607 | A1 | 11/2002 |
| WO | WO 2004/101838 | A1 | 11/2004 |
| WO | WO 2007/084178 | A2 | 7/2007 |
| WO | WO 2007/114439 | A1 | 10/2007 |
| WO | WO 2007/142379 | A1 | 12/2007 |
| WO | WO 2008/017257 | A1 | 2/2008 |
| WO | WO 2009/082498 | A1 | 7/2009 |
| WO | WO 2010/084883 | A1 | 7/2010 |
| WO | WO 2012/063504 | A1 | 5/2012 |
| WO | WO 2012/147742 | A1 | 11/2012 |
| WO | WO 2013/081770 | A1 | 8/2013 |
| WO | WO 2013/130139 | A2 | 9/2013 |

OTHER PUBLICATIONS

ASM Materials Engineering Dictionary, "Blasting or Blast Cleaning," J.R. Davis Ed., ASM International, Materials Park, OH (1992) p. 42.

"ASTM Designation F1801-97 Standard Practice for Corrosion Fatigue Testing of Metallic Implant Materials" ASTM International (1997) pp. 876-880.

"ASTM Designation F2066-01 Standard Specification for Wrought Titanium-15 Molybdenum Alloy for Surgical Implant Applications (UNS R58150)," ASTM International (2000) pp. 1-4.

AL-6XN® Alloy (UNS N08367) Allegheny Ludlum Corporation, 2002, 56 pages.

Allegheny Ludlum, "High Performance Metals for Industry, High Strength, High Temperature, and Corrosion-Resistant Alloys", (2000) pp. 1-8.

Allvac, Product Specification for "Allvac Ti-15 Mo," available at http://www.allvac.com/allvac/pages/Titanium/Ti15MO.htm, last visited Jun. 9, 2003 p. 1 of 1.

Altemp® A286 Iron-Base Superalloy (UNS Designation S66286) Allegheny Ludlum Technical Data Sheet Blue Sheet, 1998, 8 pages.

ASM Materials Engineering Dictionary, J.R. Davis Ed., ASM International, Materials Park, OH (1992) p. 39.

ATI Datalloy 2 Alloy, Technical Data Sheet, ATI Allvac, Monroe, NC, SS-844, Version 1, Sep. 17, 2010, 8 pages.

ATI 38-644™ Beta Titanium Alloy Technical Data Sheet, UNS 858640, Version 1, Dec. 21, 2011, 4 pages.

ATI 690 (UNS N06690) Nickel-Base, ATI Allvac, Oct. 5, 2010, 1 page.

Isothermal forging definition, ASM Materials Engineering Dictionary, J.R. Davis ed., Fifth Printing, Jan. 2006, ASM International, p. 238.

Isothermal forging, printed from http://thelibraryofmanufacturing.com/isothermal_forging.html, accessed Jun. 5, 2013, 3 pages.

Adiabatic definition, ASM Materials Engineering Dictionary, J.R. Davis ed., Fifth Printing, Jan. 2006, ASM International, p. 9.

Adiabatic process—Wkipedia, the free encyclopedia, printed from http://en.wikipedia.org/wiki/Adiabatic_process, accessed May 21, 2013, 10 pages.

ASTM Designation F 2066-01, "Standard Specification for Wrought Titanium-15 Molybdenum Alloy for Surgical Implant Applications (UNS R58150)", May 2001, 7 pages.

(56) References Cited

OTHER PUBLICATIONS

ASTM Designation F 2066/F2066M-13, "Standard Specification for Wrought Titanium-15 Molybdenum Alloy for Surgical Implant Applications (UNS R58150)", Nov. 2013, 6 pages.
ATI 6-2-4-2™ Alloy Technical Data Sheet, Version 1, Feb. 26, 2012, 4 pages.
ATI 6-2-4-6™ Titanium Alloy Data Sheet, accessed Jun. 26, 2012.
ATI 425, High-Strength Titanium Alloy, Alloy Digest, ASM International, Jul. 2004, 2 pages.
ATI 425® Alloy Applications, retrieved from http://web.archive.org/web/20100704044024/http://www.alleghenytechnologies.com/ATI425/applications/default.asp#other, Jul. 4, 2010, Way Back Machine, 2 pages.
ATI 425® Alloy, Technical Data Sheet, retrieved from http://web.archive.org/web/20100703120218/http://www.alleghenytechnologies.com/ATI425/specifications/datasheet.asp, Jul. 3, 2010, Way Back Machine, 5 pages.
ATI 425®-MIL Alloy, Technical Data Sheet, Version 1, May 28, 2010, pp. 1-5.
ATI 425®-MIL Alloy, Technical Data Sheet, Version 2, Aug. 16, 2010, 5 pages.
ATI 425®-MIL Titanium Alloy, Mission Critical Metallics®, Version 3, Sep. 10, 2009, pp. 1-4.
ATI 425® Titanium Alloy, Grade 38 Technical Data Sheet, Version 1, Feb. 1, 2012, pp. 1-6.
ATI 425® Alloy, Grade 38, Titanium Alloy UNS R54250, Technica Data Sheet, Version 1, Nov. 25, 2013, pp. 1-6.
ATI 500-MIL™, Mission Critical Metallics®, High Hard Specialty Steel Armor, Version 4, Sep. 10, 2009, pp. 1-4.
ATI 600-MIL®, Preliminary Draft Data Sheet, Ultra High Hard Specialty Steel Armor, Version 4, Aug. 10, 2010, pp. 1-3.
ATI 600-MIL™, Preliminary Draft Data Sheet, Ultra High Hard Specialty Steel Armor, Version 3, Sep. 10, 2009, pp. 1-3.
ATI Aerospace Materials Development, Mission Critical Metallics, Apr. 30, 2008, 17 pages.
ATI Ti-15Mo Beta Titanium Alloy Technical Data Sheet, ATI Allvac, Monroe, NC, Mar. 21, 2008, 3 pages.
ATI Titanium 6AI-2Sn-4Zr-2Mo Alloy, Technical Data Sheet, Version 1, Sep. 17, 2010. pp. 1-3.
ATI Titanium 6AI-4V Alloy, Mission Critical Metallics®, Technical Data Sheet, Version 1, Apr. 22, 2010, pp. 1-3.
ATI Wah Chang, ATI™ 425 Titanium Alloy (Ti-4AI-2.5V-1.5Fe-0.2502), Technical Data Sheet, 2004, pp. 1-5.
ATI Wall Chang, Titanium and Titanium Alloys, Technical Data Sheet, 2003, pp. 1-16.
Beal et al., "Forming of Titanium and Titanium Alloys-Cold Forming", ASM Handbook, 2006, ASM International, vol. 14B, 2 pages.
Beal et al., "Forming of Titanium and Titanium Alloys-Cold Forming", ASM Handbook, 2006, ASM International, Revised by ASM Committee on Forming Titanium Alloys, vol. 14B, 2 pages.
Beal et al., "Forming of Titanium and Titanium Alloys-Cold Forming", ASM Handbook, 2006, vol. 14B, pp. 656-669.
Bewlay, et al., "Superplastic roll forming of Ti alloys", Materials and Design, 21, 2000, pp. 287-295.
Bowen, A. W., "Omega Phase Embrittlement in Aged Ti-15%Mo," Scripta Metallurgica, vol. 5, No. 8 (1971) pp. 709-715.
Bowen, A. W., "On the Strengthening of a Metastable b-Titanium Alloy by w- and a-Precipitation" Royal Aircraft Establishment Technical Memorandum Mat 338, (1980) pp. 1-15 and Figs 1-5.
Boyer, Rodney R., "Introduction and Overview of Titanium and Titanium Alloys: Applications," Metals Handbook, ASM Handbooks Online (2002).
Boyko et al., "Modeling of the Open-Die and Radial Forging Processes for Alloy 718", Superalloys 718, 625 and Various Derivatives. Proceedings of the International Symposium on the Metallurgy and Applications of Superalloys 718, 625 and Various Derivatives, held Jun. 23, 1992, pp. 107-124.
Cain, Patrick, "Warm forming aluminum magnesium components; How it can optimize formability, reduce springback", Aug. 1, 2009, from http://www.thefabricator.com/article/presstechnology/warm-forming-aluminum-magnesium-components, 3 pages.
Canister, Jr., Wiliam D., Materials Science and Engineering, An introduction, Sixth Edition, John Wiley & Sons, pp. 180-184 (2003).
Craighead et al., "Ternary Alloys of Titanium", Journal of Metals, Mar. 1950, Transactions AIME, vol. 188, pp. 514-538.
Craighead et al., "Titanium Binary Alloys", Journal of Metals, Mar. 1950, Transactions AIME, vol. 188, pp. 485-513.
Desrayaud et al., "A novel high straining process for bulk materials—The development of a multipass forging system by compression along three axes", Journal of Materials Processing Technology, 172, 2006, pp. 152-158.
Diderrich et al., "Addition of Cobalt to the Ti-6AI-4V Alloy", Journal of Metals, May 1968, pp. 29-37.
DiDomizio, et al., "Evaluation of a Ni-20Cr Alloy Processed by Multi-axis Forging", Materials Science Forum vols. 503-504, 2006, pp. 793-798.
Disegi, J. A., "Titanium Alloys for Fracture Fixation Implants," Injury International Journal of the Care of the Injured, vol. 31 (2000) pp. S-D14-17.
Disegi, John, Wrought Titanium-15% Molybdenum Implant Material, Original Instruments and Implants of the Association for the Study of international Fixation- AO ASIF, Oct. 2003.
Donachie Jr., M.J., "Titanium A Technical Guide" 1988, ASM, pp. 39 and 46-50.
Donachie Jr., M.J., "Heat Treating Titanium and its Alloys", Heat Treating Process, Jun./Jul. 2001, pp. 47-49, 52-53, and 56-57.
Duflou et al., "A method for force reduction in heavy duty bending", Int. J. Materials and Product Technology, vol. 32, No. 4, 2008, pp. 460-475.
Elements of Metallurgy and Engineering Alloys, Editor F. C. Campbell, ASM International, 2008, Chapter 8, p. 125.
Fedotov, S.G. et al., "Effect of Aluminum and Oxygen on the Formation of Metastable Phases in Alloys of Titanium with .beta.-Stabilizing Elements", Izvestiya Akademii Nauk SSSR, Metally (1974) pp. 121-126.
Froes, F.H. et al., "The Processing Window for Grain Size Control in Metastable Beta Titanium Alloys", Beta Titanium Alloys in the 80's, ed. By R. Boyer and H. Rosenberg, AIME, 1984, pp. 161-164.
Gigliotti et al., "Evaluation of Superplastically Roll Formed VT-25", Titamium'99, Science and Technology, 2000, pp. 1581-1588.
Gilbert et al., "Heat Treating of Titanium and Titanium Alloys-Solution Treating and Aging", ASM Handbook, 1991, ASM International, vol. 4, pp. 1-8.
Glazunov et al., Structural Titanium Alloys, Moscow, Metallurgy, 1974, pp. 264-283.
Greenfield, Dan L., News Release, ATI Aerospace Presents Results of Year-Long Characterization Program for New ATI 425 Alloy Titanium Products at Aeromat 2010, Jun. 21, 2010, Pittsburgh, Pennsylvania, 1 page.
Harper, Megan Lynn, "A Study of the Microstructural and Phase Evolutions in Timetal 555", Jan. 2004, retrieved from http://www.ohiolink.edu/etd/send-pdf.cgi/harper%20megan%20lynn.pdf?acc_num=osu1132165471 on Aug. 10, 2009, 92 pages.
Hawkins, M.J. et al., "Osseointegration of a New Beta Titanium Alloy as Compared to Standard Orthopaedic Implant Metals," Sixth World Biomaterials Congress Transactions, Society for Biomaterials, 2000, p. 1083.
Ho, W.F. et al., "Structure and Properties of Cast Binary Ti-Mo Alloys" Biomaterials, vol. 20 (1999) pp. 2115-2122.
Hsieh, Chih-Chun and Weite Wu, "Overview of Intermetallic Sigma Phase Precipitation in Stainless Steels", ISRN Metallurgy, vol. 2012, 2012, pp. 1-16.
Imatani et al., "Experiment and simulation for thick-plate bending by high frequency inductor", ACTA Metallurgica Sinica, vol. 11, No. 6, Dec. 1998, pp. 449-455.
Imayev et al., "Formation of submicrocrystalline structure in TiAI Intermetallic compound", Journal of Materials Science, 27, 1992, pp. 4465-4471.
Imayev et al., "Principles of Fabrication of Bulk Ultrafine-Grained and Nanostructured Materials by Multiple Isothermal Forging", Materials Science Forum, vols. 638-642, 2010, pp. 1702-1707.

(56) References Cited

OTHER PUBLICATIONS

Imperial Metal Industries Limited, Product Specification for "IMI Titanium 205", The Kynoch Press (England) pp. 1-5. (1965).
Jablokov et al., "Influence of Oxygen Content on the Mechanical Properties of Titanium-35Niobium-7Zirconium-5Tantalum Beta Titanium Alloy," Journal of ASTM International, Sep. 2005, vol. 2, No. 8, 2002, pp. 1-12.
Jablokov et al., "The Application of Ti-15 Mo Beta Titanium Alloy in High Strength Orthopaedic Applications", Journal of ASTM International, vol. 2, Issue 8 (Sep. 2005) (published online Jun. 22, 2005).
Kovtun, et al., "Method of calculating induction heating of steel sheets during thermomechanical bending", Kiev, Nikolaev, translated from Problemy Prochnosti, No. 5, pp. 105-110, May 1978, original article submitted Nov. 27, 1977, pp. 600-606.
Lampman, S., "Wrought and Titanium Alloys," ASM Handbooks Online, ASM International 2002.
Lee et al., "An electromagnetic and thermo-mechanical analysis of high frequency induction heating for steel plate bending", Key Engineering Materials, vols. 326-328, 2008, pp. 1283-1286.
Lemons, Jack et al., "Metallic Biomaterials for Surgical Implant Devices," BONEZone, Fall (2002) p. 5-9 and Table.
Long, M. et al., "Friction and Surface Behavior of Selected Titanium Alloys During Reciprocating-Sliding Motion", WEAR, 249(1-2), Jan. 17, 2001, 158-168.
Lütjering, G. and J.C. Williams, Titanium, Springer, New York (2nd ed. 2007) p. 24.
Lutjering, G. and Williams, J.C., Titanium, Springer-Verlag, 2003, Ch. 5: Alpha+Beta Alloys, p. 177-201.
Marquardt et al., "Beta Titanium Alloy Processed for High Strength Orthopaedic Applications, "Journal of ASTM International, vol. 2, Issue 9 (Oct. 2005) (published online Aug. 17, 2005).
Marquardt, Brian, "Characterization of Ti-15Mo for Orthopaedic Applications, "TMS 2005 Annual Meeting: Technical Program, San Francisco, CA, Feb. 13-17, 2005 Abstract, p. 239.
Marquardt, Brian, "Ti-15Mo Beta Titanium Alloy Processed for High Strength Orthopaedic Applications," Program and Abstracts for The Symposium on Titanium, Niobium, Zirconium, and Tantalum for Medical and Surgical Applications, Washington, D.C., Nov. 9-10, 2004 Abstract, p. 11.
Marte et al., "Structure and Properties of Ni-20CR Produced by Severe Plastic Deformation", Ultrafine Grained Materials IV, 2006, pp. 419-424.
Materials Properties Handbook: Titanium Alloys, Eds. Boyer et al, ASM International, Materials Park, OH, 1994, pp. 524-525.
Martinelli, Gianni and Roberto Peroni, "Isothermal forging of Ti-alloys for medical applications", Presented at the 11th World Conference on Titanium, Kyoto, Japan, Jun. 4-7, 2007, accessed Jun. 5, 2013, 5 pages.
McDevitt, et al., Characterization of the Mechanical Properties of ATI 425 Alloy According to the Guidelines of the Metallic Materials Properties Development & Standardization Handbook, Aeromat 2010 Conference and Exposition: Jun. 20-24, 2010, Bellevue, WA, 23 pages.
Metals Handbook, Desk Edition, 2nd ed., J. R. Davis ed., ASM International, Materials Park, Ohio (1998), pp. 575-588.
Military Standard, Fastener Test Methods, Method 13, Double Shear Test, MIL-STD-1312-13, Jul. 26, 1985, superseding MIL-STD-1312 (in part) May 31, 1967, 8 pages.
Military Standard, Fastener Test Methods, Method 13, Double Shear Test, MIL-STD-1312-13A, Aug. 23, 1991, superseding MIL-STD-13, Jul. 26, 1985, 10 pages.
Murray, J.L., et al., Binary Alloy Phase Diagrams, Second Edition, vol. 1, Ed. Massalski, Materials Park, OH; ASM International; 1990, p. 547.
Murray, J.L., The Mn-Ti (Manganese-Titanium) System, Bulletin of Alloy Phase Diagrams, vol. 2, No. 3 (1981) p. 334-343.
Myers, J., "Primary Working, A lesson from Titanium and its Alloys," ASM Course Book 27 Lesson, Test 9, Aug. 1994, pp. 3-4.
Naik, Uma M. et al., "Omega and Alpha Precipitation in Ti- 15Mo Alloy, "Titanium '80 Science and Technology—Proceedings of the 4th International Conference on Titanium, H. Kimura & O. Izumi Eds. May 19-22, 1980 pp. 1335-1341.
Nguyen et al., "Analysis of bending deformation in triangle heating of steel plates with induction heating process using laminated plate theory", Mechanics Based Design of Structures and Machines, 37, 2009, pp. 228-246.
Nishimura, T. "Ti-15Mo-5Zr-3AI", Materials Properties Handbook: Titanium Alloys, eds. R. Boyer et al., ASM International, Materials Park, OH, 1994, p. 949.
Novikov et al., 17.2.2 Deformable ($\alpha$+ $\beta$) alloys, Chapter 17, Titanium and its Alloys, Metal Science, vol. II Thermal Treatment of the Alloy, Physical Matallurgy, 2009, pp. 357-360.
Nutt, Michael J. et al., "The Application of Ti-15 Beta Titanium Alloy in High Strength Structural Orthopaedic Applications, "Program and Abstracts for the Symposium on Titanium Niobium, Zirconium, and Tantalum for Medical and Surgical Applications, Washington, D.C., Nov. 9-10, 2004 Abstract, p. 12.
Nyakana, et al., "Quick Reference Guide for $\beta$ Titanium Alloys in the 00s", Journal of Materials Engineering and Performance, vol. 14, No. 6, Dec. 1, 2005, pp. 799-811.
Pennock, G.M. et al., "The Control of a Precipitation by Two Step Ageing in $\beta$ Ti-15Mo," Titanium '80 Science and Technology—Proceedings of the 4th International Conference on Titanium, H. Kimura & O. Izumi Eds. May 19-22, 1980 pp. 1344-1350.
Prasad, Y.V.R.K. et al. "Hot Deformation Mechanism in Ti-6AI-4V with Transformed B Starting Microstructure: Commercial v. Extra Low Interstitial Grade", Materials Science and Technology, Sep. 2000, vol. 16, pp. 1029-1036.
Qazi, J.I. et al., "High-Strength Metastable Beta-Titanium Alloys for Biomedical Applications," JOM, Nov. 2004 pp. 49-51.
Roach, M.D., et al., "Comparison of the Corrosion Fatigue Characteristics of CPTi-Grade 4, Ti-6A1-4V ELI, Ti-6A1-7 Nb, and Ti-15 Mo", Journal of Testing and Evaluation, vol. 2, Issue 7, (Jul./Aug. 2005) (published online Jun. 8, 2005).
Roach, M.D., et al., "Physical, Metallurgical, and Mechanical Comparison of a Low-Nickel Stainless Steel," Transactions on the 27th Meeting of the Society for Biomaterials, Apr. 24-29, 2001, p. 343.
Roach, M.D., et al., "Stress Corrosion Cracking of a Low-Nickel Stainless Steel," Transactions of the 27th Annual Meeting of the Society for Biomaterials, 2001, p. 469.
Rudnev et al., "Longitudinal flux indication heating of slabs, bars and strips is no longer "Black Magic:" II", Industrial Heating, Feb. 1995, pp. 46-48 and 50-51.
Russo, P.A., "Influence of Ni and Fe on the Creep of Beta Annealed Ti-6242S", Titanium '95: Science and Technology, pp. 1075-1082.
SAE Aerospace Material Specification 4897A (issued Jan. 1997, revised Jan. 2003).
SAE Aerospace, Aerospace Material Specification, Titanium Alloy Bars, Forgings and Forging Stock, 6.0AI-4.0V Annealed, AMS 6931A, issued Jan. 2004, Revised Feb. 2007, pp. 1-7.
SAE Aerospace, Aerospace Material Specification, Titanium Alloy Bars, Forgings and Forging Stock, 6.0AI-4.0V, Solution Heat Treated and Aged, AMS 6930A, Issued Jan. 2004, Revised Feb. 2006, pp. 1-9.
SAE Aerospace, Aerospace Material Specification, Titanium Alloy, Sheet, Strip, and Plate, 4AI-2.5V-1.5Fe, Annealed, AMS 6946A, Issued Oct. 2006, Revised Jun. 2007, pp. 1-7.
Salishchev et al., "Characterization of Submicron-grained Ti-6AI-4V Sheets with Enhanced Superplastic Properties", Materials Science Forum, Trans Tech Publications, Switzerland, vols. 447-448, 2004, pp. 441-446.
Salishchev et al., "Mechanical Properties of Ti-6AI-4V Titanium Alloy with Submicrocrystalline Structure Produced by Muitiaxial Forging", Materials Science Forum, vols. 584-586, 2008, pp. 783-788.
Salishchev, et al., "Effect of Deformation Conditions on Grain Size and Microstructure Homogeneity of $\beta$-Rich Titanium Alloys", Journal of Materials Engineering and Performance, vol. 14(6), Dec. 2005, pp. 709-716.

(56) References Cited

OTHER PUBLICATIONS

Salishchev, G.A., "Formation of submicrocrystalline structure in large size billets and sheets out of titanium alloys", Institute for Metals Superplasticity Problems,Ufa, Russia, presented at 2003 NATO Advanced Research Workshop, Kyiv, Ukraine, Sep. 9-13, 2003, 50 pages.
Semiatin, S.L. et al., "The Thermomechanical Processing of Alpha/Beta Titanium Alloys," Journal of Metals, Jun. 1997, pp. 33-39.
Semiatin et al., "Equal Channel Angular Extrusion of Difficult-to-Work Alloys", Materials & Design, Elsevier Science Ltd., 21, 2000, pp. 311-322.
Semiatin et al., "Alpha/Beta Heat Treatment of a Titanium Alloy with a Nonuniform Microstructure", Metalluroical and Materials Transactions A, vol. 38A, Apr. 2007, pp. 910-921.
Shahan et al., "Adiabatic shear bands in titanium and titanium alloys: a critical review", Materials & Design, vol. 14, No. 4, 1993, pp. 243-250.
SPS Titanium™ Titanium Fasteners, SPS Technologies Aerospace Fasteners, 2003, 4 pages.
Standard Specification for Wrought Titanium—6Aluminum—4Vanadium Alloy for Surgical Implant Applications (UNS R56400), Designation: F 1472-99, ASTM 1999, pp. 1-4.
Swann, P.R. and J. G. Parr, "Phase Transformations in Titanium-Rich Alloys of Titanium and Cobalt", Transactions of The Metallurgical Society of AIME, Apr. 1958, pp. 276-279.
Takemoto Y et al., "Tensile, Behavior and Cold Workability of Ti-Mo Alloys", Materials Transactions Japan Inst. Metals Japan, vol. 45, No. 5, May 2004, pp. 1571-1576.
Tamarisakandala, S. et al., "Strain-induced Porosity During Cogging of Extra-Low Interstitial Grade Ti-6AI-4V", Journal of Materials Engineering and Performance, vol. 10(2), Apr. 2001, pp. 125-130.
Tamirisakandala et al., "Effect of boron on the beta transus of Ti-6AI-4V alloy", Scripta Materialia, 53, 2005, pp. 217-222.
Tamirisakandala et al., "Powder Metallurgy Ti-6AI-4V-xB Alloys: Processing, Microstructure, and Properties", JOM, May 2004, pp. 60-63.
Tebbe, Patrick A. and Ghassan T. Kridli, "Warm forming aluminum alloys: an overview and future directions", Int. J. Materials and Product Technology, vol. 21. Nos. 1-3, 2004, pp. 24-40.
Technical Presentation: Overview of MMPDS Characterization of ATI 425 Alloy, 2012, 1 page.
Ti-6AI-4V, Ti64, 6AI-4V, 6-4, UNS R56400, 1 page.
TIMET 6-6-2 Titanium Alloy (Ti-6AI-6V-2Sn), Annealed, accessed Jun. 27, 2012.
TIMET TIMETAL® 6-2-4-2 (Ti-6AI-2Sn-4Zr-2Mo-0.08Si) Titanium Alloy datasheet, accessed Jun. 26, 2012.
Timet Timetal® 6-2-4-6 Titanium Alloy (Ti-6AI-2Sn-4Zr-6Mo), Typical, accessed Jun. 26, 2012.
Titanium 3AI-8V-6Cr-4Mo-4Zr Beta-C/Grade 19 UNS R58640, 2 pages.
Tokaji, Keiro et al., "The Microstructure Dependence of Fatigue Behavior in Ti-15Mo-5Zr-3AI Alloy," Materials Science and Engineering A, vol. 213 (1996) pp. 86-92.
Two new α-β titanium alloys, KS Ti-9 for sheet and KS EL-F for forging, with mechanical properties comparable to Ti-6AI-4V, Oct. 8, 2002, ITA 2002 Conference in Orlando, Hideto Oyama, Titanium Technology Dept., Kobe Steel, Ltd., 16 pages.
Veeck, S., et al., "The Castability of Ti-5553 Alloy," Advanced Materials and Processes, Oct. 2004, pp. 47-49.
Weiss, I. et al., "The Processing Window Concept of Beta Titanium Alloys", Recrystallization '90, ed. By T. Chandra, The Minerals, Metals & Materials Society, 1990, pp. 609-616.
Weiss, I. et al., "Thermomechanical Processing of Beta Titanium Alloy—An Overview," Material Science and Engineering, A243, 1998, pp. 46-65.
Williams, J., Thermo-mechanical processing of high-performance Ti alloys: recent progress and future needs, Journal of Material Processing Technology, 117 (2001), p. 370-373.
Yakymyshyn et al., "The Relationship between the Constitution and Mechanical Properties of Titanium-Rich Alloys of Titanium and Cobalt", 1961, vol. 53, pp. 283-294.
Zardiackas, L.D. et al., "Stress Corrosion Cracking Resistance of Titanium Implant Materials," Transactions of the 27th Annual Meeting of the Society for Biomaterials, (2001).
Zeng et al., Evaluation of Newly Developed Ti-555 High Strength Titanium Fasteners, 17th AeroMat Conference & Exposition, May 18, 2006, 2 pages.
Zhang et al., "Simulation of slip band evolution in duplex Ti-6AI-4V", Acta Materialia, vol. 58, (2010), Nov. 26, 2009, pp. 1087-1096.
Zherebtsov et al., "Production of submicrocrystalline structure in large-scale Ti-6AI-4V billet by warm severe deformation processing", Scripta Materialia, 51, 2004, pp. 1147-1151.
Titanium Alloy, Sheet, Strip, and Plate 4AI-2.5V-1.5Fe, Annealed, AMS6946 Rev. B, Aug. 2010, SAE Aerospace, Aerospace Material Specification, 7 pages.
Titanium Alloy, Sheet, Strip, and Plate βAI-4V, Annealed, AMS 4911L, Jun. 2007, SAE Aerospace, Aerospace Material Specification, 7 pages.
E112-12 Standard Test Methods for Determining Average Grain Size, ASTM International. Jan. 2013, 27 pages.
ATI Datalloy 2 Alloy, Technical Data Sheet, ATI Properties, Inc., Version 1, Jan. 24, 2013, 6 pages.
ATI AL-6XN® Alloy (UNS N08367), ATI Allegheny Ludlum, 2010, 59 pages.
ATI 800™/ATI 800HT™/ATI 800AT™ ATI Technical Data Sheet, Nickel-base Alloys (UNS N08800/N08810/N08811), 2012 Allegheny Technologies Incorporated, Version 1, Mar. 9, 2012, 7 pages.
ATI 825™ Technical Data Sheet, Nickel-base Alloy (UNS N08825), 2013 Allegheny Technologies Incorporated, Version 2, Mar. 8, 2013, 5 pages.
ATI 625™ Alloy Technical Data Sheet, High Strength Nickel-base Alloy (UNS N06625), Allegheny Technologies Incorporated, Version 1, Mar. 4, 2012, 3 pages.
ATI 600™ Technical Data Sheet, Nickel-base Alloy (UNS N06600), 2012 Allegheny Technologies Incorporated, Version 1, Mar. 19, 2012, 5 pages.
Bar definition, ASM Materials Engineering Dictionary, J.R. Davis Ed., ASM International, Materials Park, OH (1992) p. 32.
Billet definition, ASM Materials Engineering Dictionary, J.R. Davis Ed., ASM International, Materials Park, OH (1992) p. 40.
Cogging definition, ASM Materials Engineering Dictionary, J.R. Davis Ed., ASM International, Materials Park, OH (1992) p. 79.
Open die press forging definition, ASM Materials Engineering Dictionary, J.R. Davis Ed., ASM International, Materials Park, OH (1992) pp. 298 and 343.
Thermomechanical working definition, ASM Materials Engineering Dictionary, J.R. Davis Ed., ASM International, Materials Park, OH (1992) p. 480.
Ductility definition, ASM Materials Engineering Dictionary, J.R. Davis Ed., ASM International, Materials Park, OH (1992) p. 131.
AFML-TR-76-80 Development of Titanium Alloy Casting Technology, Aug. 1976, 5 pages.
Valiev et al., "Nanostructured materials produced by sever plastic deformation", Moscow, LOGOS, 2000.
Li et al., "The optimal determination of forging process parameters for Ti-6.5,AI-3.5Mo-1.5Zr-0.3Si alloy with thick lamellar microstructure in two phase field based on P-map", Journal of Materials Processing Technology, vol. 210, Issue 2, Jan. 19, 2010, pp. 370-377.
Buijk, A., "Open-Die Forging Simulation", Forge Magazine, Dec. 1, 2013, 5 pages.
Herring, D., "Grain Size and Its Influence on Materials Properties", IndustrialHeating.com, Aug. 2005, pp. 20 and 22.
INCONEL® alloy 600, Special Metals Corporation, www.specialmetals.com, Sep. 2008, 16 pages.
Yaylaci et al., "Cold Working & Hot Working & Annealing", http://yunus.hacettepe.edu.tri/~selis/teaching/WEBkmu479/Ppt/kmu479Presentations2010/Cold_Hot_Working_Annealing.pdf, 2010, 41 pages.

(56) References Cited

OTHER PUBLICATIONS

Superaustenitic, http://www.atimetals.com/products/Pages/superaustenitic.aspx, Nov. 9, 2015, 3 pages.
French, D., "Austenitic Stainless Steel", The National Board of Boiler and Pressure Vessel Inspectors Bulletin, 1992, 3 pages.
acom Magazine, outokumpu, NACE International, Feb. 2013, 16 pages.
ATI A286™ Iron Based Superalloy (UNS S66286) Technical Data Sheet, Allegheny Technologies Incorporated, Version 1, Apr. 17, 2012, 9 pages.
ATI A286™ (UNS S66236) Technical Data Sheet, Allegheny Technologies Incorporated, Version 1, Mar. 14, 2012, 3 pages.
Corrosion-Resistant Titanium, Technical Data Sheet, Allegheny Technologies Incorporated, Version 1, Feb. 29, 2012, 5 pages.
ATI 3-2.5™ Titanium (Ti Grade 9) Technical Data Sheet. ATI Wah Chang, 2010, 4 pages.
Grade 9 Ti 3AI 2.5V Alloy (UNS R56320), Jul. 30, 2013. http://www.azom.com/article.aspx?ArticleID=9337, 3 pages.
ATI Ti-6AI-4V, Grade 5, Titanium Alloy (UNS R56400) Technical Data Sheet, Allegheny Technologies Incorporated, Version 1, Jan. 31, 2012, 4 pages.
Panin et al., "Low-cost Titanium Alloys for Titanium-Polymer Layered Composites", 29th Congress of the International Council of the Aeronautical Sciences, St. Petersburg, Russia, Sep. 7, 2014, 4 pages.
Grade Ti-4.5AI-3V-2Mo-2Fe Alloy, Jul. 9, 2013, http://www.azom.com/article.aspx?ArticleID=9448, 2 pages.
Garside et al., "Mission Critical Metallics® Recent Developments in High-Strength Titanium Fasteners for Aerospace Applications", ATI, 2013, 21 pages.
Foltz et al., "Recent Developments in High-Strength Titanium Fasteners for Aerospace Applications", ATI, Oct. 22, 2014, 17 pages.
Kosaka et al., "Superplastic Forming Properties of TIMETAL ®54M", Henderson Technical Laboratory, Titanium Metals Corporation, ITA, Oct. 2010, Orlando, Florida, 18 pages.
Markovsky, P. E., "Preparation and properties of ultrafine (submicron) structure titanium alloys", Materials Science and Engineering, 1995, A203, 4 pages.
ATI Datalloy HP™ Alloy, UNS N08830, Technical Data Sheet Version 1, Apr. 14, 2015, 6 pages.
ATI Datalloy 2® Alloy, Technical Data Sheet, Version 1. Feb. 20, 2014, 6 pages.
Handa, Sukhdeep Singh, "Precipitation of Carbides in a Ni-based Superalloy", Degree Project for Master of Science with Specialization in Manufacturing Department of Engineering Science, University West, Jun. 30, 2014, 42 pages.
Titanium Alloy Guide, RMI Titanium Company, Jan. 2000, 45 pages.
Wanhill et al, "Chapter 2, Metallurgy and Microstructure", Fatigue of Beta Processed and Beta Heat-treated Titanium Alloys, SpringerBriefs in Applied Sciences and Technology, 2012, pp. 5-10.
Heat Treating of Titanium and Titanium Alloys, http://www.totalmateria.com/Article97.htm, Apr. 2004, 5 pages.
Grade 6AI 2Sn 4Zr 6Mo Titanium Alloy (UNS R56260); AZoM, http://www.azom.com/article.aspx?ArticleID=9305, Jun. 20, 2013, 4 pages.
Gammon et al., "Metallography and Microstructures of Titanium and Its Alloys", ASM Handbook, vol. 9: Metallography and Microstructures, ASM International, 2004, pp. 899-917.
Rui-gang Deng, et al. "Effects of Forging Process and Following Heat Treatment on Microstructure and Mechanical Properties of TC11 Titanium Alloy," Materials for Mechanical Engineering, vol. 35. No. 11, Nov. 2011, 5 pages. (English abstract included).
Srinivasan et al., "Rolling of Plates and Sheets from As-Cast Ti-6AI-4V-0.1 B", Journal of Materials Engineering and Performance, vol. 18.4, Jun. 2009, pp. 390-398.
Office Action dated Oct. 19, 2011 in U.S. Appl. No. 12/691,952.
Office Action dated Feb. 2, 2012 in U.S. Appl. No. 12/691,952.
Office Action dated Dec. 23, 2014 in U.S. Appl. No. 12/691,952.
Office Action dated Apr. 23, 2015 in U.S. Appl. No. 12/691,952.
Office Action dated Jul. 28, 2015 in U.S. Appl. No. 12/691,952.
Office Action dated Feb. 17, 2016 in U.S. Appl. No. 12/691,952.
Office Action dated Jun. 28, 2016 in U.S. Appl. No. 12/691,952.
Applicant-Initiated Interview Summary dated Aug. 22, 2016 in U.S. Appl. No. 12/691,952.
Advisory Action Before the Filing of an Appeal Brief dated Aug. 30, 2016 in U.S. Appl. No. 12/691,952.
Office Action dated Apr. 28, 2017 in U.S. Appl. No. 12/691,952.
Office Action dated Jul. 10, 2017 in U.S. Appl. No. 12/691,952.
Advisory Action dated Aug. 7, 2017 in U.S. Appl. No. 12/691,952.
Office Action dated Feb. 20, 2004 in U.S. Appl. No. 10/165,348.
Office Action dated Oct. 26, 2004 in U.S. Appl. No. 10/165,348.
Office Action dated Feb. 16, 2005 in U.S. Appl. No. 10/165,348.
Office Action dated Jul. 25, 2005 in U.S. Appl. No. 10/165,348.
Office Action dated Jan. 3, 2006 in U.S. Appl. No. 10/165,348.
Office Action dated Dec. 6, 2004 in U.S. Appl. No. 10/434,598.
Office Action dated Aug. 17, 2005 in U.S. Appl. No. 10/434,598.
Office Action dated Dec. 19, 2005 in U.S. Appl. No. 10/434,598.
Office Action dated Sep. 6, 2006 in U.S. Appl. No. 10/434,598.
Office Action dated Aug. 6, 2008 in U.S. Appl. No. 11/448,160.
Office Action dated Jan. 13, 2009 in U.S. Appl. No. 11/448,160.
Notice of Allowance dated Apr. 13, 2010 in U.S. Appl. No. 11/448,160.
Notice of Allowance dated Sep. 20, 2010 in U.S. Appl. No. 11/448,160.
Office Action dated Sep. 26, 2007 in U.S. Appl. No. 11/057,614.
Office Action dated Jan. 10, 2008 in U.S. Appl. No. 11/057,614.
Office Action dated Aug. 29, 2008 in U.S. Appl. No. 11/057,614.
Office Action dated Aug. 11, 2009 in U.S. Appl. No. 11/057,614.
Office Action dated Jan. 14, 2010 in U.S. Appl. No. 11/057,614.
Interview summary dated Apr. 14, 2010 in U.S. Appl. No. 11/057,614.
Office Action dated Jun. 21, 2010 in U.S. Appl. No. 11/057,614.
Notice of Allowance dated Sep. 3, 2010 in U.S. Appl. No. 11/057,614.
Office Action dated Apr. 1, 2010 in U.S. Appl. No. 11/745,189.
Interview summary dated Jun. 3, 2010 in U.S. Appl. No. 11/745,189.
Interview summary dated Jun. 15, 2010 in U.S. Appl. No. 11/745,189.
Office Action dated Nov. 24, 2010 in U.S. Appl. No. 11/745,189.
Interview summary dated Jan. 6, 2011 in U.S. Appl. No. 11/745,189.
Notice of Allowance dated Jun. 27, 2011 in U.S. Appl. No. 11/745,189.
Office Action dated Jan. 11, 2011 in U.S. Appl. No. 12/911,947.
Office Action dated Aug. 4, 2011 in U.S. Appl. No. 12/911,947.
Office Action dated Nov. 16, 2011 in U.S. Appl. No. 12/911,947.
Advisory Action dated Jan. 25, 2012 in U.S. Appl. No. 12/911,947.
Notice of Panel Decision from Pre-Appeal Brief Review dated Mar. 28, 2012 in U.S. Appl. No. 12/911,947.
Office Action dated Apr. 5, 2012 in U.S. Appl. No. 12/911,947.
Office Action dated Sep. 19, 2012 in U.S. Appl. No. 12/911,947.
Advisory Action dated Nov. 29, 2012 in U.S. Appl. No. 12/911,947.
Office Action dated May 31, 2013 in U.S. Appl. No. 12/911,947.
Notice of Allowance dated Oct. 4, 2013 in U.S. Appl. No. 12/911,947.
Office Action dated Jan. 3, 2011 in U.S. Appl. No. 12/857,789.
Office Action dated Jul. 27, 2011 in U.S. Appl. No. 12/857,789.
Advisory Action dated Oct. 7, 2011 in U.S. Appl. No. 12/857,789.
Notice of Allowance dated Jul. 1, 2013 in U.S. Appl. No. 12/857,789.
Office Action dated Nov. 14, 2012 in U.S. Appl. No. 12/885,620.
Office Action dated Jun. 13, 2013 in U.S. Appl. No. 12/885,620.
Office Action dated Nov. 19, 2013 in U.S. Appl. No. 12/885,620.
Advisory Action Before the Filing of an Appeal Brief dated Jan. 30, 2014 in U.S. Appl. No. 12/885,620.
Office Action dated Jun. 18, 2014 in U.S. Appl. No. 12/885,620.
Office Action dated Nov. 28, 2014 in U.S. Appl. No. 12/885,620.
Advisory Action dated May 18, 2015 in U.S. Appl. No. 12/885,620.
Office Action dated Jun. 30, 2015 in U.S. Appl. No. 12/885,620.
Notice of Abandonment dated Jan. 29, 2016 in U.S. Appl. No. 12/885,620.
Office Action dated Nov. 14, 2012 in U.S. Appl. No. 12/888,699.
Office Action dated Oct. 3, 2012 in U.S. Appl. No. 12/838,674.
Office Action dated Jul. 18, 2013 in U.S. Appl. No. 12/838,674.
Office Action dated May 27, 2015 in U.S. Appl. No. 12/838,674.
Applicant Initiated Interview Summary dated Sep. 1, 2015 in U.S. Appl. No. 12/838,674.

(56) References Cited

OTHER PUBLICATIONS

Notice of Allowance dated Sep. 25, 2015 in U.S. Appl. No. 12/838,674.
Office Action dated Sep. 26, 2012 in U.S. Appl. No. 12/845,122.
Notice of Allowance dated Apr. 17, 2013 in U.S. Appl. No. 12/845,122.
Office Action dated Dec. 24, 2012 in U.S. Appl. No. 13/230,046.
Notice of Allowance dated Jul. 31, 2013 in U.S. Appl. No. 13/230,046.
Office Action dated Dec. 26, 2012 in U.S. Appl. No. 13/230,143.
Notice of Allowance dated Aug. 2, 2013 in U.S. Appl. No. 13/230,143.
Office Action dated Mar. 1, 2013 in U.S. Appl. No. 12/903,851.
Office Action dated Jan. 16, 2014 in U.S. Appl. No. 12/903,851.
Office Action dated Oct. 6, 2014 in U.S. Appl. No. 12/903,851.
Office Action dated Jul. 15, 2015 in U.S. Appl. No. 12/903,851.
Examiner's Answer to Appeal Brief dated Oct. 27, 2016 in U.S. Appl. No. 12/903,851.
Office Action dated Mar. 25, 2013 in U.S. Appl. No. 13/108,045.
Office Action dated Jan. 17, 2014 in U.S. Appl. No. 13/108,045.
Office Action dated Mar. 30, 2016 in U.S. Appl. No. 13/108,045.
Office Action dated Sep. 9, 2016 in U.S. Appl. No. 13/108,045.
Advisory Action dated Mar. 7, 2017 in U.S. Appl. No. 13/108,045.
Office Action dated Apr. 16, 2013 in U.S. Appl. No. 13/150,494.
Office Action dated Jun. 14, 2013 U.S. Appl. No. 13/150,494.
Notice of Allowance dated Nov. 5, 2013 in U.S. Appl. No. 13/150,494.
Supplemental Notice of Allowability dated Jan. 17, 2014 in U.S. Appl. No. 13/150,494.
U.S. Appl. No. 13/331,135, filed Dec. 20, 2011.
Office Action dated Jan. 21, 2015 in U.S. Appl. No. 13/792,285.
Office Action dated Jun. 4, 2015 in U.S. Appl. No. 13/792,285.
Notice of Allowance dated Sep. 16, 2015 in U.S. Appl. No. 13/792,285.
Response to Rule 312 Communication dated Oct. 20, 2015 in U.S. Appl. No. 13/792,285.
Notice of Allowance dated Oct. 24, 2014 in U.S. Appl. No. 13/844,545.
Notice of Allowance dated Feb. 6, 2015 in U.S. Appl. No. 13/844,545.
Office Action dated Jan. 23, 2013 in U.S. Appl. No. 12/882,538.
Office Action dated Feb. 8, 2013 in U.S. Appl. No. 12/882,538.
Notice of Allowance dated Jun. 24, 2013 in U.S. Appl. No. 12/882,538.
Office Action dated Sep. 6, 2013 in U.S. Appl. No. 13/933,222.
Notice of Allowance dated Oct. 1, 2013 in U.S. Appl. No. 13/933,222.
Notice of Allowance dated May 6, 2014 in U.S. Appl. No. 13/933,222.
Office Action dated Jun. 3, 2015 in U.S. Appl. No. 13/714,465.
Office Action dated Jul. 8, 2015 in U.S. Appl. No. 13/714,465.
Notice of Allowance dated Sep. 2, 2015 in U.S. Appl. No. 13/714,465.
Response to Rule 312 Communication dated Sep. 29, 2015 in U.S. Appl. No. 13/714,465.
Response to Rule 312 Communication dated Oct. 8, 2015 in U.S. Appl. No. 13/714,465.
Office Action dated Jun. 26, 2015 in U.S. Appl. No. 13/777,066.
Office Action dated Oct. 5, 2015 in U.S. Appl. No. 13/777,066.
Advisory Action Before the Filing of an Appeal Brief dated Mar. 17, 2016 in U.S. Appl. No. 13/777,066.
Office Action dated Jul. 22, 2016 in U.S. Appl. No. 13/777,066.
Office Action dated Oct. 12, 2016 in U.S. Appl. No. 13/777,066.
Office Action dated May 18, 2017 in U.S. Appl. No. 13/777,066.
Advisory Action Before the Filing of an Appeal Brief dated Jul. 10, 2017 in U.S. Appl. No. 13/777,066.
Notice of Allowance dated Aug. 30, 2017 in U.S. Appl. No. 13/777,066.
Office Action dated Aug. 19, 2015 in U.S. Appl. No. 13/844,196.
Office Action dated Oct. 15, 2015 in U.S. Appl. No. 13/844,196.
Office Action dated Feb. 12, 2016 in U.S. Appl. No. 13/844,196.
Advisory Action Before the Filing of an Appeal Brief dated Jun. 15, 2016 in U.S. Appl. No. 13/844,196.
Office Action dated Aug. 22, 2016 in U.S. Appl. No. 13/844,196.
Office Action dated Dec. 29, 2016 in U.S. Appl. No. 13/844,196.
Notice of Allowance dated Jul. 13, 2017 in U.S. Appl. No. 13/844,196.
Corrected Notice of Allowability dated Jul. 20, 2017 in U.S. Appl. No. 13/844,196.
Corrected Notice of Allowability dated Aug. 18, 2017 in U.S. Appl. No. 13/844,196.
Office Action dated Oct. 2, 2015 in U.S. Appl. No. 14/073,029.
Office Action dated Aug. 12, 2016 in U.S. Appl. No. 14/073,029.
Office Action dated Jun. 14, 2017 in U.S. Appl. No. 14/073,029.
Notice of Allowance dated Jul. 7, 2017 in U.S. Appl. No. 14/073,029.
Notice of Allowability dated Sep. 21, 2017 in U.S. Appl. No. 14/073,029.
Office Action dated Oct. 28, 2015 in U.S. Appl. No. 14/093,707.
Office Action dated Mar. 17, 2016 in U.S. Appl. No. 14/093,707.
Advisory Action Before the Filing of an Appeal Brief dated Jun. 10, 2016 in U.S. Appl. No. 14/093,707.
Office Action dated Sep. 30, 2016 in U.S. Appl. No. 14/093,707.
Notice of Allowance dated Jan. 13, 2017 in U.S. Appl. No. 14/093,707.
Supplemental Notice of Allowance dated Jan. 27, 2017 in U.S. Appl. No. 14/093,707.
Supplemental Notice of Allowance dated Feb. 10, 2017 in U.S. Appl. No. 14/093,707.
Supplemental Notice of Allowability dated Mar. 1, 2017 in U.S. Appl. No. 14/093,707.
Notice of Third-Party Submission dated Dec. 16, 2015 in U.S. Appl. No. 14/077,699.
Office Action dated Jul. 25, 2016 in U.S. Appl. No. 14/077,699.
Office Action dated Aug. 16, 2016 in U.S. Appl. No. 14/077,699.
Office Action dated Oct. 25, 2016 in U.S. Appl. No. 14/077,699.
Advisory Action dated Nov. 30, 2016 in U.S. Appl. No. 14/077,699.
Office Action dated Mar. 16, 2016 in U.S. Appl. No 15/005,281.
Office Action dated Aug. 26, 2016 in U.S. Appl. No. 15/005,281.
Notice of Panel Decision from Pre-Appeal Brief Review dated Feb. 24, 2017 in U.S. Appl. No. 15/005,281.
Office Action dated Mar. 2, 2017 in U.S. Appl. No. 15/005,281.
Notice of Allowance dated May 10, 2017 in U.S. Appl. No. 15/005,281.
Corrected Notice of Allowability dated Aug. 9, 2017 in U.S. Appl. No. 15/005,281.
Office Action dated Apr. 5, 2016 in U.S. Appl. No. 14/028,588.
Office Action dated Aug. 8, 2016 in U.S. Appl. No. 14/028,588.
Advisory Action dated Oct. 14, 2016 in U.S. Appl. No. 14/028,588.
Applicant Initiated Interview Summary dated Oct. 27, 2016 in U.S. Appl. No. 14/028,588.
Office Action dated Mar. 15, 2017 in U.S. Appl. No. 14/028,588.
Office Action dated Jul. 14, 2017 in U.S. Appl. No. 14/028,588.
Advisory Action dated Sep. 12, 2017 in U.S. Appl. No. 14/028,588.
Office Action dated Apr. 13, 2016 in U.S. Appl. No. 14/083,759.
Office Action dated May 6, 2016 in U.S. Appl. No. 14/083,759.
Notice of Allowance dated Oct. 13, 2016 in U.S. Appl. No. 14/083,759.
Notice of Allowance dated Dec. 16, 2016 in U.S. Appl. No. 14/922,750.
Notice of Allowance dated Feb. 28, 2017 in U.S. Appl. No. 14/922,750.
Office Action dated Apr. 10, 2017 in U.S. Appl. No. 14/594,300.
Office Action dated May 25, 2017 in U.S. Appl. No. 14/594,300.
Office Action dated Sep. 13, 2017 in U.S. Appl. No. 14/594,300.
U.S. Appl. No. 15/348,140, filed Nov. 10, 2016.
U.S. Appl. No. 15/653,985, filed Jul. 19, 2017.
U.S. Appl. No. 15/659,661, filed Jul. 26. 2017.
Gil et al., "Formation of alpha-Widmanstatten structure: effects of grain size and cooling rate on the Widmanstatten morphologies and on the mechanical properties in Ti6AI4V alloy", Journal of Alloys and Compounds, 329, 2001, pp. 142-152.
Enayati et al., "Effects of temperature and effective strain on the flow behavior of Ti-6AI-4V", Journal of the Franklin Institute, 348, 2011, pp. 2813-2822.
Longxian et al., "Wear-Resistant Coating and Performance Titanium and Its Alloy, and properties thereof", Northeastern University Press, Dec. 2006, pp. 26-28, 33.
"Acceleration and Improvement for Heat Treating Workers," Quick Start and Improvement for Heat Treatment, ed. Yang Man, China Machine Press, Apr. 2008, pp. 265-266.
Decision on Appeal dated Dec. 15, 2017 in U.S. Appl. No. 12/903,851.

(56) References Cited

OTHER PUBLICATIONS

Corrected Notice of Allowability dated Dec. 20, 2017 in U.S. Appl. No. 13/777,066.
Office Action dated Dec. 1, 2017 in U.S. Appl. No. 14/077,699.
Notice of Panel Decision from Pre-Appeal Brief Review dated Oct. 27, 2017 in U.S. Appl. No. 14/028,588.
Advisory Action dated Jan. 26, 2018 in U.S. Appl. No. 14/594,300.
Office Action dated Oct. 31, 2017 in U.S. Appl. No. 15/653,985.
Office Action dated Dec. 6, 2017 in U.S. Appl. No. 14/948,941.
Forging Machinery, Dies, Processes, Metals Handbook Desk Edition, ASM International, 198, pp. 839-863.
Smith, et al. "Types of Heat-Treating Furnaces," Heat Treating, ASM Handbook, ASM International, 1991, vol. 4, p. 465-474.
Concise Explanation for Third Parry Preissuance submission under Rule 1.290 filed in U.S. Appl. No. 15/678,527 dated Jun. 5, 2018.
Guidelines for PWR Steam Generator Tubing Specifications and Repair, Electric Power Research institute, Apr. 14, 1999, vol. 2, Revision 1, 74 pages. (accessed at https://www.epri.com/#/pages/product/TR-016743-V2R1/).
Materials Reliability Program: Guidelines for Thermally Treated Alloy 690 Pressure Vessel Nozzels, (MRP-241), Electric Power Research Institute, Jul. 25, 2008, 51 pages. (accessed at https://www.epri.com/#/pages/product/1015007/).
Microstructure Etching and Carbon Analysis Techniques, Electric Power Research Institute, May 1, 1990, 355 pages. (accessed at https://www.epri.com/#/pages/product/NP-6720-SD/).
Frodigh, John, "Some Factors Affecting the Appearance of the Microstructure in Alloy 690", Proceedings of the Eighth International Symposium on Environmental Degradation of Materials in Nuclear. Power Systems—Water Reactors, American Nuclear Society, Inc., vol. 1, Aug. 10, 1997, 12 pages.
Kajimura et al., "Corrosion Resistance of TT Alloy 690 Manufactured by Various Melting Processes in High Temperature NaOH Solution", Proceedings of the Eighth International Symposium on Environmental Degradation of Materials in Nuclear Power Systems—Water Reactors, American Nuclear Society, Inc., vol. 1, Aug. 10, 1997, pp. 149-156.
Notice of Allowance dated Jun. 6, 2018 in U.S. Appl. No. 12/691,952.
Notice of Allowability dated Jul. 20, 2018 in U.S. Appl. No. 12/691,952.
Office Action dated Jul. 17, 2018 in U.S. Appl. No. 14/077,699.
Notice of Allowance dated Sep. 6, 2018 in U.S. Appl. No. 14/028,588.
Notice of Allowance dated Jun. 29, 2018 in U.S. Appl. No. 14/594,300.
Corrected Notice of Allowability dated Jul. 9, 2018 in U.S. Appl. No. 4/594,300.
Notice of Allowance dated Aug. 15, 2018 in U.S. Appl. No. 15/553,985.
Office Action dated Jul. 30, 2018 in U.S. Appl. No. 14/948,941.
Office Action dated Aug. 8, 2018 in U.S. Appl. No. 14/881,633.
Notice of Allowance dated Jun. 22, 2018 in U.S. Appl. No. 15/433,443.
Notice of Allowability dated Aug. 27, 2018 in U.S. Appl. No. 15/433,443.
Office Action dated Aug. 28, 2018 in U.S. Appl. No. 15/678,527.
U.S. Appl. No. 16/122,174, filed Sep. 5, 2018.
U.S. Appl. No. 16/122,450, filed Sep. 5, 2018.
Office Action dated Apr. 6, 2018 in U.S. Appl. No. 12/903,851.
Interview Summary dated Mar. 12, 2018 in U.S. Appl. No. 14/077,699.
Office Action dated Mar. 16, 2018 in U.S. Appl. No. 15/653,985.
Office Action dated Apr. 2, 2018 in U.S. Appl. No. 14/881,633.
Office Action dated Feb. 27, 2018 in U.S. Appl. No. 13/108,045.
Notice of Allowance dated Feb. 9, 2018 in U.S. Appl. No. 14/028,588.
Office Action dated Feb. 28, 2018 in U.S. Appl. No. 14/594,300.
Office Action dated Feb. 15, 2018 in U.S. Appl. No. 14/948,941.
The Japan Society for Heat Treatment, Introduction of Heat Treatment, Japan, Minoru, Kanai, Jan. 10, 1974, p. 150.
Office Action dated Oct. 26, 2018 in U.S. Appl. No. 12/903,851.
Office Action dated Nov. 2, 2018 in U.S. Appl. No. 13/108,045.
Office Action dated Jan. 10, 2019 in U.S. Appl. No. 14/077,699.
Office Action dated May 8, 2019 in U.S. Appl. No. 14/077,699.
Notification of Reopening Prosecution dated Dec. 19, 2018 in U.S. Appl. No. 14/028,588.
Office Action dated Feb. 1, 2019 in U.S. Appl. No. 14/028,588.
Applicant Initiated Interview Summary dated Jan. 30, 2019 in U.S. Appl. No. 14/948,941.
Office Action dated Feb. 15, 2019 in U.S. Appl. No. 14/948,941.
Notice of Allowance dated May 29, 2019 in U.S. Appl. No. 14/948,941.
Notice of Allowance dated Apr. 1, 2019 in U.S. Appl. No. 14/881,633.
Corrected Notice of Allowability dated May 15, 2019 in U.S. Appl. No. 14/881,633.
Corrected Notice of Allowability dated Sep. 6, 2018 in U.S. Appl. No. 15/433,443.
Notice of Allowability dated Oct. 11, 2018 in U.S. Appl. No. 15/433,443.
Corrected Notice of Allowability dated Oct. 18, 2018 in U.S. Appl. No. 15/433,443.
Notice of Allowance dated Dec. 13, 2018 in U.S. Appl. No. 15/578,527.
Corrected Notice of Allowability dated Apr. 15, 2019 in U.S. Appl. No. 15/678,527.
Office Action dated Jan. 10, 2019 in U.S. Appl. No. 15/659,661.
Notice of Allowance dated May 22, 2019 in U.S. Appl. No. 15/659,661.
Corrected Notice of Allowability dated May 29, 2019 in U.S. Appl. No. 15/659,661.
Office Action dated Jan. 25, 2019 in U.S. Appl. No. 15/348,140.
Notice of Allowance dated May 9, 2019 in U.S. Appl. No. 15/348,140.
Angeliu et al, "Behavior of Grain Boundary Chemistry and Precipitates upon Thermal Treatment of Controlled Purity Alloy 690", Metallurgical Transactions A, vol. 21A, Aug. 1990, pp. 2097-2107.
Park et al., "Effect of heat treatment on fatigue crack growth rate of Inconel 690 and Inconel 600", Journal of Nuclear Materials, 231, 1996, pp. 204-212.
Louthan, M.R., "Optical Metallography", ASM Handbook, vol. 10, Materials Characterizations, 1986, pp. 299-308.
Kolachev B.A. et al., Titanium Alloys of Different Countries, Moscow, VILS, 2000, pp. 15-16.
High Strength Non-Magnetic Stainless Steel for Oil Drill DNM series, Electric Steel Making, Daido Steel Co., Ltd., Japan. Jul. 27, 2012, vol. 83(1), pp. 75-76.
Office Action dated Jun. 27, 2019 in U.S. Appl. No. 12/903,851.
Office Action dated Jul. 12, 2019 in U.S. Appl. No 12/903,851.
Corrected Notice of Allowability dated Aug. 14, 2019 in U.S. Appl. No. 12/903,851.
Office Action dated Jun. 27, 2019 in U.S. Appl. No. 13/108,045.
Notice of Allowance dated Jun. 26, 2019 in U.S. Appl. No. 14/028,588.
Corrected Notice of Allowability dated Jun. 25, 2019 in U.S. Appl. No. 14/948,941.
Corrected Notice of Allowability dated Aug. 7, 2019 in U.S. Appl. No. 15/348,140.

* cited by examiner

LOCATION: T-1C R

LOCATION: T-1S R

LOCATION: T2C

LOCATION: T2S

METHODS FOR PROCESSING ALLOYS

CROSS-REFERENCE TO RELATED APPLICATIONS

This patent application is a continuation application claiming priority under 35 U.S.C. § 120 to co-pending U.S. application Ser. No. 13/777,066, filed on Feb. 26, 2013, the entire contents of which are hereby incorporated herein by reference.

BACKGROUND OF THE TECHNOLOGY

Field of the Technology

The present disclosure relates to methods of processing alloys. The present methods may find application in, for example, and without limitation, the chemical, mining, oil, and gas industries.

Description of the Background of the Technology

Metal alloy parts used in chemical processing facilities may be in contact with highly corrosive and/or erosive compounds under demanding conditions. These conditions may subject metal alloy parts to high stresses and aggressively promote corrosion and erosion, for example. If it is necessary to replace damaged, worn, or corroded metallic parts of chemical processing equipment, it may be necessary to suspend facility operations for a period of time. Therefore, extending the useful service life of metal alloy parts used in chemical processing facilities can reduce product cost. Service life may be extended, for example, by improving mechanical properties and/or corrosion resistance of the alloys.

Similarly, in oil and gas drilling operations, drill string components may degrade due to mechanical, chemical, and/or environmental conditions. The drill string components may be subject to impact, abrasion, friction, heat, wear, erosion, corrosion, and/or deposits. Conventional alloys may suffer from one or more limitations that impact their utility as drill string components. For example, conventional materials may lack sufficient mechanical properties (for example, yield strength, tensile strength, and/or fatigue strength), possess insufficient corrosion resistance (for example, pitting resistance and/or stress corrosion cracking), or lack necessary non-magnetic properties. Also, the properties of conventional alloys may limit the possible size and shape of the drill string components made from the alloys. These limitations may reduce the useful life of the components, complicating and increasing the cost of oil and gas drilling.

High strength non-magnetic stainless steels often contain intermetallic precipitates that decrease the corrosion resistance of the alloys. Galvanic corrosion cells that develop between the intermetallic precipitates and the base alloy can significantly decrease the corrosion resistance of high strength non-magnetic stainless steel alloys used in oil and gas drilling operations.

The broad chemical composition of one high strength non-magnetic austenitic stainless steel intended for exploration and production drilling applications in the oil and gas industry is disclosed in co-pending U.S. patent application Ser. No. 13/331,135, filed on Dec. 20, 2011, which is incorporated by reference herein in its entirety. It was discovered that the microstructures of forged workpieces of certain of the steels described in the '135 application can include intermetallic precipitates. It is believed that the intermetallic precipitates are σ-phase precipitates, comprised of Fe—Cr—Ni intermetallic compounds. The σ-phase precipitates may impair the corrosion resistance of the stainless steels disclosed in the '135 application, which may adversely affect the suitability of the steels for use in certain aggressive drilling environments.

SUMMARY

According to one non-limiting aspect of the present disclosure, a method of processing a workpiece to inhibit precipitation of intermetallic compounds comprises at least one of thermomechanically working and cooling a workpiece including an austenitic alloy. During the at least one of thermomechanically working and cooling the workpiece, the austenitic alloy is at temperatures in a temperature range spanning a temperature just less than a calculated sigma solvus temperature of the austenitic alloy down to a cooling temperature for a time period no greater than a critical cooling time. The calculated sigma solvus temperature is a function of the composition of the austenitic alloy in weight percentages and is equal to 1155.8−(760.4)·(nickel/iron)+(1409)·(chromium/iron)+(2391.6)·(molybdenum/iron)−(288.9)·(manganese/iron)−(634.8)·(cobalt/iron)+(107.8)·(tungsten/iron). The cooling temperature is a function of the composition of the austenitic alloy in weight percentages and is equal to 1290.7−(604.2)·(nickel/iron)+(829.6)·(chromium/iron)+(1899.6)·(molybdenum/iron)−(635.5)·(cobalt/iron)+(1251.3)·(tungsten/iron). The critical cooling time is a function of the composition of the austenitic alloy in weight percentages and is equal to in $\log_{10}$ 2.948+(3.631)·(nickel/iron)−(4.846)·(chromium/iron)−(11.157)·(molybdenum/iron)+(3.457)·(cobalt/iron)−(6.74)·(tungsten/iron).

In certain non-limiting embodiments of the method, thermomechanically working the workpiece comprises forging the workpiece. Such forging may comprise, for example, at least one of roll forging, swaging, cogging, open-die forging, impression-die forging, press forging, automatic hot forging, radial forging, and upset forging. In certain non-limiting embodiments of the method, the critical cooling time is in a range of 10 minutes to 30 minutes, greater than 10 minutes, or greater than 30 minutes.

In certain non-limiting embodiments of the method, after at least one of thermomechanically working and cooling the workpiece, the workpiece is heated to an annealing temperature that is at least as great as the calculated sigma solvus temperature, and holding the workpiece at the annealing temperature for a period of time sufficient to anneal the workpiece. As the workpiece cools from the annealing temperature, the austenitic alloy is at temperatures in a temperature range spanning a temperature just less than the calculated sigma solvus temperature down to the cooling temperature for a time no greater than the critical cooling time.

According to another non-limiting aspect of the present disclosure, a method of processing an austenitic alloy workpiece to inhibit precipitation of intermetallic compounds comprises forging the workpiece, cooling the forged workpiece, and, optionally, annealing the cooled workpiece. During forging the workpiece and cooling the forged workpiece, the austenitic alloy cools through a temperature range spanning a temperature just less than a calculated sigma solvus temperature of the austenitic alloy down to a cooling temperature for a time no greater than a critical cooling time. The calculated sigma solvus temperature is a function of the composition of the austenitic alloy in weight percentages and is equal to 1155.8−(760.4)·(nickel/iron)+(1409)·(chromium/iron)+(2391.6)·(molybdenum/iron)−(288.9)·(manganese/iron)−(634.8)·(cobalt/iron)+(107.8)·(tungsten/iron). The cooling temperature is a function of the composition of the austenitic alloy in weight percentages and is equal to 1290.7−(604.2)·(nickel/iron)+(829.6)·(chromium/iron)+(1899.6)·(molybdenum/iron)−(635.5)·(cobalt/iron)+(1251.3)·(tungsten/iron). The critical cooling time is a function of the composition of the austenitic alloy in weight percentages and is equal to in $\log_{10}$ 2.948+(3.631)·(nickel/iron)−(4.846)·(chromium/iron)−(11.157)·(molybdenum/iron)+(3.457)·(cobalt/iron)−(6.74)·(tungsten/iron). In certain non-limiting embodiments, forging the workpiece comprises at least one of roll forging, swaging, cogging, open-die forging, impression-die forging, press forging, automatic hot forging, radial forging, and upset forging.

In certain non-limiting embodiments of the method, forging the workpiece occurs entirely at temperatures greater than the calculated sigma solvus temperature. In certain other non-limiting embodiments of the method, forging the workpiece occurs through the calculated sigma solvus temperature. In certain non-limiting embodiments of the method, the critical cooling time is in a range of 10 minutes to 30 minutes, greater than 10 minutes, greater than 30 minutes.

BRIEF DESCRIPTION OF THE DRAWINGS

The features and advantages of apparatus and methods described herein may be better understood by reference to the accompanying drawings in which.

Figure 1:
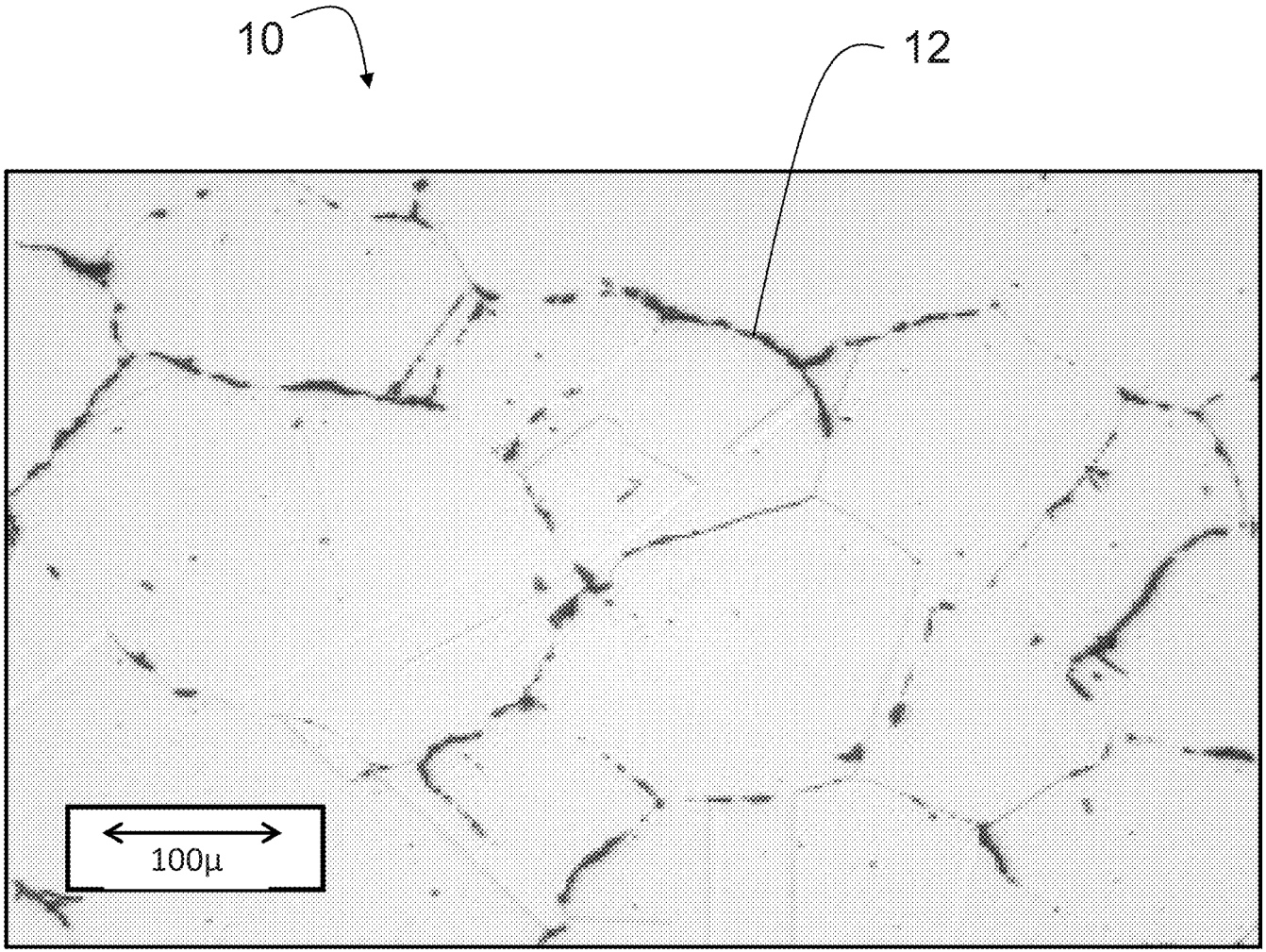
FIG. 1 Prior Art
FIG. 1 is a micrograph showing deleterious intermetallic precipitates in the microstructure at the mid radius of a radial forged workpiece of a non-magnetic austenitic alloy.

The reader will appreciate the foregoing details, as well as others, upon considering the following detailed description of certain non-limiting embodiments according to the present disclosure.

DETAILED DESCRIPTION OF CERTAIN NON-LIMITING EMBODIMENTS

It is to be understood that certain descriptions of the embodiments described herein have been simplified to illustrate only those elements, features, and aspects that are relevant to a clear understanding of the disclosed embodiments, while eliminating, for purposes of clarity, other elements, features, and aspects. Persons having ordinary skill in the art, upon considering the present description of the disclosed embodiments, will recognize that other elements and/or features may be desirable in a particular implementation or application of the disclosed embodiments. However, because such other elements and/or features may be readily ascertained and implemented by persons having ordinary skill in the art upon considering the present description of the disclosed embodiments, and are therefore not necessary for a complete understanding of the disclosed embodiments, a description of such elements and/or features is not provided herein. As such, it is to be understood that the description set forth herein is merely exemplary and illustrative of the disclosed embodiments and is not intended to limit the scope of the invention as defined solely by the claims.

Also, any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10. Any maximum numerical limitation recited herein is intended to include all lower numerical limitations subsumed therein and any minimum numerical limitation recited herein is intended to include all higher numerical limitations subsumed therein. Accordingly, Applicants reserve the right to amend the present disclosure, including the claims, to expressly recite any sub-range subsumed within the ranges expressly recited herein. All such ranges are intended to be inherently disclosed herein such that amending to expressly recite any such sub-ranges would comply with the requirements of 35 U.S.C. § 112, first paragraph, and 35 U.S.C. § 132(a).

The grammatical articles "one", "a", "an", and "the", as used herein, are intended to include "at least one" or "one or more", unless otherwise indicated. Thus, the articles are used herein to refer to one or more than one (i.e., to at least one) of the grammatical objects of the article. By way of example, "a component" means one or more components, and thus, possibly, more than one component is contemplated and may be employed or used in an implementation of the described embodiments.

All percentages and ratios are calculated based on the total weight of the alloy composition, unless otherwise indicated.

Any patent, publication, or other disclosure material that is said to be incorporated, in whole or in part, by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

The present disclosure includes descriptions of various embodiments. It is to be understood that all embodiments described herein are exemplary, illustrative, and non-limiting. Thus, the invention is not limited by the description of the various exemplary, illustrative, and non-limiting embodiments. Rather, the invention is defined solely by the claims, which may be amended to recite any features expressly or inherently described in or otherwise expressly or inherently supported by the present disclosure.

As used herein, the terms "forming", "forging", and "radial forging" refer to forms of thermomechanical processing ("TMP"), which also may be referred to herein as "thermomechanical working". Thermomechanical working is defined herein as generally covering a variety of metal forming processes combining controlled thermal and deformation treatments to obtain synergistic effects, such as improvement in strength, without loss of toughness. This definition of thermomechanical working is consistent with the meaning ascribed in, for example, ASM Materials Engineering Dictionary, J. R. Davis, ed., ASM International (1992), p. 480.

Conventional alloys used in chemical processing, mining, and/or oil and gas applications may lack an optimal level of corrosion resistance and/or an optimal level of one or more mechanical properties. Various embodiments of the alloys processed as discussed herein may have certain advantages over conventional alloys, including, but not limited to, improved corrosion resistance and/or mechanical properties. Certain embodiments of alloys processed as described herein may exhibit one or more improved mechanical properties without any reduction in corrosion resistance, for example. Certain embodiments may exhibit improved impact properties, weldability, resistance to corrosion fatigue, galling resistance, and/or hydrogen embrittlement resistance relative to certain conventional alloys.

In various embodiments, alloys processed as described herein may exhibit enhanced corrosion resistance and/or advantageous mechanical properties suitable for use in demanding applications. Without wishing to be bound to any particular theory, it is believed that certain of the alloys processed as described herein may exhibit higher tensile strength, for example, due to an improved response to strain hardening from deformation, while also retaining high corrosion resistance. Strain hardening or cold working may be used to harden materials that do not generally respond well to heat treatment. A person skilled in the art, however, will appreciate that the exact nature of the cold worked structure may depend on the material, applied strain, strain rate, and/or temperature of the deformation. Without wishing to be bound to any particular theory, it is believed that strain hardening an alloy having the composition described herein may more efficiently produce an alloy exhibiting improved corrosion resistance and/or mechanical properties than certain conventional alloys.

In certain non-limiting embodiments, the composition of an austenitic alloy processed by a method according to the present disclosure comprises, consists essentially of, or consists of, chromium, cobalt, copper, iron, manganese, molybdenum, nickel, carbon, nitrogen, tungsten, and incidental impurities. In certain non-limiting embodiments, the austenitic alloy may, but need not, include one or more of aluminum, silicon, titanium, boron, phosphorus, sulfur, niobium, tantalum, ruthenium, vanadium, and zirconium, either as trace elements or as incidental impurities.

Also, according to various non-limiting embodiments, the composition of an austenitic alloy processed by a method of the present disclosure comprises, consists essentially of, or consists of, in weight percentages based on total alloy weight, up to 0.2 carbon, up to 20 manganese, 0.1 to 1.0 silicon, 14.0 to 28.0 chromium, 15.0 to 38.0 nickel, 2.0 to 9.0 molybdenum, 0.1 to 3.0 copper, 0.08 to 0.9 nitrogen, 0.1 to 5.0 tungsten, 0.5 to 5.0 cobalt, up to 1.0 titanium, up to 0.05 boron, up to 0.05 phosphorus, up to 0.05 sulfur, iron, and incidental impurities.

In addition, according to various non-limiting embodiments, the composition of an austenitic alloy processed by a method according to the present disclosure comprises, consists essentially of, or consists of, in weight percentages based on total alloy weight, up to 0.05 carbon, 1.0 to 9.0 manganese, 0.1 to 1.0 silicon, 18.0 to 26.0 chromium, 19.0 to 37.0 nickel, 3.0 to 7.0 molybdenum, 0.4 to 2.5 copper, 0.1 to 0.55 nitrogen, 0.2 to 3.0 tungsten, 0.8 to 3.5 cobalt, up to 0.6 titanium, a combined weight percentage of niobium and tantalum no greater than 0.3, up to 0.2 vanadium, up to 0.1 aluminum, up to 0.05 boron, up to 0.05 phosphorus, up to 0.05 sulfur, iron, and incidental impurities.

Also, according to various non-limiting embodiments, the composition of an austenitic alloy processed by a method according to the present disclosure may comprise, consist essentially of, or consist of, in weight percentages based on total alloy weight, up to 0.05 carbon, 2.0 to 8.0 manganese, 0.1 to 0.5 silicon, 19.0 to 25.0 chromium, 20.0 to 35.0 nickel, 3.0 to 6.5 molybdenum, 0.5 to 2.0 copper, 0.2 to 0.5 nitrogen, 0.3 to 2.5 tungsten, 1.0 to 3.5 cobalt, up to 0.6 titanium, a combined weight percentage of niobium and tantalum no greater than 0.3, up to 0.2 vanadium, up to 0.1 aluminum, up to 0.05 boron, up to 0.05 phosphorus, up to 0.05 sulfur, iron, and incidental impurities.

In various non-limiting embodiments, the composition of an austenitic alloy processed by a method according to the present disclosure comprises carbon in any of the following weight percentage ranges: up to 2.0; up to 0.8; up to 0.2; up to 0.08; up to 0.05; up to 0.03; 0.005 to 2.0; 0.01 to 2.0; 0.01 to 1.0; 0.01 to 0.8; 0.01 to 0.08; 0.01 to 0.05; and 0.005 to 0.01.

In various non-limiting embodiments, the composition of an alloy according to the present disclosure may comprise manganese in any of the following weight percentage ranges: up to 20.0; up to 10.0; 1.0 to 20.0; 1.0 to 10; 1.0 to 9.0; 2.0 to 8.0; 2.0 to 7.0; 2.0 to 6.0; 3.5 to 6.5; and 4.0 to 6.0.

In various non-limiting embodiments, the composition of an austenitic alloy processed by a method according to the present disclosure comprises silicon in any of the following weight percentage ranges: up to 1.0; 0.1 to 1.0; 0.5 to 1.0; and 0.1 to 0.5.

In various non-limiting embodiments, the composition of an austenitic alloy processed by a method according to the present disclosure comprises chromium in any of the following weight percentage ranges: 14.0 to 28.0; 16.0 to 25.0; 18.0 to 26; 19.0 to 25.0; 20.0 to 24.0; 20.0 to 22.0; 21.0 to 23.0; and 17.0 to 21.0.

In various non-limiting embodiments, the composition of an austenitic alloy processed by a method according to the present disclosure comprises nickel in any of the following weight percentage ranges: 15.0 to 38.0; 19.0 to 37.0; 20.0 to 35.0; and 21.0 to 32.0.

In various non-limiting embodiments, the composition of an austenitic alloy processed by a method according to the present disclosure comprises molybdenum in any of the following weight percentage ranges: 2.0 to 9.0; 3.0 to 7.0; 3.0 to 6.5; 5.5 to 6.5; and 6.0 to 6.5.

In various non-limiting embodiments, the composition of an austenitic alloy processed by a method according to the present disclosure comprises copper in any of the following weight percentage ranges: 0.1 to 3.0; 0.4 to 2.5; 0.5 to 2.0; and 1.0 to 1.5.

In various non-limiting embodiments, the composition of an austenitic alloy processed by a method according to the present disclosure comprises nitrogen in any of the following weight percentage ranges: 0.08 to 0.9; 0.08 to 0.3; 0.1 to 0.55; 0.2 to 0.5; and 0.2 to 0.3. In certain embodiments, nitrogen in the austenitic alloy may be limited to 0.35 weight percent or 0.3 weight percent to address its limited solubility in the alloy.

In various non-limiting embodiments, the composition of an austenitic alloy processed by a method according to the present disclosure comprises tungsten in any of the following weight percentage ranges: 0.1 to 5.0; 0.1 to 1.0; 0.2 to 3.0; 0.2 to 0.8; and 0.3 to 2.5.

In various non-limiting embodiments, the composition of an austenitic alloy processed by a method according to the present disclosure comprises cobalt in any of the following weight percentage ranges: up to 5.0; 0.5 to 5.0; 0.5 to 1.0; 0.8 to 3.5; 1.0 to 4.0; 1.0 to 3.5; and 1.0 to 3.0. In certain embodiments, cobalt unexpectedly improved mechanical properties of the alloy. For example, in certain embodiments of the alloy, additions of cobalt may provide up to a 20% increase in toughness, up to a 20% increase in elongation, and/or improved corrosion resistance. Without wishing to be bound to any particular theory, it is believed that replacing iron with cobalt may increase the resistance to deleterious sigma phase precipitation in the alloy after hot working relative to non-cobalt bearing variants which exhibited higher levels of sigma phase at the grain boundaries after hot working.

In various non-limiting embodiments, the composition of an austenitic alloy processed by a method according to the present disclosure comprises a cobalt/tungsten weight percentage ratio of from 2:1 to 5:1, or from 2:1 to 4:1. In certain embodiments, for example, the cobalt/tungsten weight percentage ratio may be about 4:1. The use of cobalt and tungsten may impart improved solid solution strengthening to the alloy.

In various non-limiting embodiments, the composition of an austenitic alloy processed by a method according to the present disclosure comprises titanium in any of the following weight percentage ranges: up to 1.0; up to 0.6; up to 0.1; up to 0.01; 0.005 to 1.0; and 0.1 to 0.6.

In various non-limiting embodiments, the composition of an austenitic alloy processed by a method according to the present disclosure comprises zirconium in any of the following weight percentage ranges: up to 1.0; up to 0.6; up to 0.1; up to 0.01; 0.005 to 1.0; and 0.1 to 0.6.

In various non-limiting embodiments, the composition of an austenitic alloy processed by a method according to the present disclosure comprises niobium and/or tantalum in any of the following weight percentage ranges: up to 1.0; up to 0.5; up to 0.3; 0.01 to 1.0; 0.01 to 0.5; 0.01 to 0.1; and 0.1 to 0.5.

In various non-limiting embodiments, the composition of an austenitic alloy processed by a method according to the present disclosure comprises a combined weight percentage of niobium and tantalum in any of the following ranges: up to 1.0; up to 0.5; up to 0.3; 0.01 to 1.0; 0.01 to 0.5; 0.01 to 0.1; and 0.1 to 0.5.

In various non-limiting embodiments, the composition of an austenitic alloy processed by a method according to the present disclosure comprises vanadium in any of the following weight percentage ranges: up to 1.0; up to 0.5; up to 0.2; 0.01 to 1.0; 0.01 to 0.5; 0.05 to 0.2; and 0.1 to 0.5.

In various non-limiting embodiments, the composition of an austenitic alloy processed by a method according to the present disclosure comprises aluminum in any of the following weight percentage ranges: up to 1.0; up to 0.5; up to 0.1; up to 0.01; 0.01 to 1.0; 0.1 to 0.5; and 0.05 to 0.1.

In various non-limiting embodiments, the composition of an austenitic alloy processed by a method according to the present disclosure comprises boron in any of the following weight percentage ranges: up to 0.05; up to 0.01; up to 0.008; up to 0.001; up to 0.0005.

In various non-limiting embodiments, the composition of an austenitic alloy processed by a method according to the present disclosure comprises phosphorus in any of the following weight percentage ranges: up to 0.05; up to 0.025; up to 0.01; and up to 0.005.

In various non-limiting embodiments, the composition of an austenitic alloy processed by a method according to the present disclosure comprises sulfur in any of the following weight percentage ranges: up to 0.05; up to 0.025; up to 0.01; and up to 0.005.

In various non-limiting embodiments, the balance of the composition of an austenitic alloy according to the present disclosure may comprise, consist essentially of, or consist of iron and incidental impurities. In various non-limiting embodiments, the composition of an austenitic alloy processed by a method according to the present disclosure comprises iron in any of the following weight percentage ranges: up to 60; up to 50; 20 to 60; 20 to 50; 20 to 45; 35 to 45; 30 to 50; 40 to 60; 40 to 50; 40 to 45; and 50 to 60.

In various non-limiting embodiments, the composition of an austenitic alloy processed by a method according to the present disclosure comprises one or more trace elements. As used herein, "trace elements" refers to elements that may be present in the alloy as a result of the composition of the raw materials and/or the melting method employed and which are present in concentrations that do not significantly negatively affect important properties of the alloy, as those properties are generally described herein. Trace elements may include, for example, one or more of titanium, zirconium, niobium, tantalum, vanadium, aluminum, and boron in any of the concentrations described herein. In certain non-limiting embodiments, trace elements may not be present in alloys according to the present disclosure. As is known in the art, in producing alloys, trace elements typically may be largely or wholly eliminated by selection of particular starting materials and/or use of particular processing techniques. In various non-limiting embodiments, the composition of an austenitic alloy according to the present disclosure may comprise a total concentration of trace elements in any of the following weight percentage ranges: up to 5.0; up to 1.0; up to 0.5; up to 0.1; 0.1 to 5.0; 0.1 to 1.0; and 0.1 to 0.5.

In various non-limiting embodiments, the composition of an austenitic alloy processed by a method according to the present disclosure comprises a total concentration of incidental impurities in any of the following weight percentage ranges: up to 5.0; up to 1.0; up to 0.5; up to 0.1; 0.1 to 5.0; 0.1 to 1.0; and 0.1 to 0.5. As generally used herein, the term "incidental impurities" refers to elements present in the alloy in minor concentrations. Such elements may include one or more of bismuth, calcium, cerium, lanthanum, lead, oxygen, phosphorus, ruthenium, silver, selenium, sulfur, tellurium, tin, and zirconium. In various non-limiting embodiments, individual incidental impurities in the composition of an austenitic alloy processed according to the present disclosure do not exceed the following maximum weight percentages: 0.0005 bismuth; 0.1 calcium; 0.1 cerium; 0.1 lanthanum; 0.001 lead; 0.01 tin, 0.01 oxygen; 0.5 ruthenium; 0.0005 silver; 0.0005 selenium; and 0.0005 tellurium. In various non-limiting embodiments, the composition of an austenitic alloy processed by a method according to the present disclosure, the combined weight percentage of cerium, lanthanum, and calcium present in the alloy (if any is present) may be up to 0.1. In various non-limiting embodiments, the combined weight percentage of cerium and/or lanthanum present in the composition of an austenitic alloy may be up to 0.1. Other elements that may be present as incidental impurities in the composition of austenitic alloys processed as described herein will be apparent to those having ordinary skill in the art. In various non-limiting embodiments, the composition of an austenitic alloy processed by a method according to the present disclosure comprises a total concentration of trace elements and incidental impurities in any of the following weight percentage ranges: up to 10.0; up to 5.0; up to 1.0; up to 0.5; up to 0.1; 0.1 to 10.0; 0.1 to 5.0; 0.1 to 1.0; and 0.1 to 0.5.

In various non-limiting embodiments, an austenitic alloy processed according to a method of the present disclosure may be non-magnetic. This characteristic may facilitate use of the alloy in applications in which non-magnetic properties are important. Such applications include, for example, certain oil and gas drill string component applications. Certain non-limiting embodiments of the austenitic alloy processed as described herein may be characterized by a magnetic permeability value ($\mu_r$) within a particular range. In various non-limiting embodiments, the magnetic permeability value of an alloy processed according to the present disclosure may be less than 1.01, less than 1.005, and/or less than 1.001. In various embodiments, the alloy may be substantially free from ferrite.

In various non-limiting embodiments, an austenitic alloy processed by a method according to the present disclosure may be characterized by a pitting resistance equivalence number (PREN) within a particular range. As is understood, the PREN ascribes a relative value to an alloy's expected resistance to pitting corrosion in a chloride-containing environment. Generally, alloys having a higher PREN are expected to have better corrosion resistance than alloys having a lower PREN. One particular PREN calculation provides a $PREN_{16}$ value using the following formula, wherein the percentages are weight percentages based on total alloy weight:

$$PREN_{16}=\%\ Cr+3.3(\%\ Mo)+16(\%\ N)+1.65(\%\ W)$$

In various non-limiting embodiments, an alloy processed using a method according to the present disclosure may have a $PREN_{16}$ value in any of the following ranges: up to 60; up to 58; greater than 30; greater than 40; greater than 45; greater than 48; 30 to 60; 30 to 58; 30 to 50; 40 to 60; 40 to 58; 40 to 50; and 48 to 51. Without wishing to be bound to any particular theory, it is believed that a higher $PREN_{16}$ value may indicate a higher likelihood that the alloy will exhibit sufficient corrosion resistance in environments such as, for example, in highly corrosive environments, that may exist in, for example, chemical processing equipment and the down-hole environment to which a drill string is subjected in oil and gas drilling applications. Aggressively corrosive environments may subject an alloy to, for example, alkaline compounds, acidified chloride solutions, acidified sulfide solutions, peroxides, and/or $CO_2$, along with extreme temperatures.

In various non-limiting embodiments, an austenitic alloy processed by a method according to the present disclosure may be characterized by a coefficient of sensitivity to avoid precipitations value (CP) within a particular range. The concept of a CP value is described in, for example, U.S. Pat. No. 5,494,636, entitled "Austenitic Stainless Steel Having High Properties". In general, the CP value is a relative indication of the kinetics of precipitation of intermetallic phases in an alloy. A CP value may be calculated using the following formula, wherein the percentages are weight percentages based on total alloy weight:

$$CP=20(\%\ Cr)+0.3(\%\ Ni)+30(\%\ Mo)+5(\%\ W)+10(\%\ Mn)+50(\%\ C)-200(\%\ N)$$

Without wishing to be bound to any particular theory, it is believed that alloys having a CP value less than 710 will exhibit advantageous austenite stability which helps to minimize HAZ (heat affected zone) sensitization from intermetallic phases during welding. In various non-limiting embodiments, an alloy processed as described herein may have a CP in any of the following ranges: up to 800; up to 750; less than 750; up to 710; less than 710; up to 680; and 660-750.

In various non-limiting embodiments, an austenitic alloy according to the present disclosure may be characterized by a Critical Pitting Temperature (CPT) and/or a Critical Crevice Corrosion Temperature (CCCT) within particular ranges. In certain applications, CPT and CCCT values may more accurately indicate corrosion resistance of an alloy than the alloy's PREN value. CPT and CCCT may be measured according to ASTM G48-11, entitled "Standard Test Methods for Pitting and Crevice Corrosion Resistance of Stainless Steels and Related Alloys by Use of Ferric Chloride Solution". In various non-limiting embodiments, the CPT of an alloy processed according to the present disclosure may be at least 45° C., or more preferably is at least 50° C., and the CCCT may be at least 25° C., or more preferably is at least 30° C.

In various non-limiting embodiments, an austenitic alloy processed by a method according to the present disclosure may be characterized by a Chloride Stress Corrosion Cracking Resistance (SCC) value within a particular range. The concept of an SCC value is described in, for example, A. J. Sedricks, *Corrosion of Stainless Steels* (J. Wiley and Sons 1979). In various non-limiting embodiments, the SCC value of an alloy according to the present disclosure may be determined for particular applications according to one or more of the following: ASTM G30-97 (2009), entitled "Standard Practice for Making and Using U-Bend Stress-Corrosion Test Specimens"; ASTM G36-94 (2006), entitled "Standard Practice for Evaluating Stress-Corrosion-Cracking Resistance of Metals and Alloys in a Boiling Magnesium Chloride Solution"; ASTM G39-99 (2011), "Standard Practice for Preparation and Use of Bent-Beam Stress-Corrosion Test Specimens"; ASTM G49-85 (2011), "Standard Practice for Preparation and Use of Direct Tension Stress-Corrosion Test Specimens"; and ASTM G123-00 (2011), "Standard Test Method for Evaluating Stress-Corrosion Cracking of Stainless Alloys with Different Nickel Content in Boiling Acidified Sodium Chloride Solution." In various non-limiting embodiments, the SCC value of an alloy processed according to the present disclosure is high enough to indicate that the alloy can suitably withstand boiling acidified sodium chloride solution for 1000 hours without experiencing unacceptable stress corrosion cracking, pursuant to evaluation under ASTM G123-00 (2011).

It was discovered that the microstructures of forged workpieces of alloy compositions described above may contain deleterious intermetallic precipitates. It is believed that the intermetallic precipitates likely are sigma phase precipitates, i.e., $(Fe,Ni)_3(Cr,Mo)_2$ compounds. Intermetallic precipitates may impair corrosion resistance of the alloys and negatively impact their suitability for service in oil and gas drilling and other aggressive environments. FIG. 1 shows an example of deleterious intermetallic precipitates 12 in the microstructure 10 at the mid radius of a radial forged workpiece. The chemical composition of the alloy shown in FIG. 1 falls within alloy compositions listed herein and consisted of, in weight percentages based on total alloy weight: 26.0397 iron; 33.94 nickel; 22.88 chromium; 6.35 molybdenum; 4.5 manganese; 3.35 cobalt; 1.06 tungsten; 1.15 copper; 0.01 niobium; 0.26 silicon; 0.04 vanadium; 0.019 carbon; 0.0386 nitrogen; 0.015 phosphorus; 0.0004 sulfur; and incidental impurities.

If intermetallic precipitates are confined to an alloy surface, surface grinding can be used to remove the deleterious layer containing the intermetallic precipitates, with concomitant reduction in product yield and increase in product cost. In some alloy compositions, however, the deleterious intermetallic precipitates may extend significantly into or throughout the cross-section of a radial forged workpiece, in which case the workpiece may be wholly unsuitable in the as-radial forged condition for applications subjecting the alloy to, for example, highly corrosive conditions. An option for removing deleterious intermetallic precipitates from the microstructure is to solution treat the radial forged workpiece prior to a cooling temperature radial forging operation. This, however, adds an additional processing step and increases cost and cycle time. Additionally, the time it takes to cool the workpiece from the annealing temperature is dependent on the diameter of the workpiece, and it should be sufficiently rapid to prevent the formation of the deleterious intermetallic precipitates.

Figure 2:
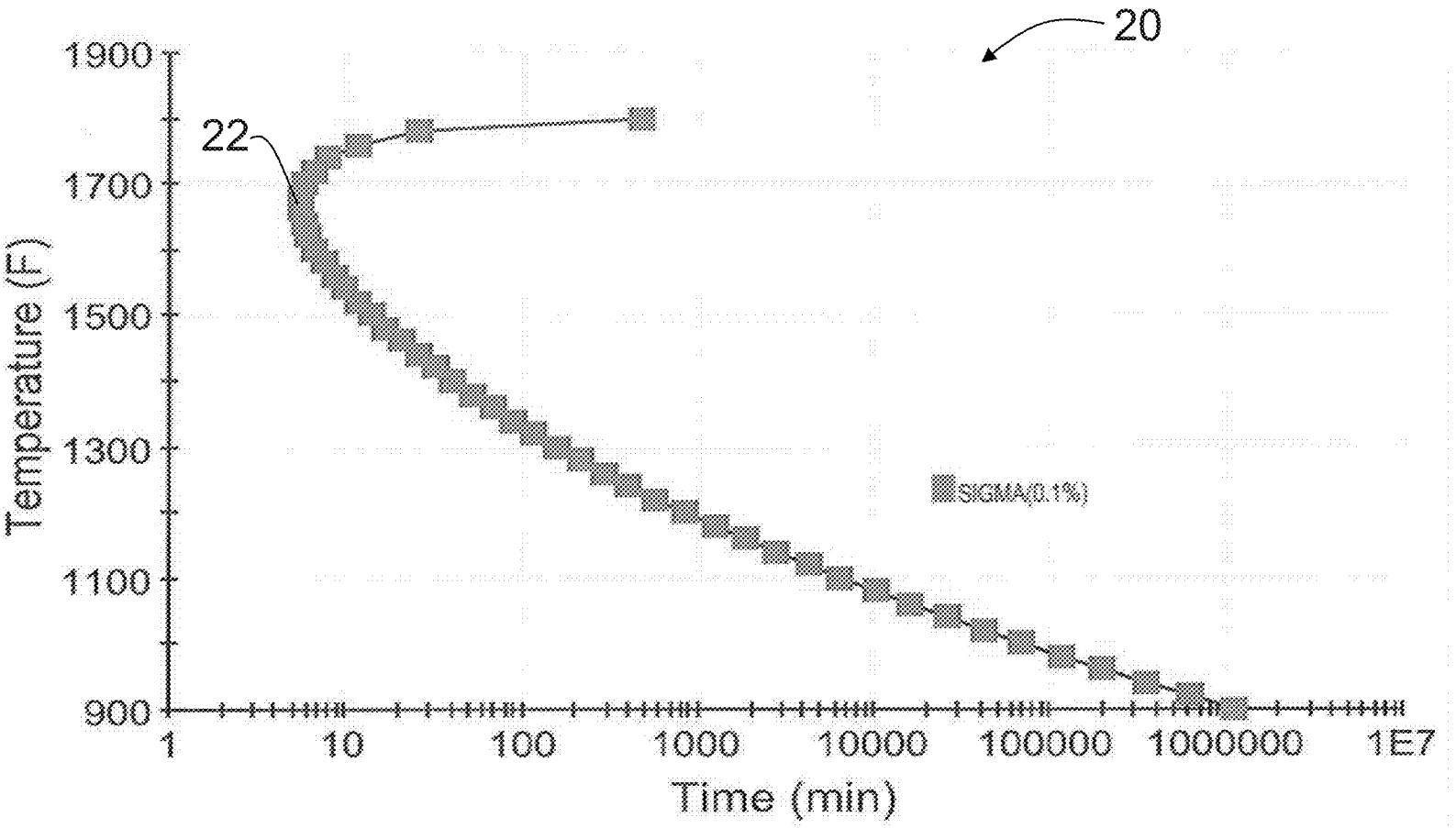
FIG. 2 is an isothermal transformation curve or TTT curve predicting the kinetics for 0.1 weight percent σ-phase intermetallic precipitation in an alloy.

Without intending to be bound to any particular theory, it is believed that the intermetallic precipitates principally form because the precipitation kinetics are sufficiently rapid to permit precipitation to occur during the time taken to forge the workpiece. FIG. 2 is an isothermal transformation curve 20, also known as a "TTT diagram" or "TTT curve", which predicts the kinetics for 0.1 weight percent σ-phase (sigma phase) intermetallic precipitation in the alloy having the composition described above for FIG. 1. It will be seen from FIG. 2 that intermetallic precipitation occurs most rapidly, i.e., in the shortest time, at the apex 22 or "nose" of the "C" curve that comprises the isothermal transformation curve 20.

Figure 3:
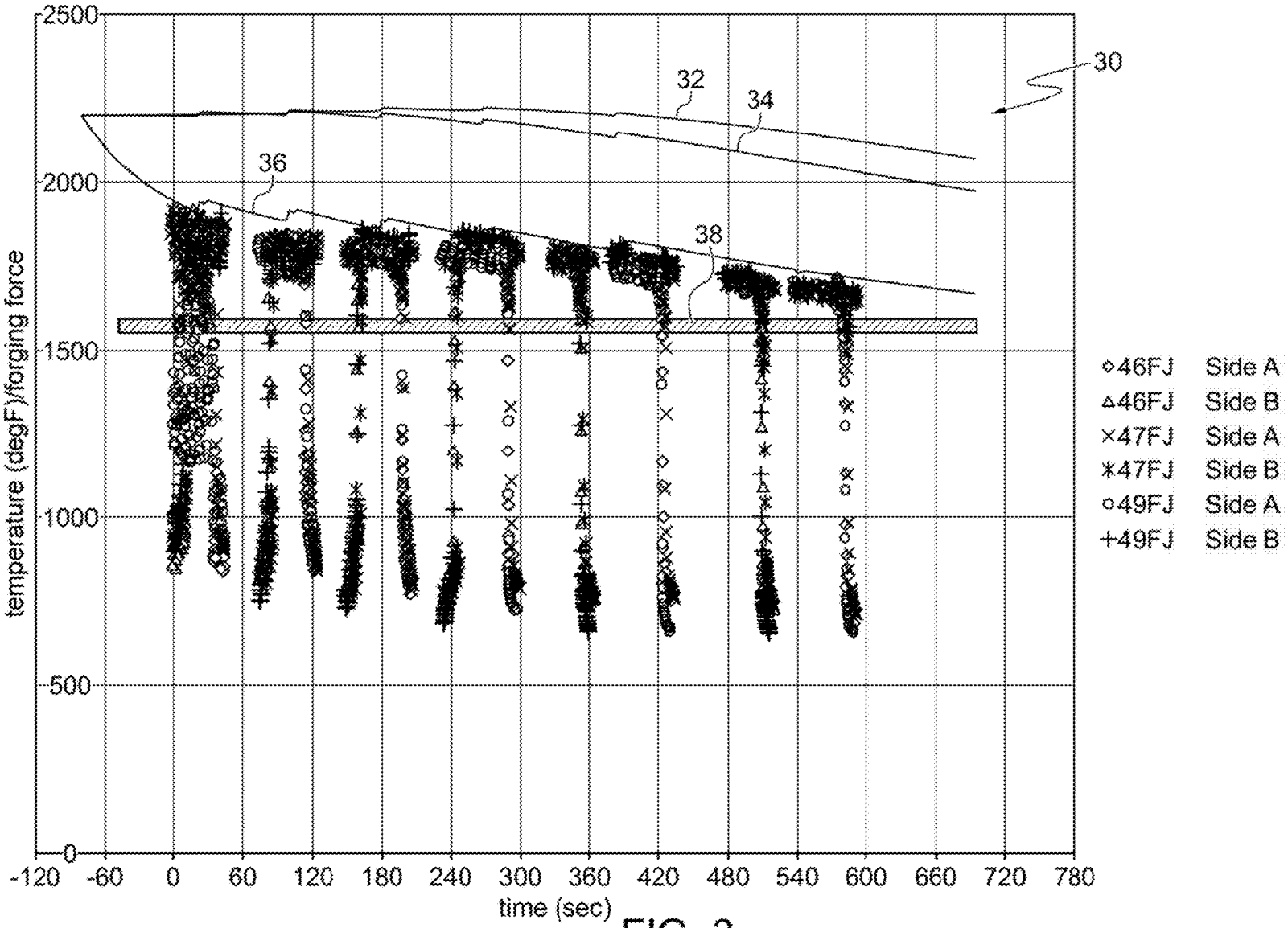
FIG. 3 is a plot showing calculated center-of-workpiece temperature, calculated center temperature, calculated surface temperature, and actual temperatures derived from the radial forging of experimental workpieces of austenitic alloys according to methods of the present disclosure.

FIG. 3 is a graph showing a combination 30 of a calculated center-of-workpiece temperature 32, calculated mid-radius temperature 34, calculated surface temperature 36, and actual temperatures from the radial forging of experimental workpieces of austenitic alloys having the chemical compositions listed in Table 1. These compositions fall within the scope of alloy compositions described above in the present detailed description. The workpieces had a diameter of approximately 10 inches, and the actual temperatures were measured using optical pyrometers. The temperature of the nose of the TTT diagram is represented as line 38. Table 1 also shows the $PREN_{16}$ values for the listed alloy compositions.

TABLE 1

| Element | Heat 45FJ | Heat 47FJ | Heat 48FJ | Heat 49FJ |
|---|---|---|---|---|
| C | 0.007 | 0.010 | 0.018 | 0.010 |
| Mn | 4.47 | 4.50 | 4.51 | 4.55 |
| Cr | 20.91 | 22.26 | 22.91 | 21.32 |
| Mo | 4.76 | 6.01 | 6.35 | 5.41 |
| Co | 2.05 | 2.60 | 3.38 | 2.01 |
| Fe | 40.67 | 32.37 | 26.20 | 39.57 |
| Nb | 0.01 | 0.01 | 0.01 | 0.01 |

TABLE 1-continued

| Element | Heat 45FJ | Heat 47FJ | Heat 48FJ | Heat 49FJ |
|---|---|---|---|---|
| Ni | 25.35 | 30.07 | 34.10 | 25.22 |
| W | 0.64 | 0.84 | 1.07 | 0.64 |
| N | 0.072 | 0.390 | 0.385 | 0.393 |
| $PREN_{16}$ | 44 | 50 | 52 | 47 |

It may be observed from FIG. 3 that the actual surface temperature of the workpieces during radial forging is close to the temperature at which the kinetics of intermetallic precipitation are most rapid, thereby strongly promoting precipitation of the deleterious intermetallic compounds.

Using the thermodynamic modeling software JMatPro, available from Sente Software Ltd., Surrey, United Kingdom, relationships were determined between the content of specific elements in certain alloys described herein and (1) the time to the apex of the isothermal transformation curve and (2) the temperature in the apex area of the isothermal transformation curve. It was determined that adjusting the levels of various elements in the alloys can change the time to the apex of the isothermal transformation curve and thereby permit thermomechanical processing to take place without the formation of the deleterious intermetallic precipitates. Examples of the thermomechanical processing that may be applied include, but are not limited to, radial forging and press forging.

Figure 4:
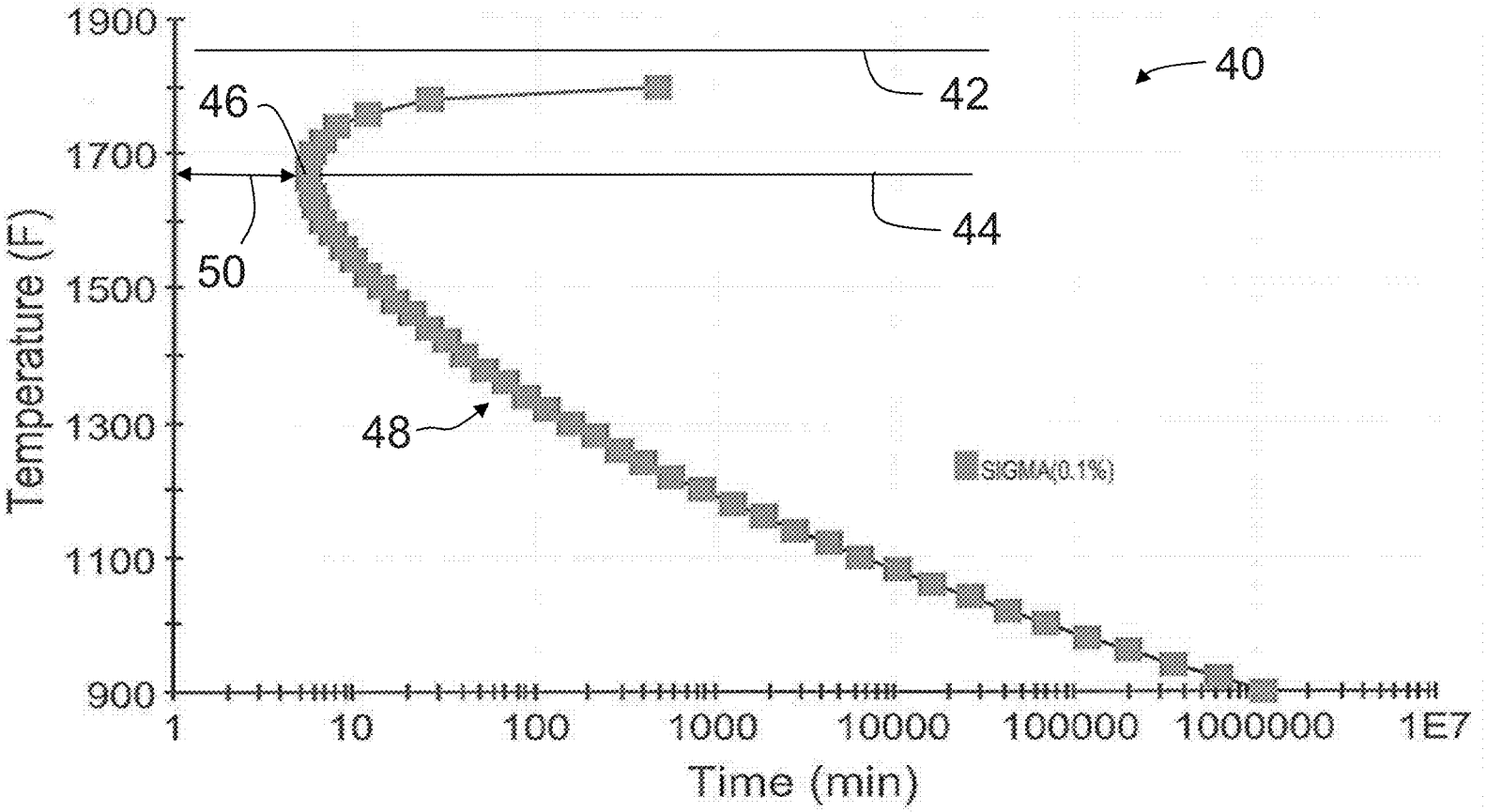
FIG. 4 is a TTT curve, with associated forming and cooling temperatures and times, according to embodiments of the present disclosure.

Accordingly, a non-limiting aspect of the present disclosure is directed to a quantitative relationship discovered between the chemical composition of a high strength, non-magnetic austenitic steel and the maximum allowable time for processing the alloy as it cools between a specific temperature range so as to avoid formation of deleterious intermetallic precipitates within the alloy. FIG. 4 is a TTT curve 48, showing a calculated sigma solvus temperature 42, a cooling temperature 44, and a critical cooling time 50, and also illustrates a relationship 40 according to the present disclosure defining the maximum time or critical cooling time 50 allowable for processing the alloy as it cools within a specific temperature range to avoid precipitation of deleterious intermetallics.

The relationship 40 illustrated in FIG. 4 may be described using three equations. Equation 1 defines the calculated sigma solvus temperature, represented in FIG. 4 by line 42.

Calculated Sigma Solvus Temperature (° F.)=1155.8−[(760.4)·(% nickel/% iron)]+[(1409)·(% chromium/% iron)]+[(2391.6)·(% molybdenum/% iron)]−[(288.9)·(% manganese/% iron)−[(634.8)·(% cobalt/% iron)]+[(107.8)·(% tungsten/% iron)]. Equation 1

When austenitic steels according to the present disclosure are at or above the calculated sigma solvus temperature according to Equation 1, the deleterious intermetallic precipitates have not formed in the alloys.

In a non-limiting embodiment the workpiece is thermomechanically processed at a temperature in a thermomechanical processing temperature range. The temperature range is from a temperature just below the calculated sigma solvus temperature 42 of the austenitic alloy to a cooling temperature 44 of the austenitic alloy. Equation 2 is used to calculate the cooling temperature 44 in degrees Fahrenheit as a function of the chemical composition of the austenitic steel alloy. Referring to FIG. 4, the cooling temperature 44 calculated according to Equation 2 is intended to predict the temperature of the apex 46 of the isothermal transformation curve 48 of the alloy.

Cooling Temperature (° F.)=1290.7−[(604.2)·(% nickel/% iron)]+[(829.6)·(% chromium/% iron)]+[(1899.6)·(% molybdenum/% iron)]−[(635.5)·(% cobalt/% iron)]+[(1251.3)·(% tungsten/% iron)]. Equation 2

Equation 3 is an equation that predicts the time in $\log_{10}$ minutes at which the apex 46 of the isothermal transformation curve 48 for the particular alloy occurs.

Critical Cooling Time ($\log_{10}$ in minutes)=2.948+[(3.631)·(% nickel/% iron)]−[(4.846)·(% chromium/% iron)]−[(11.157)·(% molybdenum/% iron)]+[(3.457)·(% cobalt/% iron)]−[(6.74)·(% tungsten/% iron)]. Equation 3

Referring to FIG. 4, the time at which the apex 46 of the isothermal transformation curve 48 occurs is represented by arrow 50. The time calculated by Equation 3 and represented by arrow 50 in FIG. 4 is referred to herein as the "critical cooling time". If the time during which the alloy cools in temperature range that spans a temperature just below the calculated sigma solvus temperature 42 to the cooling temperature 44 is longer than the critical cooling time 50, deleterious intermetallic precipitates may form. The intermetallic precipitates may render the alloy or product unsuitable for its intended use because of galvanic corrosion cells established between the intermetallic precipitates and the base alloy. More generally, to prevent formation of deleterious intermetallic precipitates, the time to thermomechanically process the alloy in a temperature range spanning a temperature just less than the calculated sigma solvus temperature 42 down to the cooling temperature 44 should be no greater than the critical cooling time 50.

In a non-limiting embodiment, the workpiece is allowed to cool from a temperature just below the calculated sigma solvus temperature 42 to the cooling temperature 44 within a time no longer than the critical cooling time 50. It will be recognized that the workpiece can be allowed to cool during thermomechanical processing of the workpiece. For example, and not to be limiting, a workpiece may be heated to a temperature in a thermomechanical processing temperature range and subsequently thermomechanically processed using a forging process. As the workpiece is thermomechanically processed, the workpiece may cool to a degree. In a non-limiting embodiment, allowing the workpiece to cool comprises the natural cooling that may occur during thermomechanical processing. According to an aspect of the present disclosure, it is only required that the time that the workpiece spends in a cooling temperature range spanning a temperature just below the calculated sigma solvus temperature 42 to the cooling temperature 44, is no greater than the critical cooling time 50.

According to certain non-limiting embodiments, a critical cooling time that is practical for forging, radial forging, or other thermomechanical processing of an austenitic alloy workpiece according to the present disclosure is within a range of 10 minutes to 30 minutes. Certain other non-limiting embodiments include a critical cooling time of greater than 10 minutes, or greater than 30 minutes. It will be recognized that according to methods of the present disclosure, the critical cooling time calculated according to Equation 3 based on the chemical composition of the alloy is the maximum allowable time to thermomechanically process and/or cool in a temperature range spanning a temperature just less than the calculated sigma solvus temperature (calculated by Equation 1 above) down to the cooling temperature (calculated by Equation 2 above).

The calculated sigma solvus temperature calculated by Equation 1 and the cooling temperature calculated by Equation 2 define end points of the temperature range over which the cooling time requirement, or, as referred to herein, the critical cooling time, is important. The time during which the alloy is hot worked at or above the calculated sigma solvus temperature calculated according to Equation 1 is unimportant to the present method because elements forming the deleterious intermetallic precipitates addressed herein remain in solution when the alloy is at or above the calculated sigma solvus temperature. Instead, only the time during which the workpiece is within the range of temperatures spanning a temperature just less than the calculated sigma solvus temperature (calculated using Equation 1) to the cooling temperature (calculated using Equation 2), which is referred to herein as the cooling temperature range, is significant for preventing deleterious intermetallic σ-phase precipitation. In order to prevent the formation of deleterious σ-phase intermetallic particles, the actual time that the workpiece spends in the calculated cooling temperature range must be no greater than the critical cooling time as calculated in Equation 3.

Also, the time during which the workpiece is at a temperature below the cooling temperature calculated according to Equation 2 is unimportant to the present method because below the cooling temperature, the rates of diffusion of the elements comprising the deleterious intermetallic precipitates are low enough to inhibit substantial formation of the precipitates. The total time it takes to work the alloy at a temperature less than the calculated sigma solvus temperature according to Equation 1 and then cool the alloy to the cooling temperature according to Equation 2, i.e., the time during which the alloy is in the temperature range bounded by (i) a temperature just less than the calculated sigma solvus temperature and (ii) the cooling temperature, must be no greater than the critical cooling time according to Equation 3.

Table 2 shows the calculated sigma solvus temperatures calculated using Equation 1, the cooling temperatures calculated from Equation 2, and the critical cooling times calculated from Equation 3 for the three alloys having the compositions in Table 1.

TABLE 2

| | Heat 45FJ | Heat 47FJ | Heat 48FJ | Heat 49FJ |
|---|---|---|---|---|
| Calculated sigma solvus temperature (° F.) | 1624 | 1774 | 1851 | 1694 |
| Cooling temperature (° F.) | 1561 | 1634 | 1659 | 1600 |
| Critical cooling time (min) | 30.4 | 10.5 | 8.0 | 15.6 |

According to a non-limiting aspect of the present disclosure, thermomechanically working a workpiece according to methods of the present disclosure comprises forging the workpiece. For the thermomechanical process of forging, the thermomechanical working temperature and the thermomechanical working temperature range according to the present disclosure may be referred to as the forging temperature and the forging temperature range, respectively.

According to another certain aspect of the present disclosure, thermomechanically working a workpiece according to methods of the present disclosure may comprise radial forging the workpiece. For the thermomechanical process of radial forging, the thermomechanical processing temperature range according to the present disclosure may be referred to as the radial forging temperature range.

In a non-limiting embodiment of a method according to the present disclosure, the step of thermomechanically working or processing the workpiece comprises or consists of forging the alloy. Forging may include, but is not limited to any of the following types of forging: roll forging, swaging, cogging, open-die forging, closed-die forging, isothermal forging, impression-die forging, press forging, automatic hot forging, radial forging, and upset forging. In a specific embodiment, forming comprises or consists of radial forging.

According to a non-limiting aspect of the present disclosure, a workpiece may be annealed after steps of thermomechanical working and cooling according to the present disclosure. Annealing comprises heating the workpiece to a temperature that is equal to or greater than the calculated sigma solvus temperature according to Equation 1, and holding the workpiece at the temperature for period of time. The annealed workpiece is then cooled. Cooling the annealed workpiece in the temperature range spanning a temperature just below the calculated sigma solvus temperature (calculated according to Equation 1) and the cooling temperature calculated according to Equation 2 must be completed within the critical cooling time calculated according to Equation 3 in order to prevent precipitation of the deleterious intermetallic phase. In a non-limiting embodiment the alloy is annealed at a temperature in a range of 1900° F. to 2300° F., and the alloy is held at the annealing temperature for 10 minutes to 1500 minutes.

It will be recognized that the methods of processing an austenitic alloy workpiece to inhibit precipitation of intermetallic compounds according to the present disclosure apply to any and all of the alloys having chemical compositions described in the present disclosure.

Figure 5:
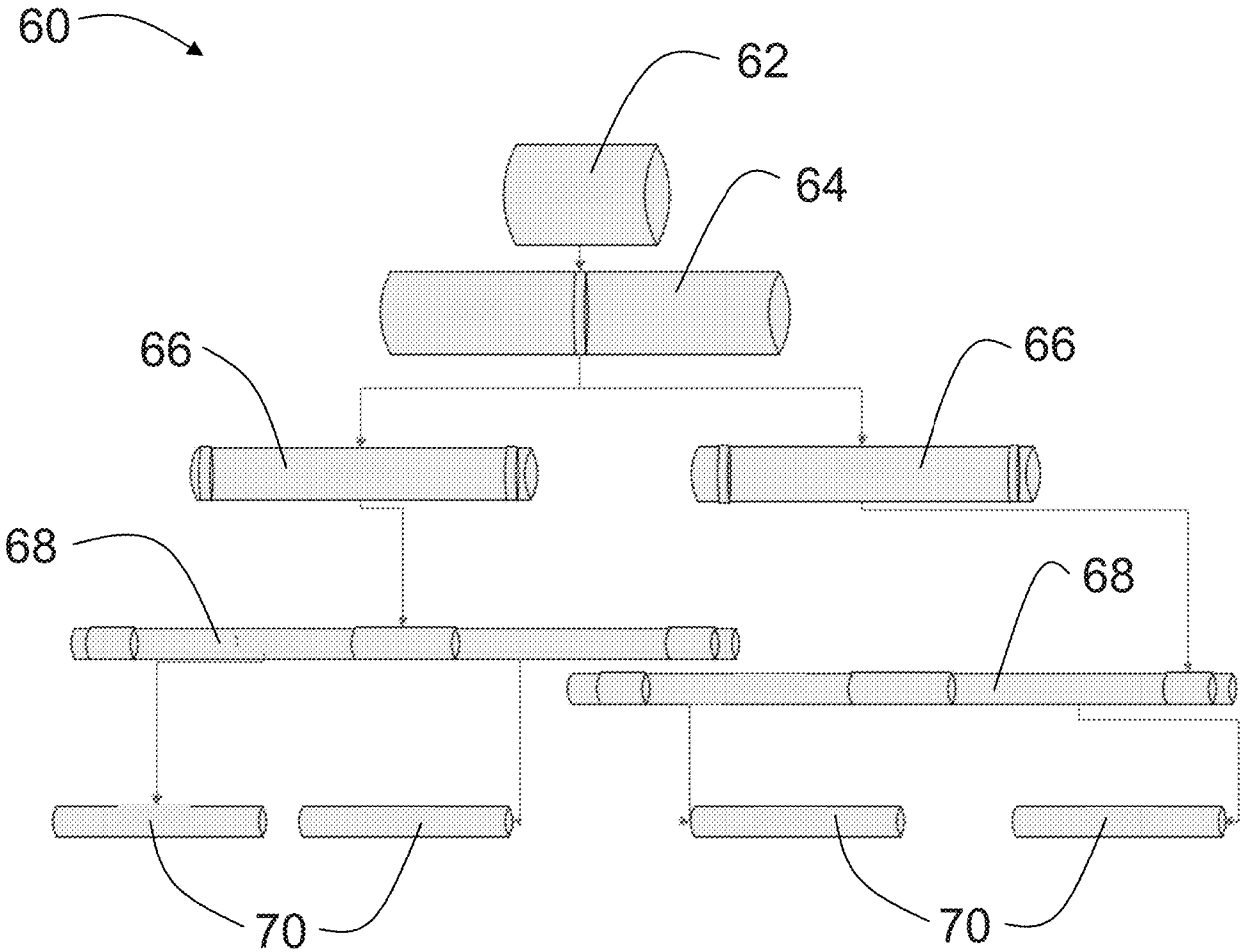
FIG. 5 is a schematic illustration of a non-limiting embodiment of a process according to the present disclosure for producing forms of specific diameter of a high strength non-magnetic steel useful for exploration and production drilling applications in the oil and gas industry.

FIG. 5 is a schematic diagram of a process 60 which is a non-limiting embodiment of a method according to the present disclosure. Process 60 may be used to manufacture high strength non-magnetic steel product forms having diameters useful for exploration and production drilling applications in the oil and gas industry. The material is melted to a 20-inch diameter ingot (62) using a combination of argon oxygen decarburization and electroslag remelting (AOD/ESR). AOD and ESR are techniques known to those having ordinary skill and, therefore, are not further described herein. The 20-inch diameter ingot is radial forged to 14-inch diameter (64), reheated, and radial forged to approximately 9-inch diameter (66). The 9-inch diameter ingot is then allowed to cool (not shown in FIG. 5). The final step in the process 60 is a low temperature radial forge operation reducing the diameter to approximately 7.25-inch diameter (68). The 7.25-inch diameter rod may be multiple cut (70) for polishing, testing, and/or subsequent processing.

In the scheme shown in FIG. 5, the steps that pertain to the method of the present disclosure are the step of radial forging the workpiece from approximately 14-inch diameter (64) to approximately 9-inch diameter (66), and the subsequent or concurrent step during which the radial forged workpiece cools (not shown in FIG. 5). Referring to FIG. 4, all regions (i.e., the entire workpiece cross-section) of the radial forged approximately 9-inch diameter workpiece should cool from a temperature just below the calculated sigma solvus temperature 42 to the cooling temperature 44 in a time no greater than the calculated critical cooling time 50. It will be recognized that in certain non-limiting embodiments according to the present disclosure, all or some amount of cooling to the cooling temperature 44 can occur while the workpiece is simultaneously being thermomechanically worked or forged, and the cooling of the workpiece need not occur entirely as a step separate from the thermomechanical working or forging step.

During a direct radial forging operation, the most rapid cooling occurs at the surface of the workpiece, and the surface region may end up being processed at or below the cooling temperature 44 as described previously. To prevent the precipitation of the deleterious intermetallic precipitate, the cooling time of the surface region should conform to the constraint of the critical cooling time 50 calculated from the alloy composition using Equation 3.

In a non-limiting embodiment, it is possible to shorten the available cooling window by adding an additional process step aimed at eliminating the intermetallic precipitate from the as-forged workpiece. The additional process step may be a heat treatment adapted to dissolve the intermetallic precipitate in the as-forged workpiece at temperatures greater than the calculated sigma solvus temperature 42. However, any time taken for the surface, mid-radius, and center of the workpiece to cool after the heat treatment must be within the critical cooling time calculated according to Equation 3. The cooling rate after the additional heat treatment process step is partially dependent on the diameter of the workpiece, with the center of the workpiece cooling at the slowest rate. The greater the diameter of the workpiece, the slower the cooling rate of the center of the workpiece. In any case, cooling between a temperature just below the calculated sigma solvus temperature and the calculated cooling temperature should be no longer than the critical cooling time of Equation 3.

An unexpected observation during the development of the present invention was that nitrogen had a significant influence on the available time for processing in that the nitrogen suppressed precipitation of the deleterious intermetallics and thereby permitted longer critical cooling times without formation of the deleterious intermetallics. Nitrogen, however, is not included in Equations 1-3 of the present disclosure because in a non-limiting embodiment, nitrogen is added to the austenitic alloys processed according to the present methods at the element's solubility limit, which will be relatively constant over the range of chemical compositions for the austenitic alloys described herein.

After thermomechanically working an austenitic alloy and cooling according to the methods herein and the constraints of Equations 1-3, the processed alloy may be fabricated into or included in various articles of manufacture. The articles of manufacture may include, but are not limited to, parts and components for use in the chemical, petrochemical, mining, oil, gas, paper products, food processing, pharmaceutical, and/or water service industries. Non-limiting examples of specific articles of manufacture that may include alloys processed by methods according to the present disclosure include: a pipe; a sheet; a plate; a bar; a rod; a forging; a tank; a pipeline component; piping, condensers, and heat exchangers intended for use with chemicals, gas, crude oil, seawater, service water, and/or corrosive fluids (e.g., alkaline compounds, acidified chloride solutions, acidified sulfide solutions, and/or peroxides); filter washers, vats, and press rolls in pulp bleaching plants; service water piping systems for nuclear power plants and power plant flue gas scrubber environments; components for process systems for offshore oil and gas platforms; gas well components, including tubes, valves, hangers, landing nipples, tool joints, and packers; turbine engine components; desalination components and pumps; tall oil distillation columns and packing; articles for marine environments, such as, for example, transformer cases; valves; shafting; flanges; reactors; collectors; separators; exchangers; pumps; compressors; fasteners; flexible connectors; bellows; chimney liners; flue liners; and certain drill string components such as, for example, stabilizers, rotary steerable drilling components, drill collars, integral blade stabilizers, stabilizer mandrels, drilling and measurement tubulars, measurements-while-drilling housings, logging-while-drilling housings, non-magnetic drill collars, non-magnetic drill pipe, integral blade non-magnetic stabilizers, non-magnetic flex collars, and compressive service drill pipe.

In connection with the methods according to the present disclosure, the austenitic alloys having the compositions described in the present disclosure may be provided by any suitable conventional technique known in the art for producing alloys. Such techniques include, for example, melt practices and powder metallurgy practices. Non-limiting examples of conventional melt practices include, without limitation, practices utilizing consumable melting techniques (e.g., vacuum arc remelting (VAR) and ESR, non-consumable melting techniques (e.g., plasma cold hearth melting and electron beam cold hearth melting), and a combination of two or more of these techniques. As known in the art, certain powdered metallurgy practices for preparing an alloy generally involve producing alloy powders by the following steps: AOD, vacuum oxygen decarburization (VOD), or vacuum induction melting (VIM) ingredients to provide a melt having the desired composition; atomizing the melt using conventional atomization techniques to provide an alloy powder; and pressing and sintering all or a portion of the alloy powder. In one conventional atomization technique, a stream of the melt is contacted with the spinning blade of an atomizer, which breaks up the stream into small droplets. The droplets may be rapidly solidified in a vacuum or inert gas atmosphere, providing small solid alloy particles.

After thermomechanically working and cooling a workpiece according to the constraints of Equations 1-3 of the present disclosure, the austenitic alloys described herein may have improved corrosion resistance and/or mechanical properties relative to conventional alloys. After thermomechanically working and cooling a workpiece according to the constraints of Equations 1-3 of the present disclosure, non-limiting embodiments of the alloys described herein may have ultimate tensile strength, yield strength, percent elongation, and/or hardness greater, comparable to, or better than DATALLOY 2® alloy (UNS unassigned) and/or AL-6XN® alloy (UNS N08367), which are available from Allegheny Technologies Incorporated, Pittsburgh, Pa. USA. Also, after thermomechanically processing and allowing the workpiece to cool according to the constraints of Equations 1-3 of the present disclosure, the alloys described herein may have PREN, CP, CPT, CCCT, and/or SCC values comparable to or better than DATALLOY 2® alloy and/or AL-6XN® alloy. In addition, after thermomechanically processing and allowing the workpiece to cool according to the constraints of Equations 1-3 of the present disclosure, the alloys described herein may have improved fatigue strength, microstructural stability, toughness, thermal cracking resistance, pitting corrosion, galvanic corrosion, SCC, machinability, and/or galling resistance relative to DATALLOY 2® alloy and/or AL-6XN® alloy. DATALLOY 2® alloy is a Cr—Mn—N stainless steel having the following nominal composition, in weight percentages: 0.03 carbon; 0.30 silicon; 15.1 manganese; 15.3 chromium; 2.1 molybdenum; 2.3 nickel; 0.4 nitrogen; balance iron and impurities. AL-6XN® alloy is a superaustenitic stainless steel having the following typical composition, in weight percentages: 0.02 carbon; 0.40 manganese; 0.020 phosphorus; 0.001 sulfur; 20.5 chromium; 24.0 nickel; 6.2 molybdenum; 0.22 nitrogen; 0.2 copper; balance iron and impurities.

In certain non-limiting embodiments, after thermomechanically working and cooling a workpiece according to the constraints of Equations 1-3 of the present disclosure, the alloys described herein may exhibit, at room temperature, ultimate tensile strength of at least 110 ksi, yield strength of at least 50 ksi, and/or percent elongation of at least 15%. In various other non-limiting embodiments, after forming, forging, or radial forging and cooling according to the present disclosure, the alloys described herein may exhibit, in an annealed state and at room temperature, ultimate tensile strength in the range of 90 ksi to 150 ksi, yield strength in the range of 50 ksi to 120 ksi, and/or percent elongation in the range of 20% to 65%.

The examples that follow are intended to further describe certain non-limiting embodiments, without restricting the scope of the present disclosure. Persons having ordinary skill in the art will appreciate that variations of the following examples are possible within the scope of the invention, which is defined solely by the claims.

Example 1

Figure 6:
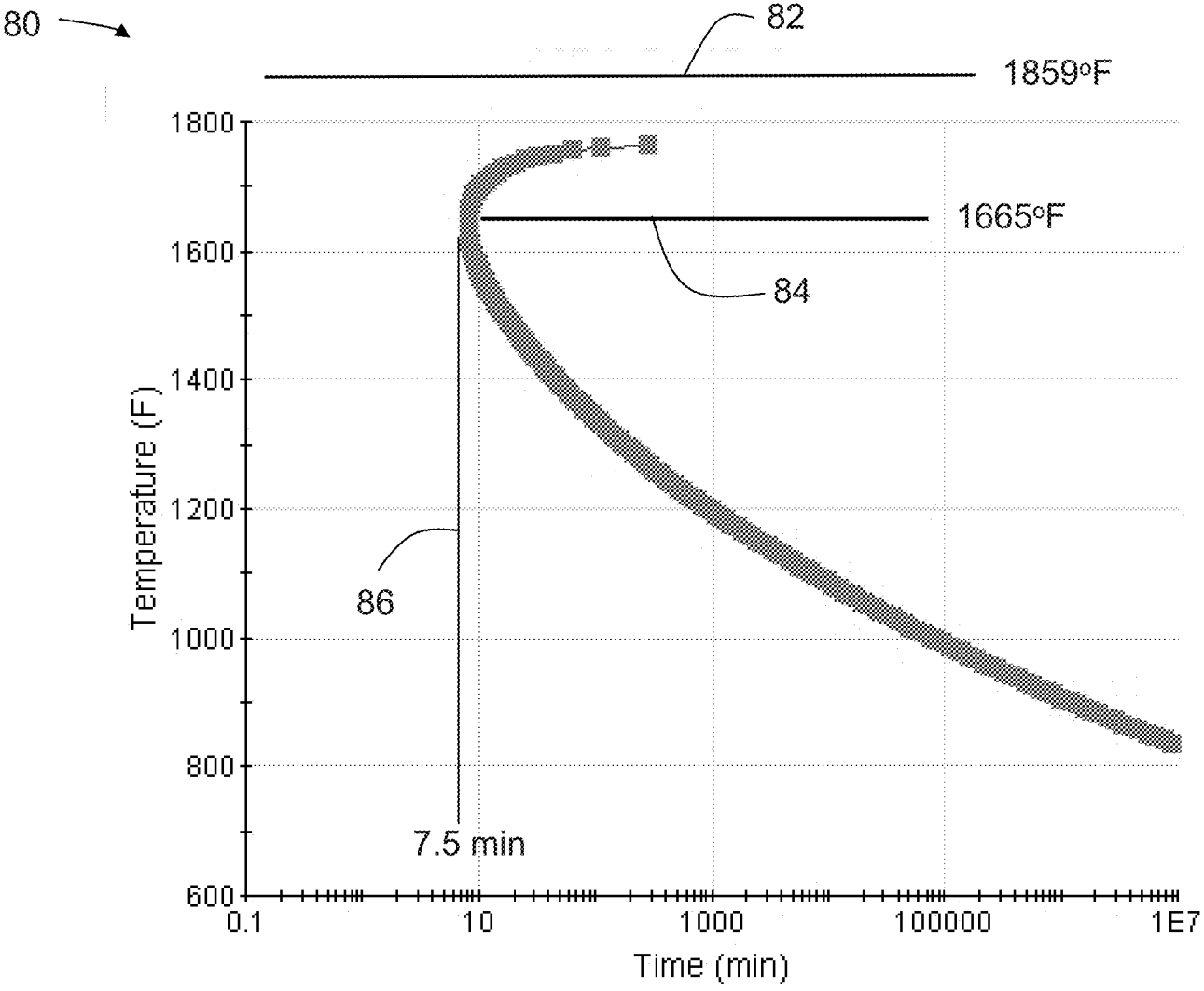
FIG. 6 is a TTT diagram for an embodiment of an alloy having a relatively short critical cooling time as calculated according to an embodiment of the present disclosure.

FIG. 6 shows an example of a TTT diagram 80 for an alloy that has a relatively short allowable critical cooling time as calculated using Equation 3 of the present disclosure. The chemical composition of the alloy that is the subject of FIG. 6 includes, in weight percentages: 26.04 iron; 33.94 nickel; 22.88 chromium; 6.35 molybdenum; 4.5 manganese; 3.35 cobalt; 1.06 tungsten; 1.15 copper; 0.01 niobium; 0.26 silicon; 0.04 vanadium; 0.019 carbon; 0.386 nitrogen; 0.015 phosphorus; and 0.0004 sulfur. For this alloy composition, the calculated sigma solvus temperature 82 calculated according to Equation 1 of the present disclosure is about 1859° F.; the cooling temperature 84 calculated according to Equation 2 of the present disclosure is about 1665° F.; and the critical cooling time 86 calculated according to Equation 3 of the present disclosure is about 7.5 minutes. According the present disclosure, in order to prevent precipitation of the deleterious intermetallic phase, the workpiece must be thermomechanically processed and allowed to cool when within the temperature range just less that 1859° F. (i.e., the calculated sigma solvus temperature calculated by Equation 1) down to 1665° F. (i.e., the cooling temperature calculated according to Equation 2) for no longer than 7.5 minutes (i.e., the critical cooling time calculated according to Equation 3).

Figure 7:
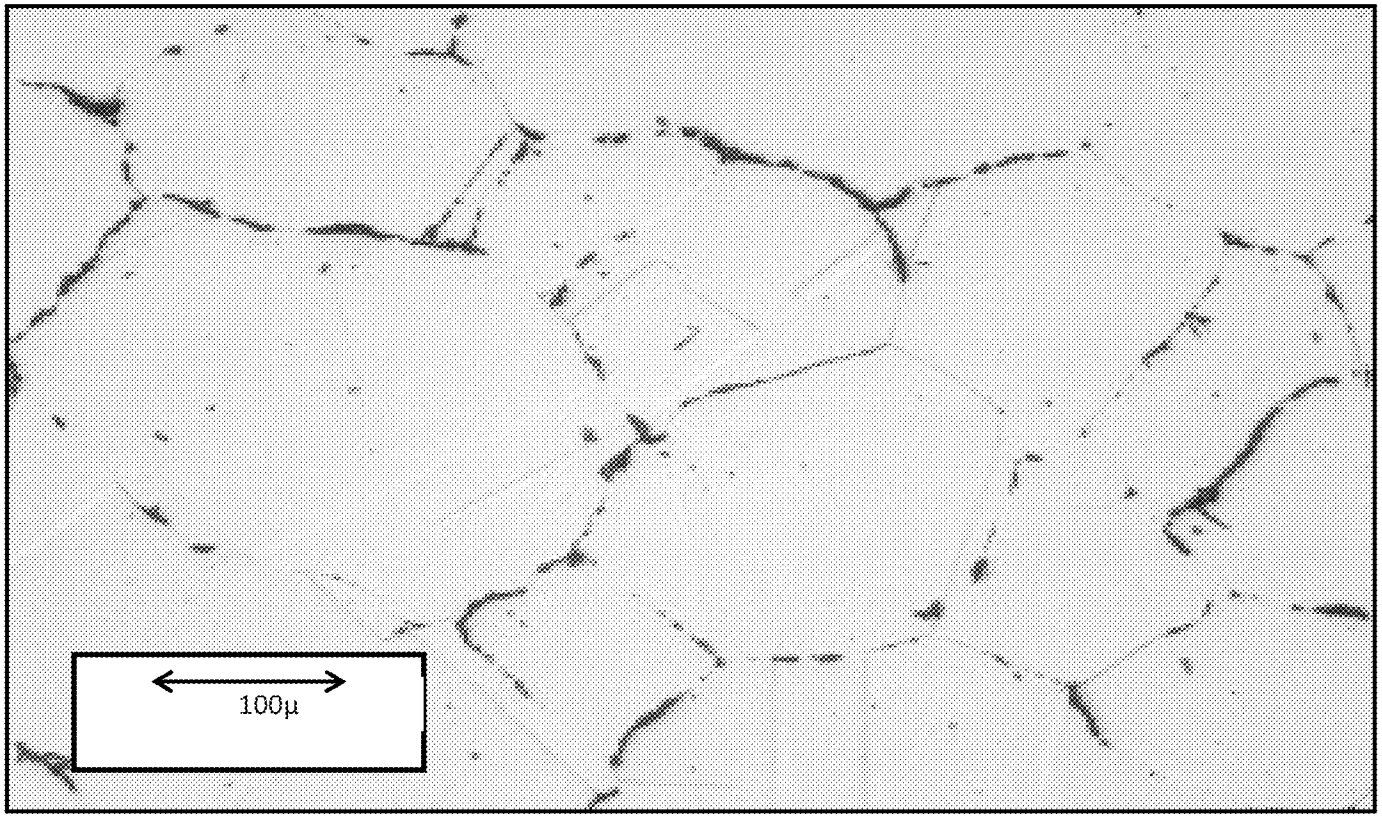
FIG. 7 (prior art)
FIG. 7 is a micrograph of a center region of an as-forged 9-inch diameter workpiece produced using an actual cooling time greater than the calculated critical cooling time required to avoid intermetallic precipitation of sigma phase according to the present disclosure.

FIG. 7 shows microstructures of the center of an as-forged 9-inch diameter workpiece having the composition of Heat 48FJ as disclosed in Table 1. The 9-inch workpiece was made as follows. A 20-inch diameter electroslag remelted (ESR) ingot was homogenized at 2225° F., reheated to 2150° F., hot worked on a radial forge to an approximately 14-inch workpiece, and air cooled. The 14 inch workpiece was reheated to 2200° F. and hot worked on a radial forge to about a 9-inch diameter workpiece, followed by water quenching. The relevant actual cooling time, i.e., the time to forge and then cool within the temperature range just below the 1859° F. calculated sigma solvus temperature calculated by Equation 1 down to the 1665° F. cooling temperature calculated by Equation 2, was greater than the 7.5 minute critical cooling time calculated by Equation 3 allowable to avoid intermetallic precipitation of sigma phase. As predicted from Equations 1-3, the micrograph of FIG. 7 shows that the microstructure of the as-forged 9-inch diameter workpiece contained deleterious intermetallic precipitates, most probably sigma, at the grain boundaries.

Example 2

Figure 8:
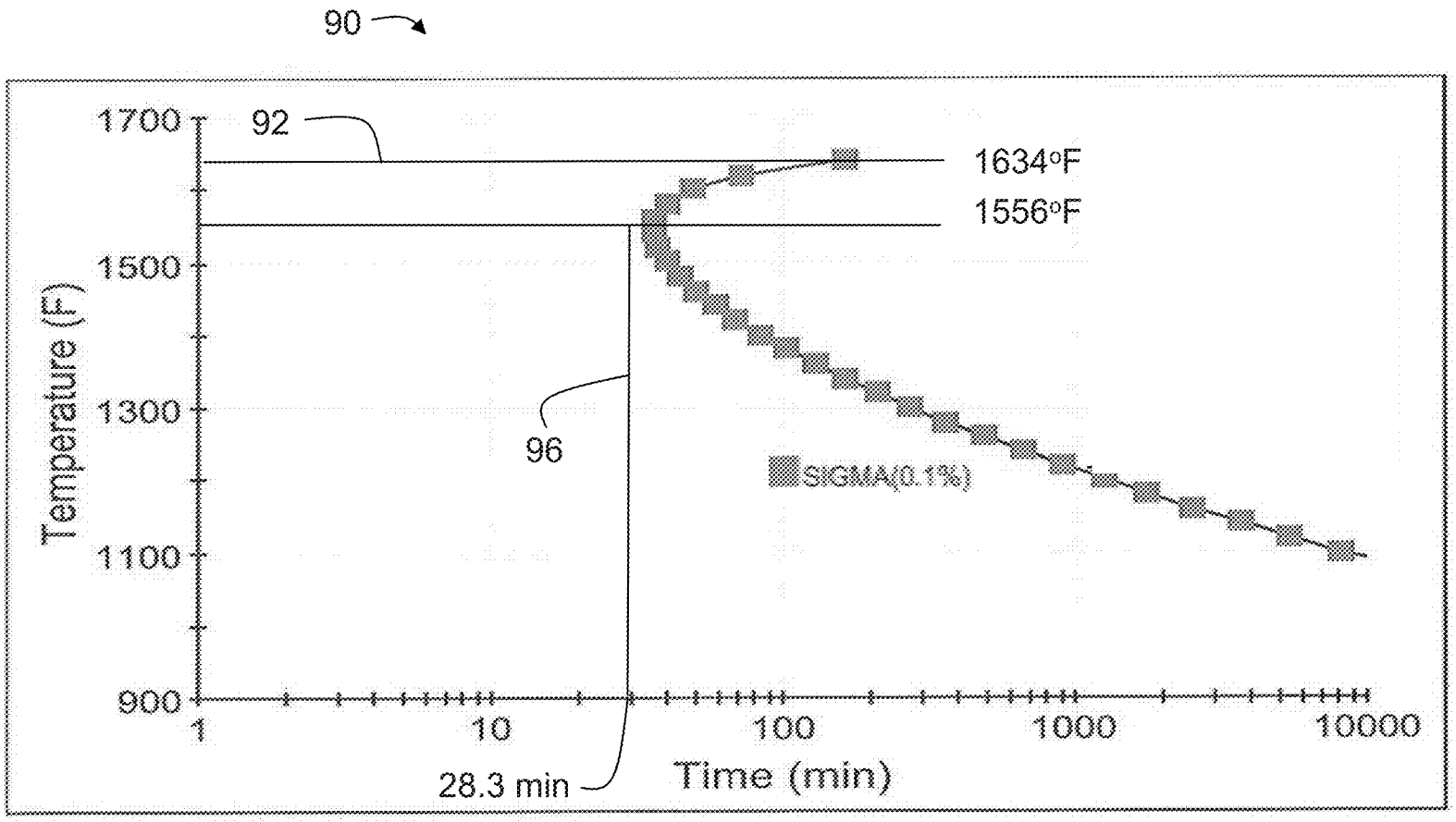
FIG. 8 is a TTT diagram for an embodiment of an alloy having a relatively long critical cooling time as calculated according to an embodiment of the present disclosure.

FIG. 8 shows an example of a TTT diagram 90 for an alloy that has a longer critical cooling time calculated using Equation 3 than the alloy of FIG. 6. The chemical composition of the alloy of FIG. 8 comprises, in weight percentages: 39.78 iron; 25.43 nickel; 20.91 chromium; 4.78 molybdenum; 4.47 manganese; 2.06 cobalt; 0.64 tungsten; 1.27 copper; 0.01 niobium; 0.24 silicon; 0.04 vanadium; 0.0070 carbon; 0.37 nitrogen; 0.015 phosphorus; and 0.0004 sulfur. The calculated sigma solvus temperature 92 for the alloy calculated according to Equation 1 is about 1634° F.; the cooling temperature 94 calculated according to Equation 2 is about 1556° F.; and the critical cooling time 96 calculated according to Equation 3 disclosure is about 28.3 minutes. According the method of the present disclosure, in order to prevent precipitation of the deleterious intermetallic phase within the alloy, the alloy must be formed and cooled when in the temperature range spanning a temperature just below the calculated sigma solvus temperature (1634° F.) down to the calculated cooling temperature (1556° F.) for a time no greater than the calculated critical cooling time (28.3 minutes).

Figure 9:
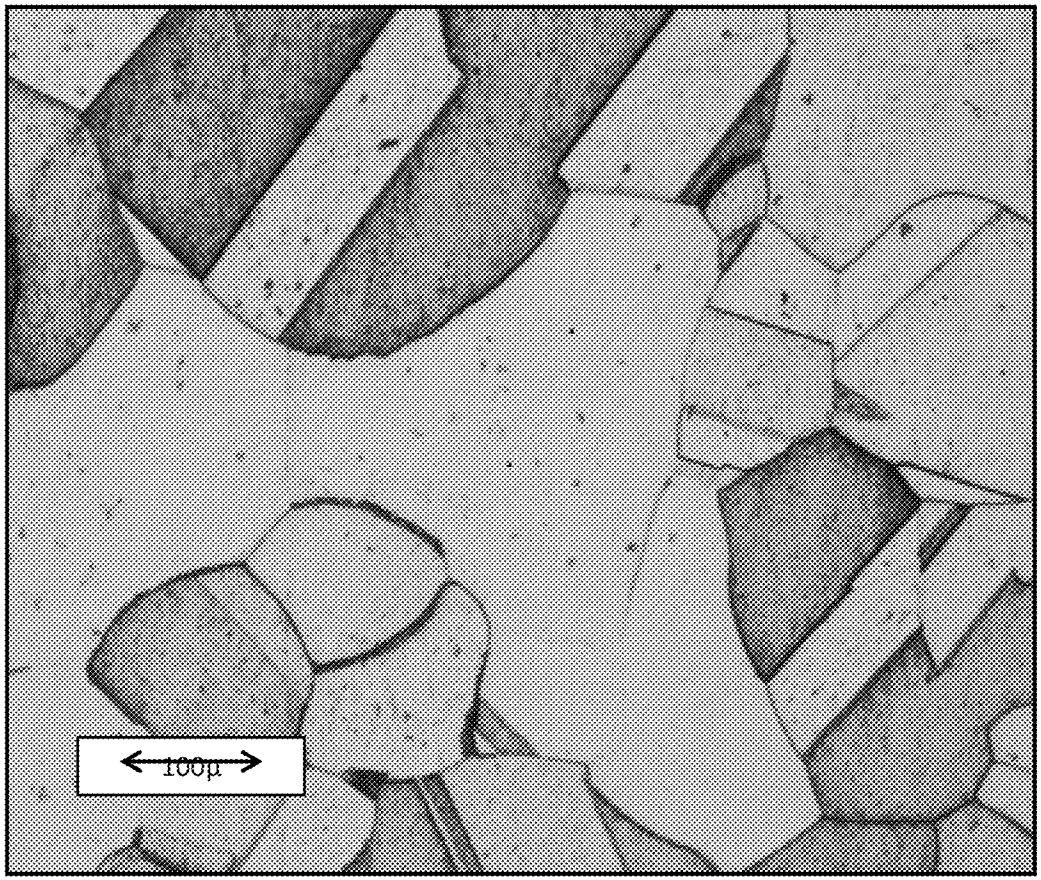
FIG. 9 is a micrograph showing the microstructure of the mid-radius of an as-forged 9-inch diameter workpiece using an actual cooling time less than the calculated critical cooling time to avoid intermetallic precipitation of sigma phase according to the present disclosure.

FIG. 9 shows the microstructure of the mid radius of an as-forged 9-inch diameter workpiece of the alloy. The workpiece was made as follows. An approximately 20-inch diameter ESR ingot of the alloy was homogenized at 2225° F., hot worked on a radial forge to about a 14-inch diameter workpiece, and air cooled. The cooled workpiece was reheated to 2200° F. and hot worked on a radial forge to about a 10-inch diameter workpiece, followed by water quenching. The relevant actual cooling time, i.e., the time for forging and cooling while in the temperature range spanning a temperature just below the calculated sigma solvus temperature calculated according to Equation 1 (1634° F.) down to the cooling temperature calculated according to Equation 2 (1556° F.), was less than the critical cooling time calculated according to Equation 3 (28.3 minutes) allowed to avoid intermetallic precipitation of sigma phase. As predicted from Equations 1-3, the micrograph of FIG. 9 shows that the microstructure of the as-forged 9-inch diameter workpiece did not contain deleterious intermetallic sigma phase precipitates at the grain boundaries. The darkened areas at the grain boundaries are attributed to metallographic etching artifacts and do not represent grain boundary precipitates.

Example 3

Figure 10:
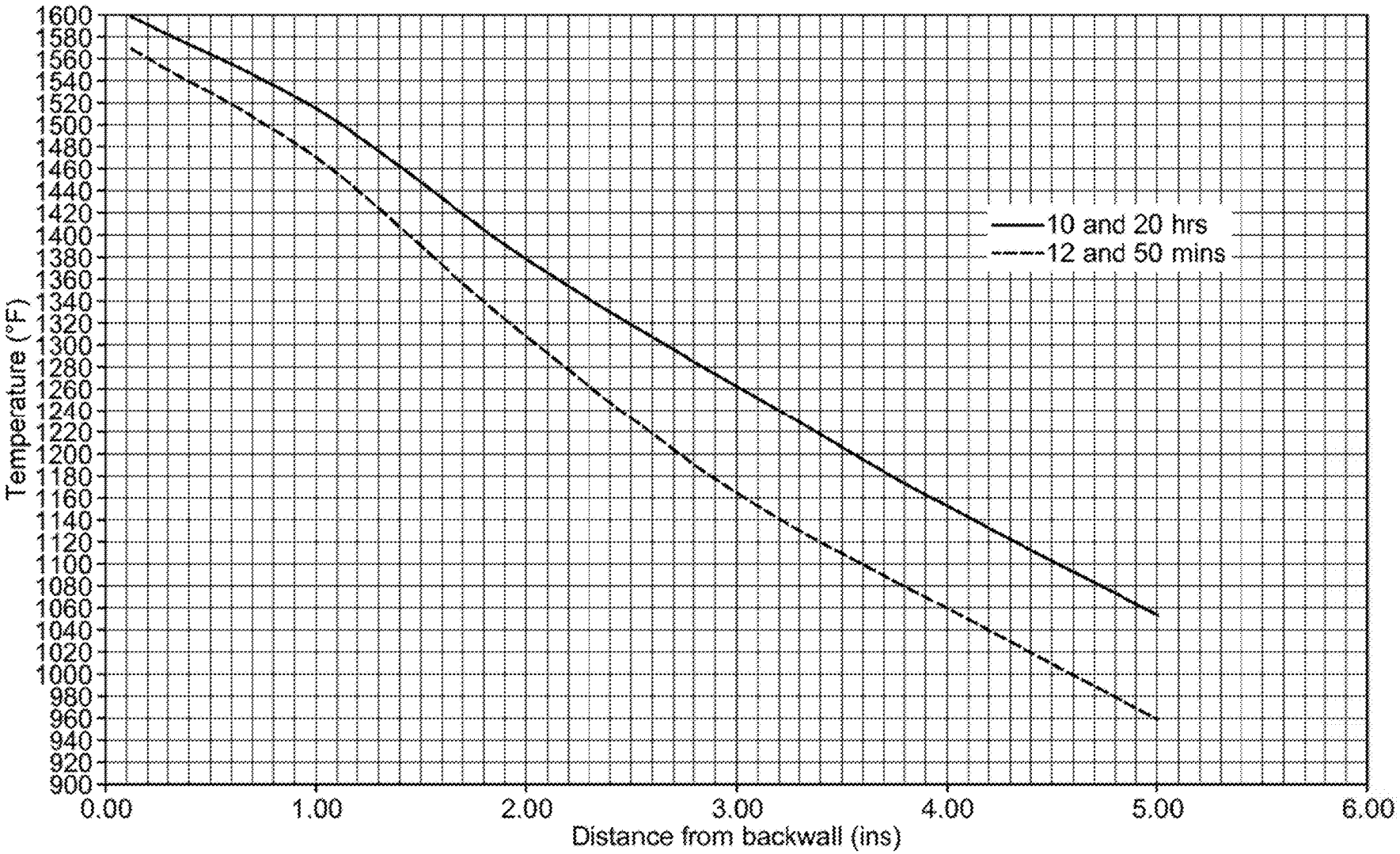
FIG. 10 is a plot of temperature versus distance from the back wall of a gradient furnace for heat treatments used in Example 3 of the present disclosure.

Samples of the non-magnetic austenitic alloy of heat number 49FJ (see Table 1) were provided. The alloy had a calculated sigma solvus temperature calculated according to Equation 1 of 1694° F. The alloy's cooling temperature calculated according to Equation 2 was 1600° F. The time to the nose of the C curve the TTT diagram (i.e., the critical cooling time) calculated according to Equation 3 was 15.6 minutes. The alloy samples were annealed at 1950° F. for 0.5 hours. The annealed samples were placed in a gradient furnace with the back wall of the furnace at approximately 1600° F., the front wall of the furnace at approximately 1000° F., and a gradient of intermediate temperatures within the furnace between the front and back wall. The temperature gradient in the furnace is reflected in the plot depicted in FIG. 10. The samples were placed at locations within the furnace so as to be subjected to temperatures of 1080° F., 1200° F., 1300° F., 1400° F., 1500° F., or 1550° F., and were heated for 12 minutes, 50 minutes, 10 hours, or 20 hours. The microstructure of each sample was evaluated at the particular heating temperature applied to the sample.

Figure 11:
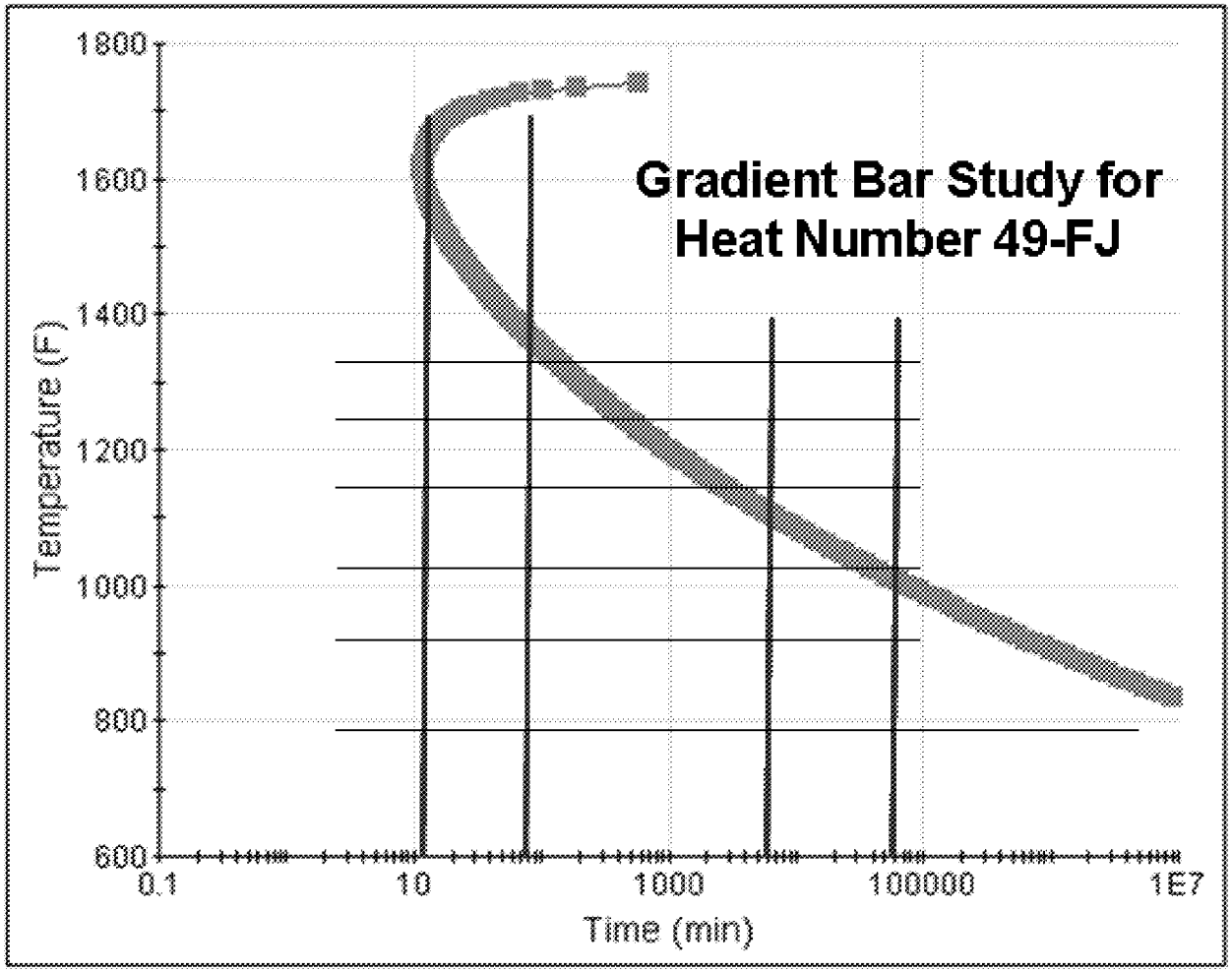
FIG. 11 is a TTT diagram plotting sampling temperature gradients (horizontal lines) and critical cooling times (vertical lines) used in Example 3 of the present disclosure.
Figure 12:
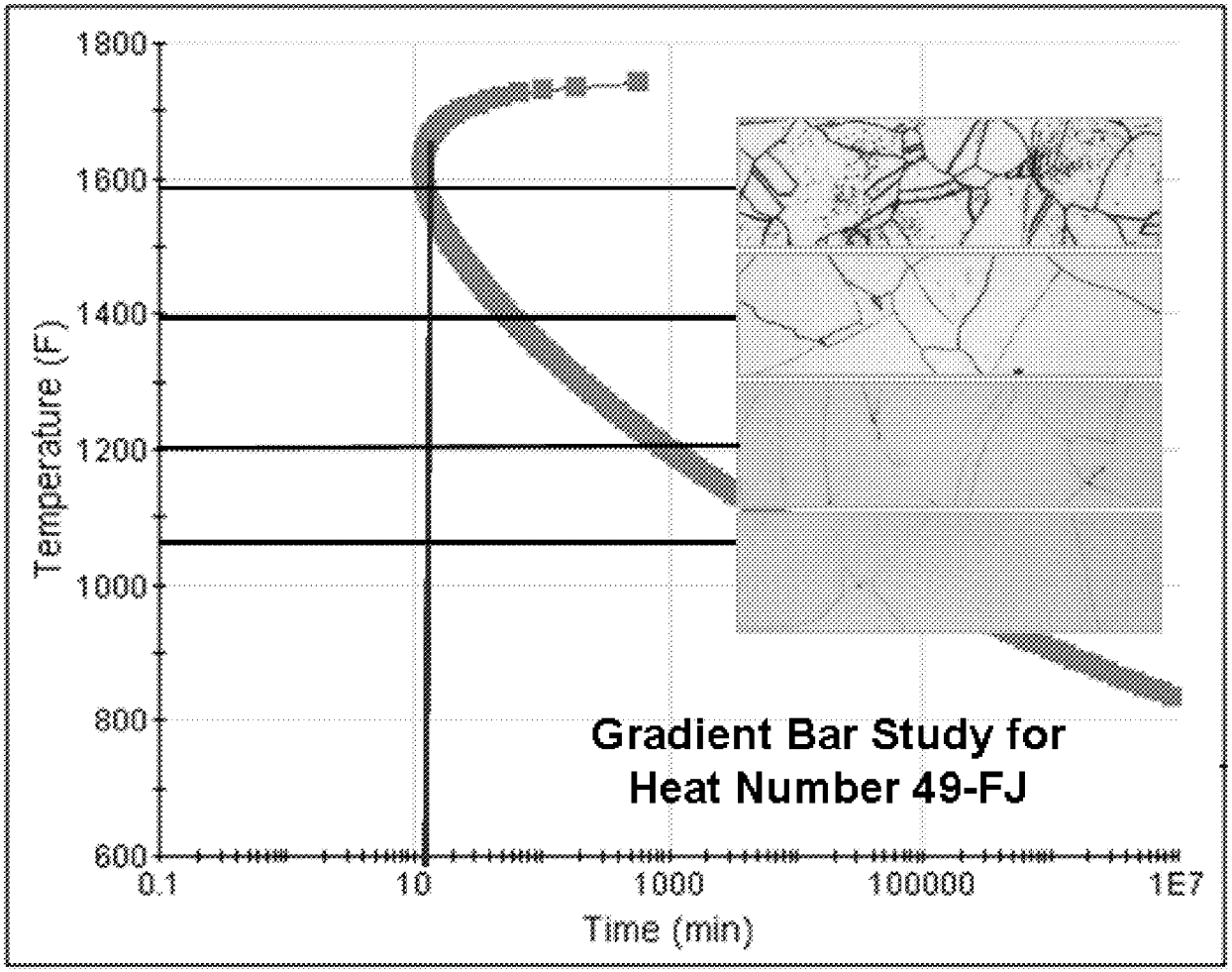
FIG. 12 is a figure superimposing microstructures from samples held for 12 minutes at various temperatures on a TTT diagram for Example 3 of the present disclosure.
Figure 13:
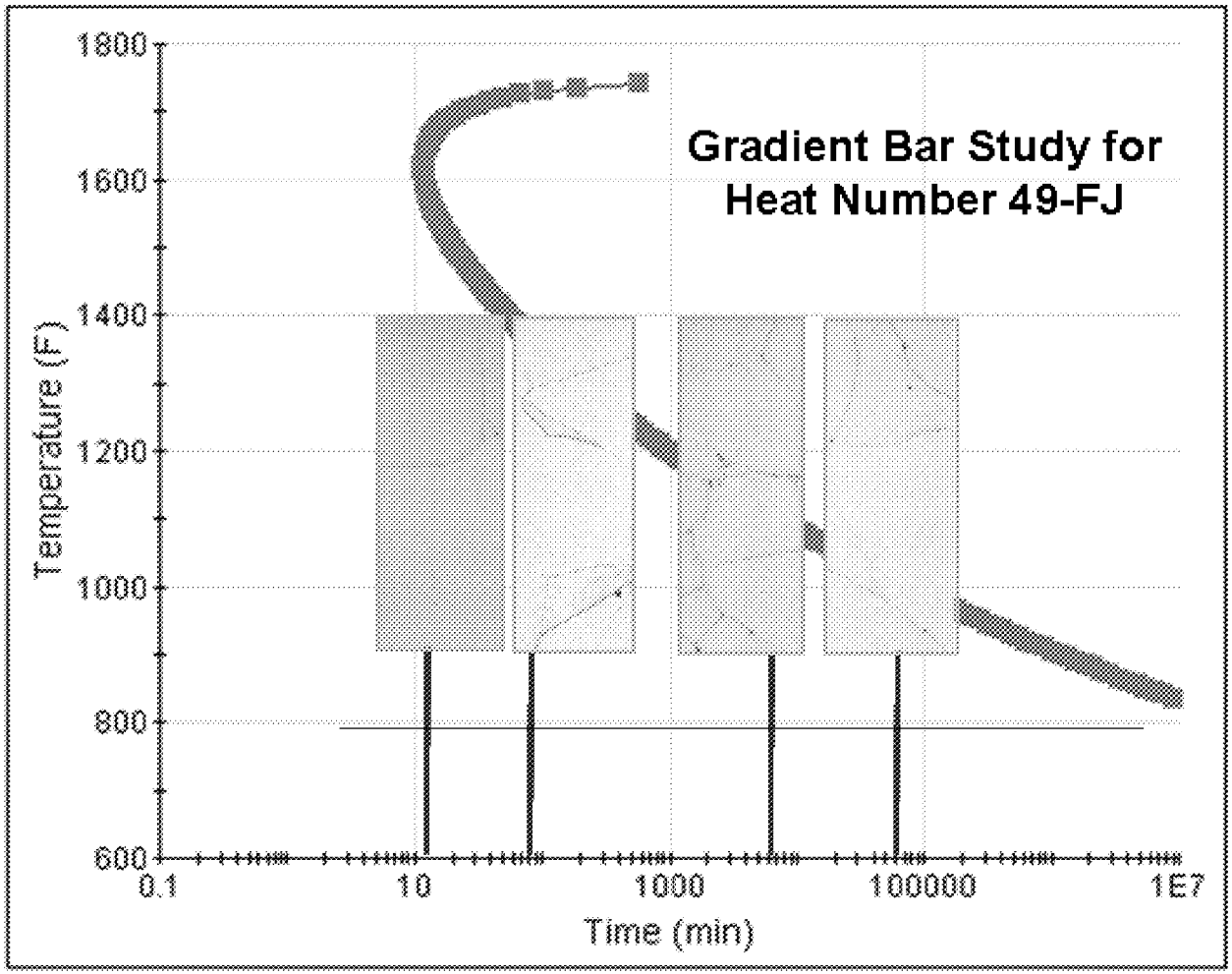
FIG. 13 is a figure superimposing microstructures for samples held at 1080° F. for various times on a TTT diagram for Example 3 of the present disclosure.

FIG. 11 is a TTT diagram with the heating temperature gradients (horizontal lines) and the actual cooling times (vertical lines) that were used in these experiments. FIG. 12 superimposes microstructures from samples held for 12 minutes at various temperatures on the TTT diagram. FIG. 13 superimposes microstructures from samples held at 1080° F. for various times on the TTT diagram. In general, the results confirm the accuracy of the TTT diagrams in that precipitation of the intermetallic phase addressed herein occurred at approximately the temperatures and times defined by the TTT diagram.

Example 4

A 20-inch diameter ESR ingot having the chemistry of Heat 48FJ was provided. The alloy had a calculated sigma solvus temperature calculated using Equation 1 of 1851° F. The cooling temperature calculated according to Equation 2 was 1659° F. The time to the nose of the C curve the TTT diagram (i.e., the critical cooling time) calculated according to Equation 3 was 8.0 minutes. The ESR ingot was homogenized at 2225° F., reheated to 2225° F. and hot worked on a radial forge to approximately a 14-inch diameter workpiece, and then air cooled. The cooled 14-inch diameter workpiece was reheated to 2225° F. and hot worked on a radial forge to approximately a 10-inch diameter workpiece, followed by water quenching. Optical temperature measurements during the radial forging operation indicated that the temperature at the surface was approximately 1778° F., and as the radial forged workpiece was entering the water quenching tank, the surface temperature was about 1778° F. The radial forged and water quenched workpiece was annealed at 2150° F. and then water quenched.

Figure 14B:
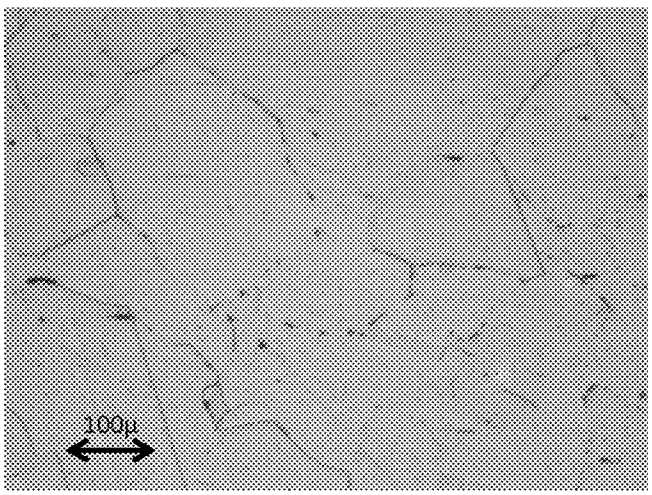
FIG. 14B is a micrograph showing the microstructure at a center region of an alloy of Example 4 of the present disclosure that was annealed but did not cool within the calculated critical cooling time according to the present disclosure and exhibits sigma phase precipitates.
Figure 14A:
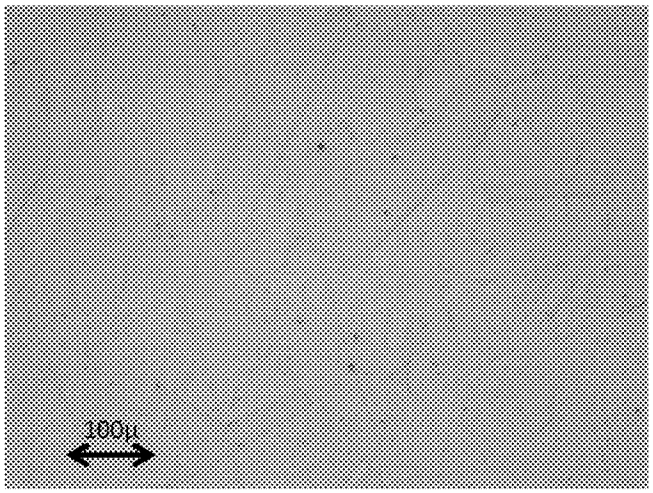
FIG. 14A is a micrograph showing the microstructure of a surface region of an alloy of Example 4 of the present disclosure that was annealed and cooled within the calculated critical cooling time according to the present disclosure and is devoid of sigma phase precipitates.

FIG. 14A shows the microstructure at the surface of the annealed radial forged workpiece. FIG. 14B shows the microstructure at the center of the annealed radial forged workpiece. The 2150° F. annealing step solutionizes the sigma phase that was formed during the radial forging operation. The calculated critical cooling time of 8.0 minutes, however, is insufficient to prevent sigma phase formation at the center of the ingot as the ingot cools from a temperature just below the 1851° F. calculated sigma solvus temperature to the 1659° F. calculated cooling temperature during the water quenching operation. The photomicrograph of FIG. 14A shows that the surface cooled sufficiently rapidly to avoid sigma phase precipitation, but the micrograph of FIG. 14B shows that cooling at the center of the ingot occurred slowly enough to permit precipitation of sigma phase. The center of the ingot cooled from the calculated sigma solvus temperature calculated by Equation 1 to the cooling temperature calculated by Equation 2 in a time period greater than the critical cooling time calculated by Equation 3.

Example 5

A 20-inch diameter ESR ingot having the chemistry of Heat 45FJ was provided. The alloy had a calculated sigma solvus temperature calculated using Equation 1 of 1624° F. The cooling temperature calculated according to Equation 2 was 1561° F. The time to the nose of the C curve the TTT diagram (i.e., the critical cooling time) was 30.4 minutes. The ESR ingot was homogenized at 2225° F., reheated to 2225° F. and hot worked on a radial forge to approximately a 14 inch diameter workpiece, and then air cooled. The workpiece was reheated to 2225° F. and hot worked on a radial forge to approximately a 10-inch diameter workpiece, followed by water quenching. Optical temperature measurements during the radial forging operation indicated that the workpiece surface temperature was approximately 1886° F., and as the radial forged workpiece was entering the water quenching tank, the surface temperature was about 1790° F.

Figure 15B:
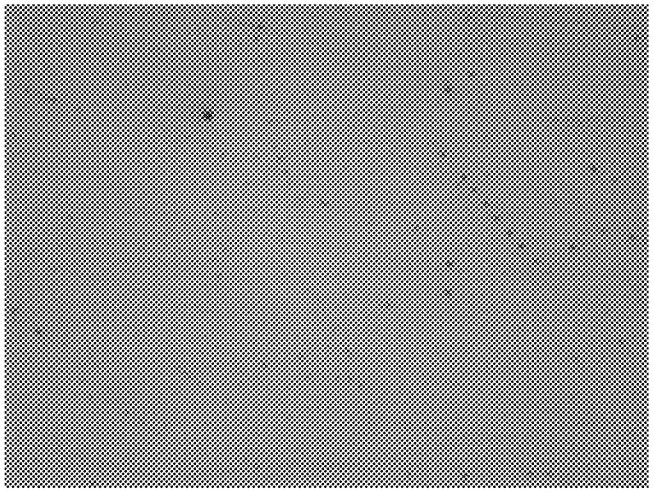
FIG. 15B is a micrograph showing the microstructure at a center region of an alloy of Example 5 of the present disclosure that was forged and cooled within the calculated critical cooling time according to the present disclosure and is devoid of sigma phase precipitates.
Figure 15A:
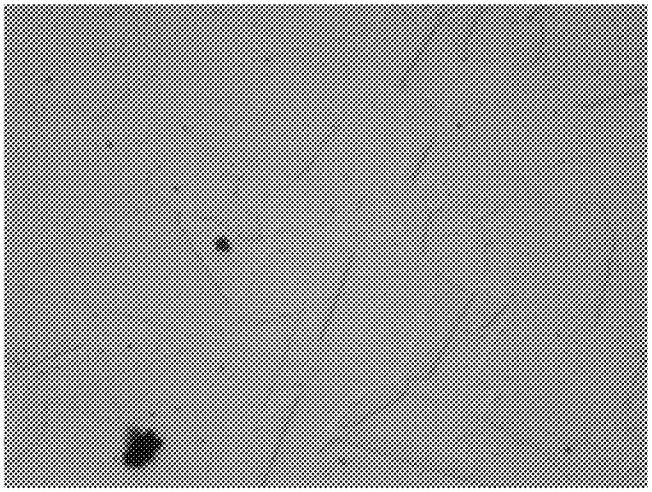
FIG. 15A is a micrograph showing the microstructure of a surface region of an alloy of Example 5 of the present disclosure that was forged and cooled within the calculated critical cooling time according to the present disclosure and is devoid of sigma phase precipitates.

FIG. 15A shows the microstructure at the surface of the radial forged and water quenched workpiece. FIG. 15B shows the microstructure at the center of the radial forged and water quenched workpiece. The microstructures shown in both FIG. 15A and FIG. 15B are devoid of sigma precipitation. This confirms that the actual time to cool from a temperature just below the calculated sigma solvus temperature of 1624° F. down to the calculated cooling temperature of 1561° F. was sufficiently quick (i.e., was less than 30.4 minutes) to avoid precipitation of sigma phase at both the surface and the center of the radial forged and water quenched workpiece.

Example 6

A 20-inch diameter ESR ingot having the chemistry of Heat 48FJ was provided. The Heat 48FJ alloy had a calculated sigma solvus temperature calculated using Equation 1 of 1851° F. The cooling temperature calculated according to Equation 2 was 1659° F. The time to the nose of the C curve of the TTT diagram (i.e., the critical cooling time) calculated according to Equation 3 was 8.0 minutes. A second 20-inch diameter ESR ingot, having the chemistry of Heat 49FJ, was provided. The Heat 49FJ alloy had a calculated sigma solvus temperature calculated using Equation 1 of 1694° F. The cooling temperature calculated according to Equation 2 was 1600° F. The time to the nose of the C curve of the TTT diagram (i.e., the critical cooling time) calculated according to Equation 3 was 15.6 minutes.

Both ingots were homogenized at 2225° F. The homogenized ingots were reheated to 2225° F. and hot worked on a radial forge to approximately 14-inch diameter workpieces, followed by air cooling. Both cooled workpieces were reheated to 2225° F. and hot worked on a radial forge to approximately 10-inch diameter workpieces, followed by water quenching.

Figure 16B:
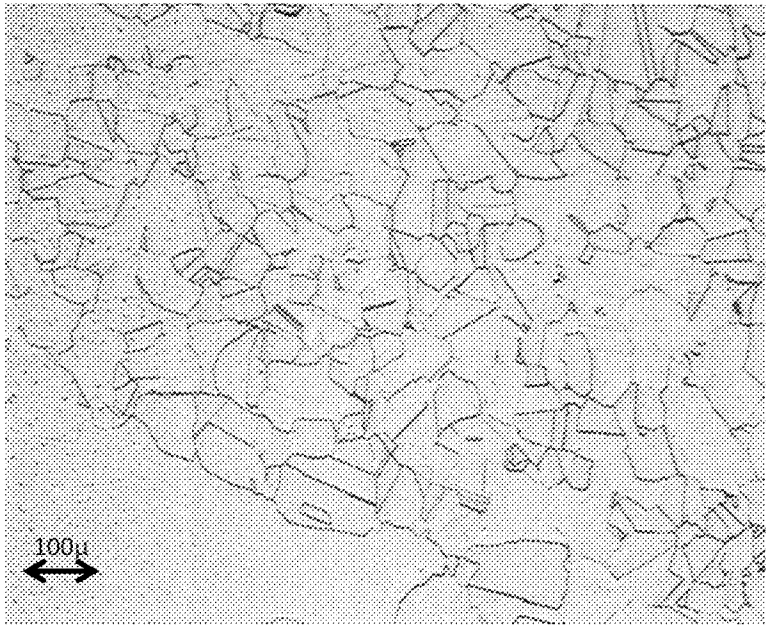
FIG. 16B is a micrograph showing the microstructure at a mid-radius of an alloy of Example 6 of the present disclosure that was forged and cooled for a time within the calculated critical cooling time according to the present disclosure and does not exhibit sigma phase precipitates at the grain boundaries.
Figure 16A:
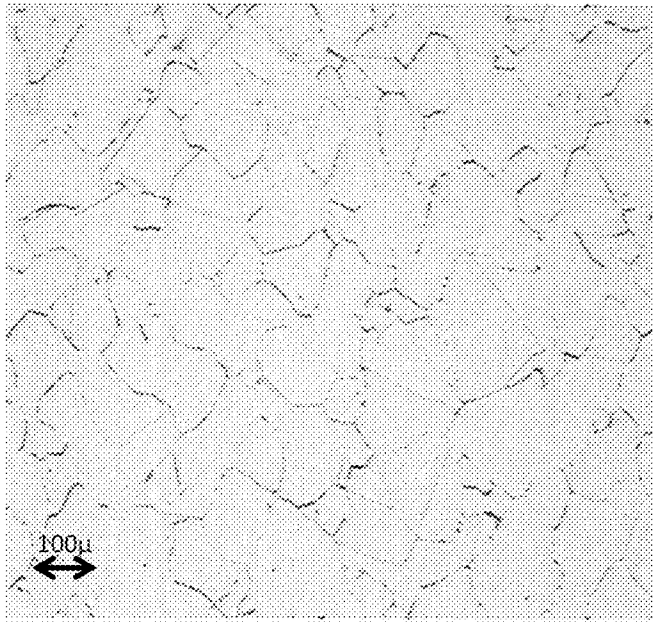
FIG. 16A is a micrograph showing the microstructure at a mid-radius of an alloy of Example 6 of the present disclosure that was forged and cooled for a time that exceeded the calculated critical cooling time according to the present disclosure and exhibits sigma phase precipitates at the grain boundaries.

Optical temperature measurements during the radial forging operation of the Heat 48FJ ingot indicated that the temperature at the surface was approximately 1877° F., and entering the water quenching tank, the surface temperature was about 1778° F. FIG. 16A shows the center microstructure of the alloy, which included sigma phase precipitates at the grain boundary.

Optical temperature measurements during the radial forging operation of the Heat 49FJ ingot indicated that the temperature at the surface was approximately 1848° F., and entering the water quenching tank the surface temperature was about 1757° F. FIG. 16B shows the center microstructure of the alloy, which is devoid of sigma phase precipitates. Dark regions at the grain boundaries in the micrograph of FIG. 16B are attributed to metallographic etching artifacts.

These results demonstrate that even when processed under essentially identical conditions, the workpiece with the shorter critical cooling time as calculated by Equation 3 (Heat 48FJ) developed sigma phase at its center, whereas the workpiece with the longer critical cooling time (Heat 49FJ) as calculated by Equation 3 did not develop sigma phase precipitates at its center.

Example 7

A 20-inch diameter ESR ingot having the chemistry of Heat 49FJ was provided. The Heat 49FJ alloy had a calculated sigma solvus temperature calculated using Equation 1 of 1694° F. The cooling temperature calculated according to Equation 2 was 1600° F. The time to the nose of the C curve of the TTT diagram (i.e., the critical cooling time) calculated according to Equation 3 was 15.6 minutes. The ingot was homogenized at 2225° F., reheated to 2225° F. and hot worked on a radial forge to approximately a 14-inch diameter workpiece, and then air cooled. The air cooled workpiece was reheated to 2150° F. and hot worked on a radial forge to approximately a 9-inch diameter workpiece, followed by water quenching. Optical temperature measurements during the radial forging operation indicated that the temperature at the surface was approximately 1800° F., and as the radial forged workpiece was entering the water quenching tank, the surface temperature was about 1700° F. The forged and water quenched workpiece was then reheated to 1025° F. and warm worked on a radial forged to approximately a 7.25-inch diameter workpiece, followed by air cooling.

Figure 17B:
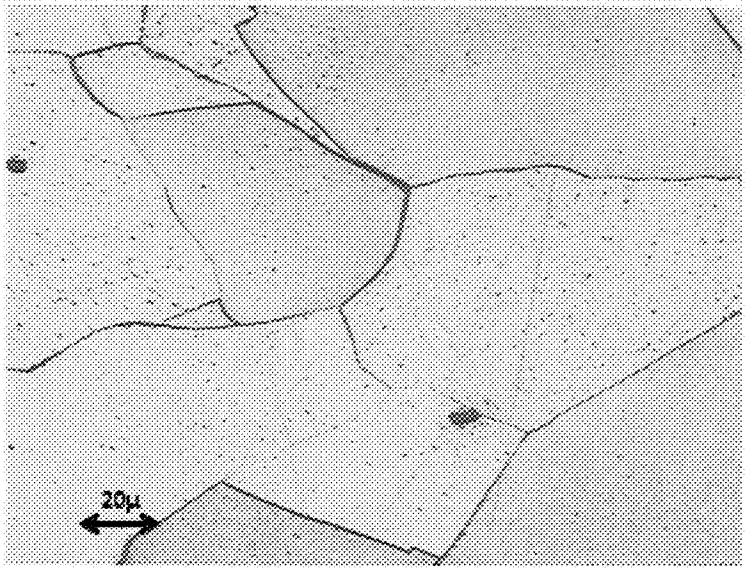
FIG. 17B is a micrograph showing the microstructure of a center region of an alloy of Example 7 of the present disclosure that was forged and cooled for a time within the calculated critical cooling time according to the present disclosure and then warm worked without exhibiting sigma phase precipitates at the grain boundaries.
Figure 17A:
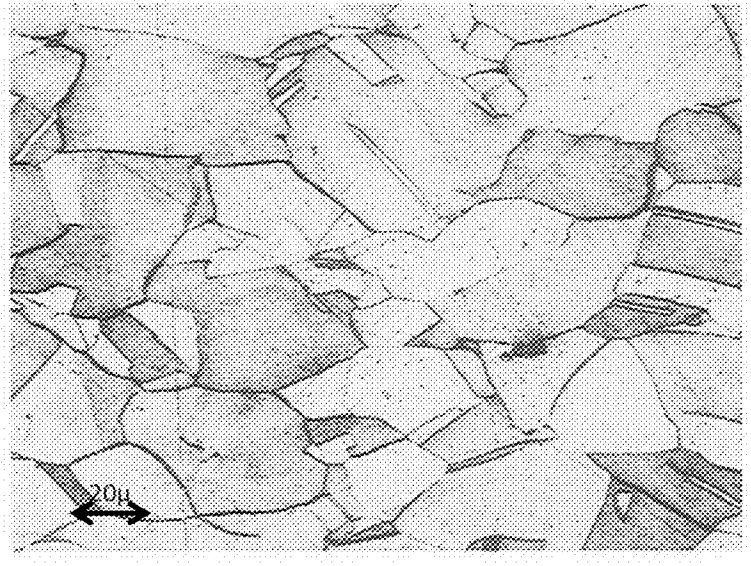
FIG. 17A is a micrograph showing the microstructure of a surface region of an alloy of Example 7 of the present disclosure that was forged and cooled for a time within the calculated critical cooling time according to the present disclosure and then warm worked without exhibiting sigma phase precipitates at the grain boundaries.

The microstructure of the surface of the 7.25-inch diameter workpiece is shown in FIG. 17A, and the microstructure of the center of the 7.25-inch diameter workpiece is shown in FIG. 17B. The micrographs show that there was no sigma phase at either the surface or the center of the workpiece. In this example, the workpiece having the chemistry of Heat 49FJ was processed through the relevant temperature range, i.e., the temperature range bounded by a temperature just below the calculated sigma solvus temperature and down to the calculated cooling temperature, in less than the calculated critical cooling time, thereby avoiding precipitation of sigma phase.

It will be understood that the present description illustrates those aspects of the invention relevant to a clear understanding of the invention. Certain aspects that would be apparent to those of ordinary skill in the art and that, therefore, would not facilitate a better understanding of the invention have not been presented in order to simplify the present description. Although only a limited number of embodiments of the present invention are necessarily described herein, one of ordinary skill in the art will, upon considering the foregoing description, recognize that many modifications and variations of the invention may be employed. All such variations and modifications of the invention are intended to be covered by the foregoing description and the following claims.

What is claimed is:

1. A method of processing a workpiece to inhibit precipitation of intermetallic compounds, the method comprising:

at least one of thermomechanically working and cooling a workpiece including an austenitic alloy, wherein during the at least one of thermomechanically working and cooling the workpiece, the austenitic alloy is at temperatures in a temperature range spanning a temperature just less than a calculated sigma solvus temperature of the austenitic alloy down to a cooling temperature for a time no greater than a critical cooling time;

wherein the austenitic alloy comprises, in weight percentages based on total alloy weight, up to 0.2 carbon, up to 20 manganese, 0.1 to 1.0 silicon, 14.0 to 28.0 chromium, 15.0 to 32.0 nickel, 2.0 to 9.0 molybdenum, 0.1 to 3.0 copper, 0.08 to 0.9 nitrogen, 0.1 to 5.0 tungsten, 0.5 to 5.0 cobalt, up to 1.0 titanium, up to 0.05 boron, up to 0.05 phosphorus, up to 0.05 sulfur, 20 to 60 iron, and incidental impurities;

wherein the calculated sigma solvus temperature is a function of the composition of the austenitic alloy in weight percentages and, in Fahrenheit degrees, is equal to 1155.8−(760.4)·(nickel/iron)+(1409)·(chromium/iron)+(2391.6)·(molybdenum/iron)−(288.9)·(manganese/iron)−(634.8)·(cobalt/iron)+(107.8)·(tungsten/iron);

wherein the cooling temperature is a function of the composition of the austenitic alloy in weight percentages and, in Fahrenheit degrees, is equal to 1290.7−(604.2)·(nickel/iron)+(829.6)·(chromium/iron)+(1899.6)·(molybdenum/iron)−(635.5)·(cobalt/iron)+(1251.3)·(tungsten/iron); and wherein the critical cooling time is a function of the composition of the austenitic alloy in weight percentages and, in minutes, is equal to, in $\log_{10}$, 2.948+(3.631)·(nickel/iron)−(4.846)·(chromium/iron)−(11.157)·(molybdenum/iron)+(3.457)·(cobalt/iron)−(6.74)·(tungsten/iron), and wherein the critical cooling time is in a range of 10 minutes to 30 minutes.

2. The method of claim 1, wherein thermomechanically working the workpiece comprises forging the workpiece.

3. The method of claim 2, wherein forging the workpiece comprises at least one of roll forging, swaging, cogging, open-die forging, impression-die forging, press forging, automatic hot forging, radial forging, and upset forging.

4. The method of claim 1, wherein thermomechanically working the workpiece comprises radial forging the workpiece.

5. The method of claim 1, further comprising, after at least one of thermomechanically working and cooling the workpiece:

heating the workpiece to an annealing temperature that is at least as great as the calculated sigma solvus temperature, and holding the workpiece at the annealing temperature for a period of time sufficient to anneal the workpiece;

wherein as the workpiece cools from the annealing temperature, the austenitic alloy is at temperatures in a temperature range spanning a temperature just less than the calculated sigma solvus temperature down to the cooling temperature for a time no greater than the critical cooling time.

6. The method of claim 1, wherein the austenitic alloy comprises a combined weight percentage of niobium and tantalum no greater than 0.3.

7. The method of claim 1, wherein the austenitic alloy comprises up to 0.2 weight percent vanadium.

8. The method of claim 1, wherein the austenitic alloy comprises up to 0.1 weight percent aluminum.

9. The method of claim 1, wherein the austenitic alloy comprises a combined weight percentage of cerium and lanthanum no greater than 0.1.

10. The method of claim 1, wherein the austenitic alloy comprises up to 0.5 weight percent ruthenium.

11. The method of claim 1, wherein the austenitic alloy comprises up to 0.6 weight percent zirconium.

12. The method of claim 1, wherein the austenitic alloy comprises a cobalt/tungsten weight percentage ratio from 2:1 to 4:1.

13. The method of claim 1, wherein the austenitic alloy has a $PREN_{16}$ value of greater than 40, wherein the $PREN_{16}$ value is determined by the equation:

$$PREN_{16}=\%\ Cr+3.3(\%\ Mo)+16(\%\ N)+1.65(\%\ W),$$

wherein the percentages are weight percentages.

14. The method of claim 1, wherein the austenitic alloy has a $PREN_{16}$ value in the range of 40 to 60, wherein the $PREN_{16}$ value is determined by the equation:

$$PREN_{16}=\%\ Cr+3.3(\%\ Mo)+16(\%\ N)+1.65(\%\ W),$$

wherein the percentages are weight percentages.

15. The method of claim 1, wherein the austenitic alloy is non-magnetic.

16. The method of claim 1, wherein the austenitic alloy has a magnetic permeability value less than 1.01.

17. The method of claim 1, wherein the austenitic alloy has an ultimate tensile strength of at least 110 ksi, a yield strength of at least 50 ksi, and a percent elongation of at least 15%.

18. The method of claim 1, wherein the austenitic alloy has an ultimate tensile strength in the range of 90 ksi to 150 ksi, a yield strength in the range of 50 ksi to 120 ksi, and a percent elongation in the range of 20% to 65%.

19. The method of claim 1, wherein the austenitic alloy has an ultimate tensile strength in the range of 100 ksi to 240 ksi, a yield strength in the range of 110 ksi to 220 ksi, and a percent elongation in the range of 15% to 30%.

20. The method of claim 1, wherein the austenitic alloy has a critical pitting temperature of at least 45° C.

21. The method of claim 1, wherein the austenitic alloy comprises, in weight percentages based on total alloy weight: up to 0.05 carbon; 1.0 to 9.0 manganese; 0.1 to 1.0 silicon; 18.0 to 26.0 chromium; 19.0 to 32.0 nickel; 3.0 to 7.0 molybdenum; 0.4 to 2.5 copper; 0.1 to 0.55 nitrogen; 0.2 to 3.0 tungsten; 0.8 to 3.5 cobalt; up to 0.6 titanium; a combined weight percentage of niobium and tantalum no greater than 0.3; up to 0.2 vanadium; up to 0.1 aluminum; up to 0.05 boron; up to 0.05 phosphorus; up to 0.05 sulfur; 20 to 50 iron; and incidental impurities.

22. The method of claim 21, wherein the austenitic alloy comprises 2.0 to 8.0 weight percent manganese.

23. The method of claim 21, wherein the austenitic alloy comprises 19.0 to 25.0 weight percent chromium.

24. The method of claim 21, wherein the austenitic alloy comprises 20.0 to 32.0 weight percent nickel.

25. The method of claim 21, wherein the austenitic alloy comprises 3.0 to 6.5 weight percent molybdenum.

26. The method of claim 21, wherein the austenitic alloy comprises 0.5 to 2.0 weight percent copper.

27. The method of claim 21, wherein the austenitic alloy comprises 0.3 to 2.5 weight percent tungsten.

28. The method of claim 21, wherein the austenitic alloy comprises 1.0 to 3.5 weight percent cobalt.

29. The method of claim 21, wherein the austenitic alloy comprises 0.2 to 0.5 weight percent nitrogen.

30. The method of claim 1, wherein the austenitic alloy comprises, in weight percentages based on total alloy weight: up to 0.05 carbon; 2.0 to 8.0 manganese; 0.1 to 0.5 silicon; 19.0 to 25.0 chromium; 20.0 to 32.0 nickel; 3.0 to 6.5 molybdenum; 0.5 to 2.0 copper; 0.2 to 0.5 nitrogen; 0.3 to 2.5 tungsten; 1.0 to 3.5 cobalt; up to 0.6 titanium; a combined weight percentage of niobium and tantalum no greater than 0.3; up to 0.2 vanadium; up to 0.1 aluminum; up to 0.05 boron; up to 0.05 phosphorus; up to 0.05 sulfur; 20 to 50 iron; trace elements; and incidental impurities.

31. The method of claim 30, wherein the austenitic alloy comprises 2.0 to 6.0 weight percent manganese.

32. The method of claim 30, wherein the austenitic alloy comprises 20.0 to 25.0 weight percent chromium.

33. The method of claim 30, wherein the austenitic alloy comprises 6.0 to 6.5 weight percent molybdenum.

34. The method of claim 31, wherein the austenitic alloy comprises 20 to 45 weight percent iron.

35. A method of processing an austenitic alloy workpiece to inhibit precipitation of intermetallic compounds, the method comprising:

forging the workpiece;

cooling the forged workpiece; and optionally, annealing the cooled workpiece;

wherein the austenitic alloy comprises, in weight percentages based on total alloy weight, up to 0.2 carbon, up to 20 manganese, 0.1 to 1.0 silicon, 14.0 to 28.0 chromium, 15.0 to 32.0 nickel, 2.0 to 9.0 molybdenum, 0.1 to 3.0 copper, 0.08 to 0.9 nitrogen, 0.1 to 5.0 tungsten, 0.5 to 5.0 cobalt, up to 1.0 titanium, up to 0.05 boron, up to 0.05 phosphorus, up to 0.05 sulfur, 20 to 60 iron, and incidental impurities;

wherein during forging the workpiece and cooling the forged workpiece the austenitic alloy cools through a temperature range spanning a temperature just less than a calculated sigma solvus temperature of the austenitic alloy down to a cooling temperature for a time no greater than a critical cooling time;

wherein the calculated sigma solvus temperature is a function of the composition of the austenitic alloy in weight percentages and, in Fahrenheit degrees, is equal to 1155.8−(760.4)·(nickel/iron)+(1409)·(chromium/iron)+(2391.6)·(molybdenum/iron)−(288.9)·(manganese/iron)−(634.8)·(cobalt/iron)+(107.8)·(tungsten/iron);

wherein the cooling temperature is a function of the composition of the austenitic alloy in weight percentages and, in Fahrenheit degrees, is equal to 1290.7−(604.2)·(nickel/iron)+(829.6)·(chromium/iron)+(1899.6)·(molybdenum/iron)−(635.5)·(cobalt/iron)+(1251.3)·(tungsten/iron); and wherein the critical cooling time is a function of the composition of the austenitic alloy in weight percentages and, in minutes, is equal to, in $\log_{10}$, 2.948+(3.631)·(nickel/iron)−(4.846)·(chromium/iron)−(11.157)·(molybdenum/iron)+(3.457)·(cobalt/iron)−(6.74)·(tungsten/iron), and wherein the critical cooling time is in a range of 10 minutes to 30 minutes.

36. The method of claim 35, wherein forging the workpiece occurs entirely at temperatures greater than the calculated sigma solvus temperature.

37. The method of claim 35, wherein forging the workpiece occurs through the calculated sigma solvus temperature.

38. The method of claim 35, wherein forging the workpiece comprises at least one of roll forging, swaging, cogging, open-die forging, impression-die forging, press forging, automatic hot forging, radial forging, and upset forging.

* * * * *